US012246226B2

(12) United States Patent
Mizutani et al.

(10) Patent No.: US 12,246,226 B2
(45) Date of Patent: Mar. 11, 2025

(54) GOLF CLUB HEAD

(71) Applicant: SUMITOMO RUBBER INDUSTRIES, LTD., Kobe (JP)

(72) Inventors: Naruhiro Mizutani, Kobe (JP); Daisuke Kohno, Kobe (JP); Hirotaka Nakamura, Kobe (JP); Jun Kodaka, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 215 days.

(21) Appl. No.: 17/902,437

(22) Filed: Sep. 2, 2022

(65) Prior Publication Data

US 2023/0080945 A1 Mar. 16, 2023

(30) Foreign Application Priority Data

Sep. 3, 2021 (JP) ..... 2021-144283

(51) Int. Cl.
*A63B 53/04* (2015.01)

(52) U.S. Cl.
CPC ..... *A63B 53/0412* (2020.08); *A63B 53/0437* (2020.08); *A63B 53/0466* (2013.01); *A63B 2209/023* (2013.01)

(58) Field of Classification Search
CPC ..... A63B 53/0412; A63B 2209/023; A63B 53/0437; A63B 53/0466
See application file for complete search history.

(56) References Cited

U.S. PATENT DOCUMENTS 1,587,758 A * 6/1926 Charavay ..... A63B 53/04 473/327
3,595,577 A * 7/1971 Hodge ..... A63B 53/04 473/314

(Continued)

FOREIGN PATENT DOCUMENTS

JP 2020-171434 A 10/2020
WO WO-2011094188 A1 * 8/2011 ..... A63B 53/0466

OTHER PUBLICATIONS

@nd Swing, Taylormade R510 Driver, https://www.2ndswing.com/golf-clubs/drivers/taylormade-r510-driver/right-handed-stiff-graphite-44dot25in-d-d2335072641, 2002.*

(Continued)

*Primary Examiner* — William M Pierce
(74) *Attorney, Agent, or Firm* — Birch, Stewart, Kolasch & Birch, LLP

(57) ABSTRACT

A state of a head placed such that its shaft axis is vertical to a horizontal plane and a face normal line is parallel to a perpendicular plane on which the shaft axis lies is defined as a 0-degree state. A direction parallel to the perpendicular plane and parallel to the horizontal plane is defined as a projection direction. A projected area of the head projected in the projection direction when the head is rotated by θ° about the shaft axis toward a back side from the 0-degree state is denoted by WAθ. WAθ is divided by the shaft axis into an area Afθ and an area Abθ. Airflow causes a force acting on the area Afθ in a face-closing direction and a force acting on the area Abθ in a face-opening direction. (Af90−Ab90) is −4500 ($mm^2$) or less. (Af15−Ab15) is 4700 ($mm^2$) or less.

12 Claims, 37 Drawing Sheets

(56) References Cited

U.S. PATENT DOCUMENTS 5,318,297 A * 6/1994 Davis ..... A63B 60/00 473/327
5,505,448 A * 4/1996 Park ..... A63B 60/006 473/327
5,997,413 A * 12/1999 Wood, IV ..... A63B 53/0466 473/328
D489,424 S * 5/2004 Lee ..... D21/733
7,713,138 B2 * 5/2010 Sato ..... A63B 53/0466 473/328
8,366,565 B2 * 2/2013 Tavares ..... A63B 60/00 473/328
8,702,531 B2 * 4/2014 Boyd ..... A63B 53/02 473/328
9,861,864 B2 * 1/2018 Beach ..... A63B 53/0466
10,130,855 B2 * 11/2018 Stokke ..... A63B 53/08
11,465,019 B2 * 10/2022 Albertsen ..... A63B 53/0466
2011/0136584 A1 * 6/2011 Boyd ..... A63B 60/52 473/345
2011/0165961 A1 * 7/2011 Cackett ..... A63B 60/00 473/282
2011/0192001 A1 * 8/2011 Evans ..... A63B 53/0466 29/407.01
2011/0192002 A1 * 8/2011 Evans ..... A63B 53/0466 29/407.1
2011/0195801 A1 * 8/2011 Evans ..... A63B 53/0466 473/345
2011/0247190 A1 * 10/2011 Evans ..... A63B 53/0466 29/407.01
2011/0250986 A1 * 10/2011 Schweigert ..... A63B 60/02 473/409
2011/0281663 A1 * 11/2011 Stites ..... A63B 53/0466 473/327
2011/0281664 A1 * 11/2011 Boyd ..... A63B 53/0466 473/282
2013/0324296 A1 * 12/2013 Ban ..... A63B 53/0466 473/345
2016/0339306 A1 * 11/2016 Simone ..... A63B 60/00
2019/0374824 A1 * 12/2019 Albertsen ..... A63B 53/0466
2020/0324173 A1 10/2020 Aramaki
2021/0162280 A1 * 6/2021 Morales ..... A63B 53/0466
2022/0226699 A1 * 7/2022 Mizutani ..... A63B 53/0466
2022/0249923 A1 * 8/2022 Kodaka ..... A63B 53/0408

OTHER PUBLICATIONS

A Review of Dynamic Models and Measurements i Golf, by John McPhee, https://uwaterloo.ca/motion-research-group/sites/ca.motion-research-group/files/uploads/files/review_golf.pdf, 2022.*

* cited by examiner

A-A

C–C

--PRIOR ART--

--PRIOR ART--

--PRIOR ART--

--PRIOR ART--

--PRIOR ART--

--PRIOR ART--

GOLF CLUB HEAD

CROSS REFERENCE TO RELATED APPLICATION

The present application claims priority to Japanese Patent Application No. 2021-144283 filed on Sep. 3, 2021. The entire contents of this Japanese Patent Application are hereby incorporated by reference.

BACKGROUND

Technical Field

The present disclosure relates to a golf club head.

Description of the Related Art

A golf club having excellent flight distance performance is in demand. The flight distance performance can be improved by the performance of the head, the shaft, or the golf club as a whole. For an improvement of the flight distance performance based on the head, the position of the center of gravity and the rebound performance may be taken into consideration as described in, for example, JP2020-171434 A (US2020/0324173A1).

SUMMARY

Inventors of the present disclosure have found that a golf club head having excellent flight distance performance can be achieved based on a technical idea different from a conventional one.

One of the objects of the present disclosure is to provide a golf club head that has excellent ball catchability and excellent flight distance performance.

In one aspect, the present disclosure provides a golf club head including a face portion that forms a striking face, a crown portion that forms a crown outer surface, a sole portion that forms a sole outer surface, and a hosel portion that is configured to receive a shaft and that defines a shaft axis line. The striking face has a face center, and a normal line at the face center. The golf club head has a head width in a face-back direction of greater than or equal to 100 mm. The golf club head has a head length in a toe-heel direction of greater than or equal to 110 mm. A state of the head placed in such a manner that the shaft axis line is vertical to a horizontal plane and the normal line is parallel to a first perpendicular plane on which the shaft axis line lies is defined as a 0-degree state. A direction that is parallel to the first perpendicular plane and is parallel to the horizontal plane is defined as a projection direction. A projected area of the head projected in the projection direction when the head is rotated by θ° about the shaft axis line toward a back side from the 0-degree state is denoted by WAθ ($mm^2$). θ ranges from 0 to 90. The projected area is divided into two regions by the shaft axis line. Of the two regions, a region to which a force acting in such a direction that the striking face is opened is applied due to air resistance during downswing is defined as a first region, and a region to which a force acting in such a direction that the striking face is closed is applied due to the air resistance is defined as a second region. An area of the first region is denoted by Afθ ($mm^2$), and an area of the second region is denoted by Abθ ($mm^2$). (Afθ−Abθ) is denoted by Sθ ($mm^2$). S90 is less than or equal to −4500 ($mm^2$). S15 is less than or equal to 4700 ($mm^2$).

DESCRIPTION OF THE PREFERRED EMBODIMENTS

Hereinafter, the present disclosure will be described in detail according to the preferred embodiments with appropriate references to the accompanying drawings.

In the present disclosure, a reference state, a reference perpendicular plane, a toe-heel direction, a face-back direction, an up-down direction, a face center, and a normal line at the face center are defined as follows.

Figure 37:
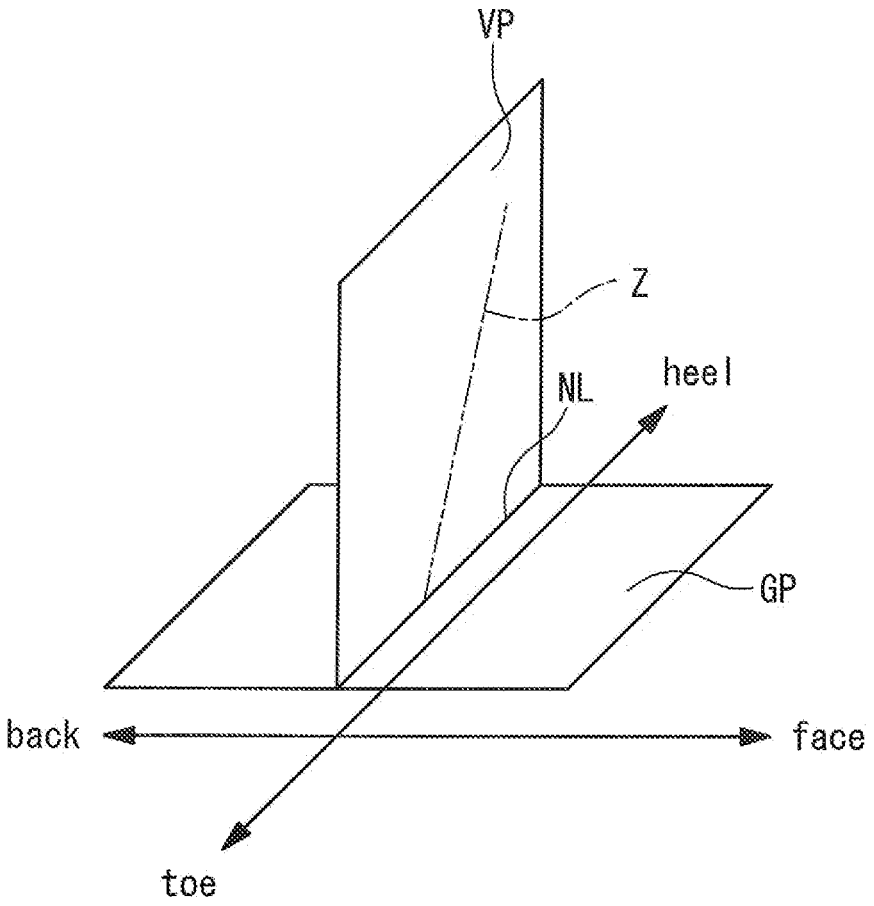
FIG. 37 is a conceptual diagram for illustrating the reference state.

The reference state is a state where a head is placed at a predetermined lie angle on a ground plane GP. As shown in FIG. 37, in this reference state, a shaft axis line Z lies on a plane VP that is perpendicular to the ground plane GP. The shaft axis line Z is the center line of a shaft when the shaft is attached to the head. Typically, the shaft axis line Z is the center line of a hosel hole (shaft hole). The plane VP is defined as the reference perpendicular plane. The predetermined lie angle is shown in a product catalog, for example.

In this reference state, a face orientation is determined so that the normal line of a striking face at the face center is contained in (lies on) a plane that is perpendicular to the reference perpendicular plane VP and is perpendicular to the ground plane GP. That is, in a planar view of the head as viewed from above, the normal line of the striking face at the face center is set to be perpendicular to the reference perpendicular plane VP.

In the present disclosure, the toe-heel direction is the direction of an intersection line NL between the reference perpendicular plane VP and the ground plane GP (see FIG. 37).

In the present disclosure, the face-back direction is a direction that is perpendicular to the toe-heel direction and is parallel to the ground plane GP.

In the present disclosure, the up-down direction is a direction that is perpendicular to the toe-heel direction and is perpendicular to the face-back direction. In other words, the up-down direction in the present disclosure is a direction perpendicular to the ground plane GP.

In the present disclosure, the face center Fc is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step becomes less than or equal to 0.5 mm for the first time, the newly-determined midpoint Py (the midpoint Py determined last) is defined as the face center Fc.

Figure 1:
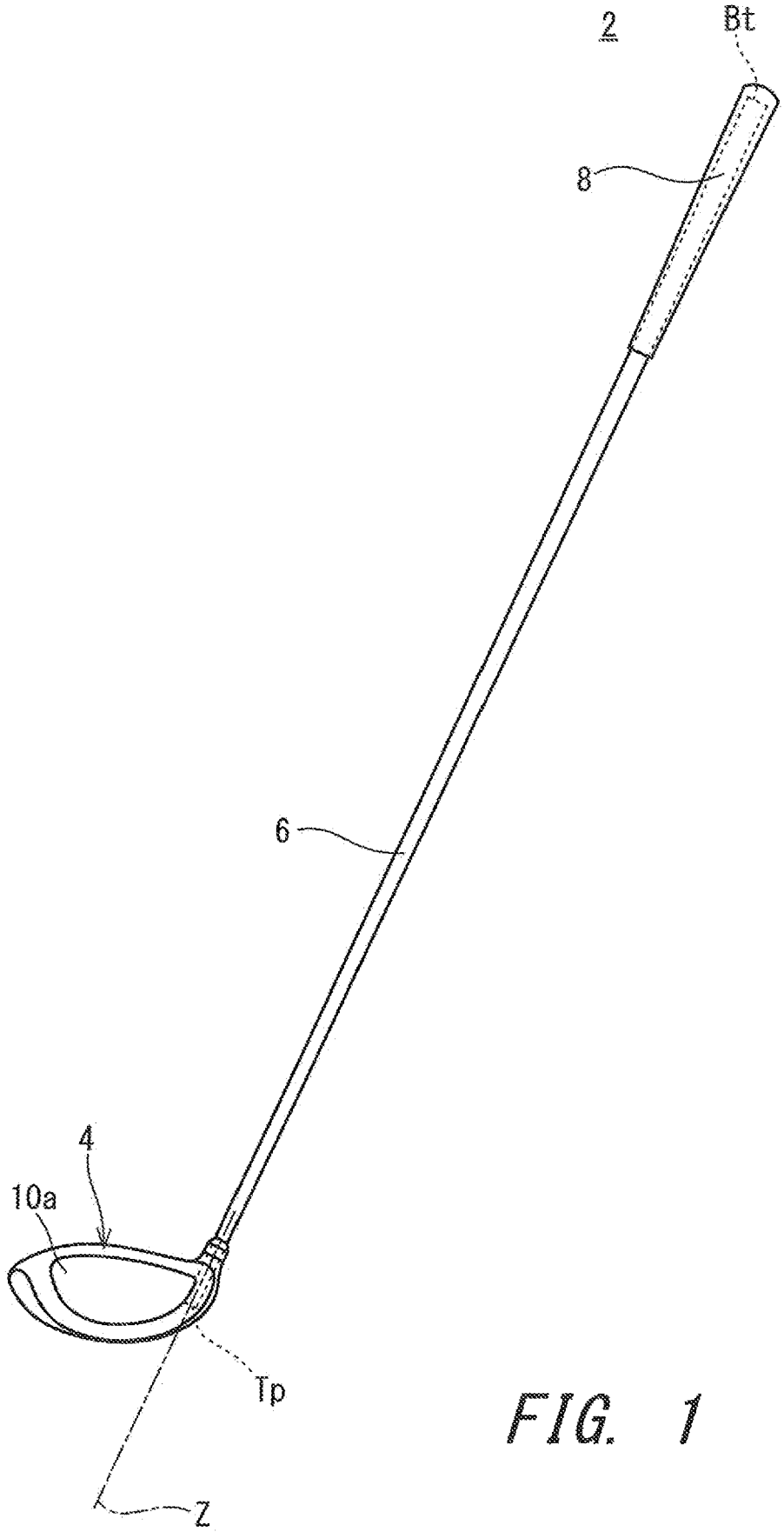
FIG. 1 shows a golf club according to a first embodiment.
Figure 2:
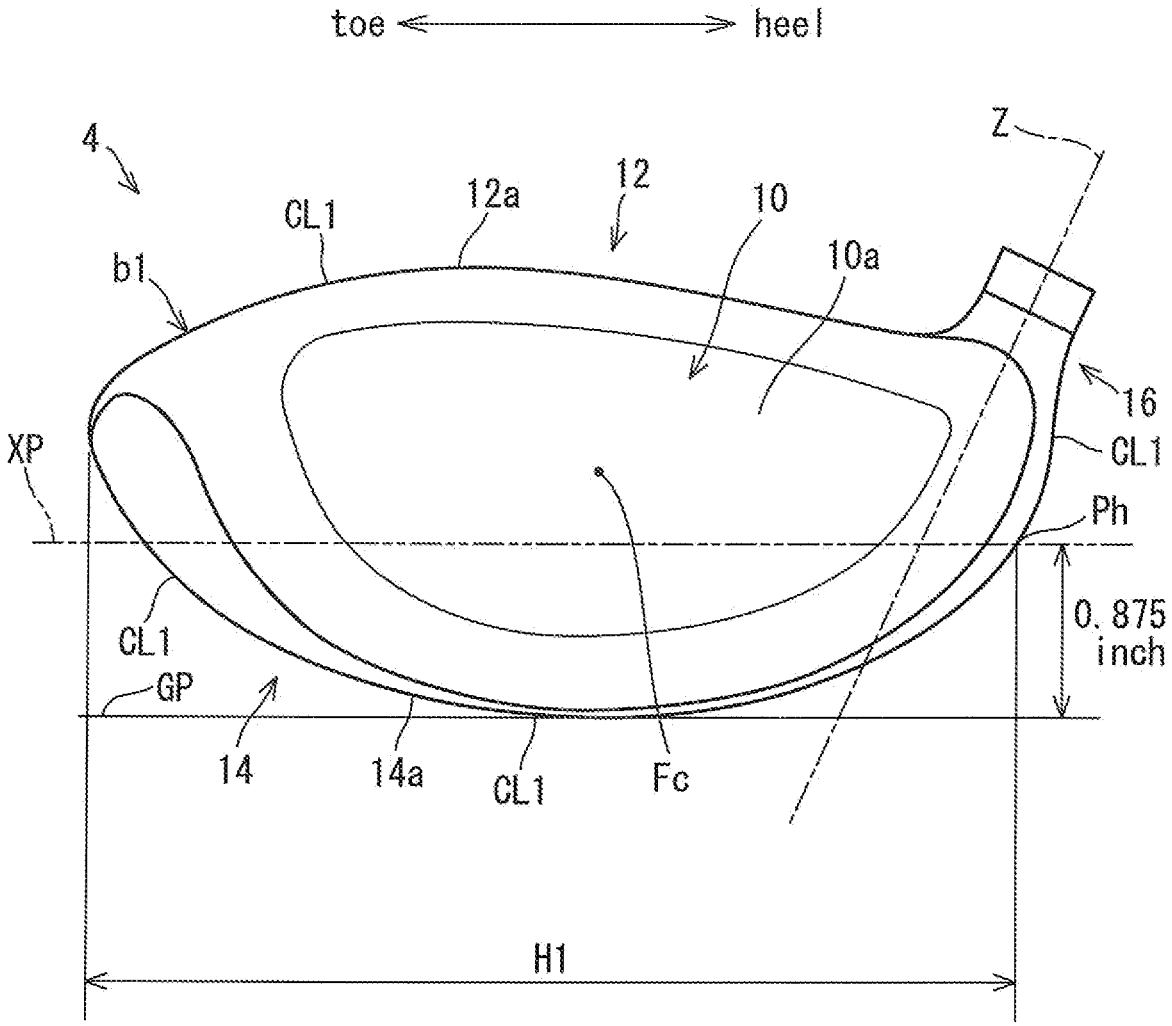
FIG. 2 is a front view of a head of the first embodiment as viewed from a face side, showing the head in a reference state.
Figure 3:
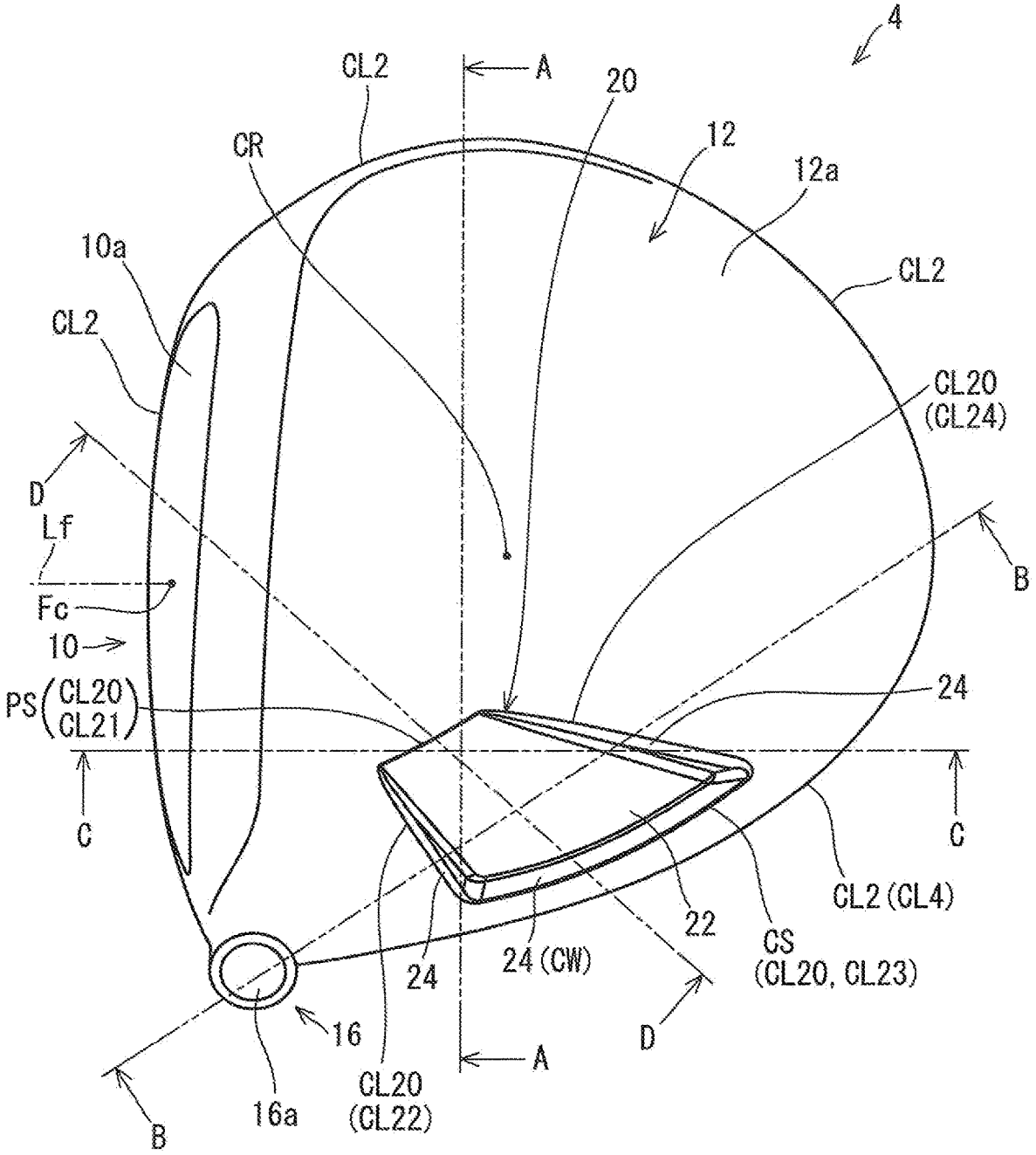
FIG. 3 is a plan view of the head of the first embodiment as viewed from a crown side.
Figure 4:
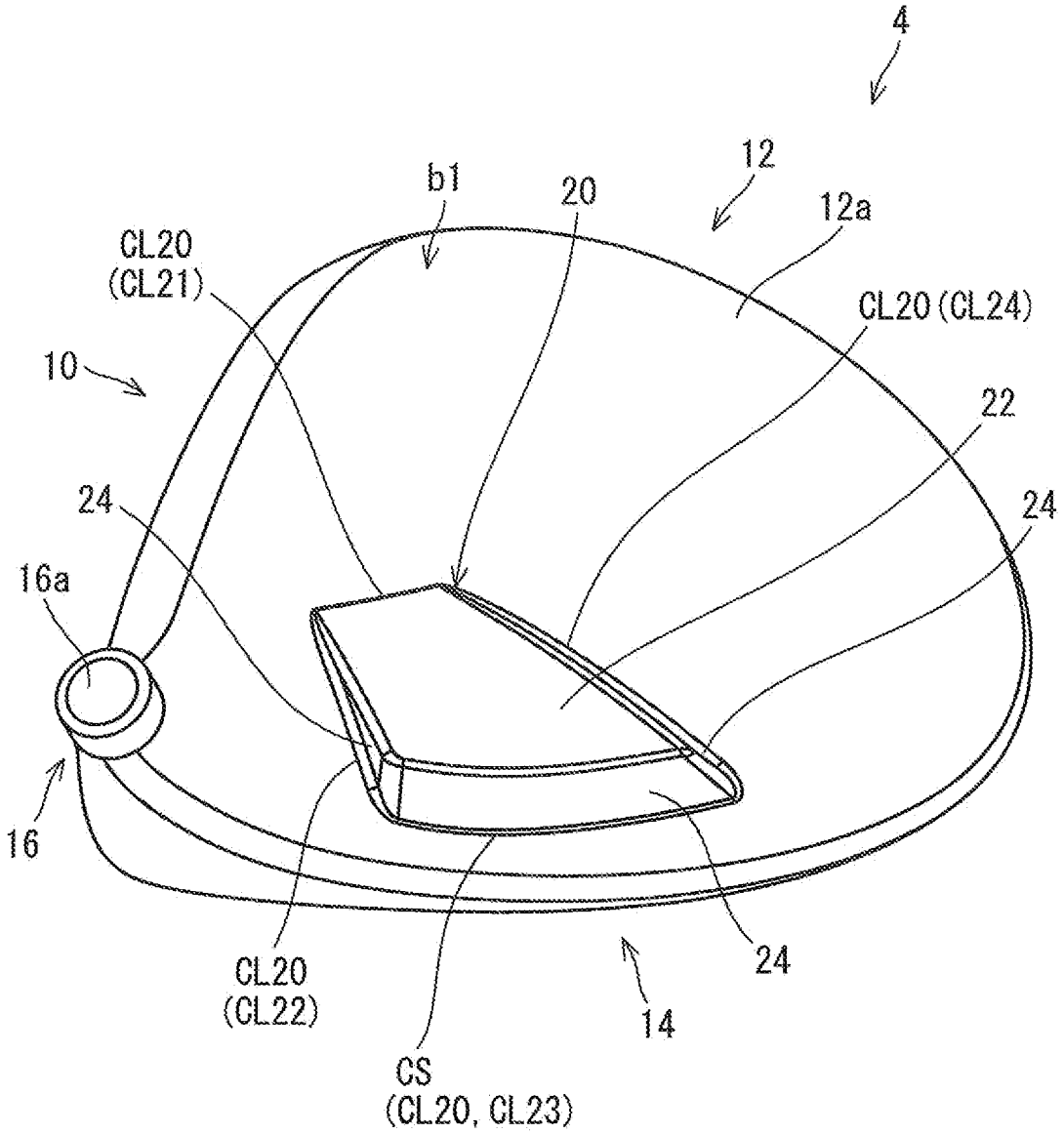
FIG. 4 is a perspective view of the head of the first embodiment as viewed from a heel back side.

FIG. 1 is an overall view of a golf club 2 that includes a head 4 according to a first embodiment of the present disclosure. FIG. 2 is a front view of the head 4. FIG. 2 shows the head 4 which is in the reference state as viewed from the face side. FIG. 3 is a plan view of the head 4 as viewed from a crown side. FIG. 4 is a perspective view of the head 4 as viewed from the heel back side.

As shown in FIG. 1, the golf club 2 includes the golf club head 4, a shaft 6, and a grip 8. The shaft 6 has a tip end Tp and a butt end Bt. The head 4 is attached to a tip end portion of the shaft 6. The grip 8 is attached to a butt end portion of the shaft 6.

The golf club 2 is a driver (No. 1 wood). Typically, the club as a driver has a length of greater than or equal to 43 inches. Preferably, the golf club 2 is a wood-type golf club.

The shaft 6 is in a tubular form. The shaft 6 is hollow. The material of the shaft 6 is a fiber reinforced resin. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. "UD" is an abbreviation of "unidirectional". A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

Although not shown in the drawings, the head 4 is hollow. In the present embodiment, the head 4 is a wood type head. The head 4 is a driver head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a metal portion and a non-metal portion. Examples of the material for the non-metal portion include fiber reinforced plastics. From the viewpoint of strength, the fiber reinforced plastic is preferably a carbon fiber reinforced plastic.

As shown in FIG. 2 to FIG. 4, the head 4 includes a face portion 10, a crown portion 12, a sole portion 14, and a hosel portion 16. The face portion 10 includes a striking face 10*a*. The striking face 10*a* is the outer surface of the face portion 10. The striking face 10*a* is also simply referred to as a face. The crown portion 12 forms a crown outer surface 12*a*. The sole portion 14 forms a sole outer surface 14*a*. The hosel portion 16 has a shaft hole 16*a*.

The striking face 10*a* has a face center Fc as defined above. The striking face 10*a* has a normal line Lf. The normal line Lf is a line normal to the striking face 10*a* at the face center Fc.

The head 4 includes, on its outer surface, a protruding portion 20. In the present embodiment, the protruding portion 20 is formed on the crown portion 12. The crown portion 12 includes the protruding portion 20 on the crown outer surface 12*a*. Although not shown in the drawings, the protruding portion 20 is hollow. The protruding portion 20 forms a projection on the crown outer surface 12*a* and forms a recess on a crown inner surface. Alternatively, the protruding portion 20 may be solid (not hollow).

The entirety of the protruding portion 20 is positioned on the heel side with respect to the face center Fc. In the planar view, the entirety of the protruding portion 20 is positioned on the heel side with respect to a geometric center CR.

In the front view of the head as viewed from the face side (see FIG. 2), the protruding portion 20 is not viewable. In the front view of the head as viewed from the face side (see FIG. 2), the protruding portion 20 does not form any part of an outer contour line CL1 of the head 4. The outer contour line is namely a contour line (outline) of a silhouette.

In the present embodiment, the entirety of the protruding portion 20 is formed on the crown outer surface 12*a*. As shown in FIG. 3, the head 4 has an outer contour line CL2 in the plan view of the head 4. As shown in FIG. 3, the protruding portion 20 does not reach the outer contour line CL2. The protruding portion 20 does not extend to other portions than the crown outer surface 12*a*. In the plan view (FIG. 3) of the head 4, the entirety of the protruding portion 20 can be seen.

The plan view of the head 4 is a projection figure obtained by projecting the head in the reference state onto a plane parallel to the ground plane GP. This plan view (FIG. 3) is also referred to as a planar view.

In the plan view of the head 4, the protruding portion 20 may reach the outer contour line CL2. In other words, the protruding portion 20 may form a part of the outer contour line CL2. The protruding portion 20 may extend into other portions than the crown outer surface 12*a*. For example, the protruding portion 20 may extend from the crown outer surface 12*a* onto the sole outer surface 14*a*. For example, the protruding portion 20 may extend from the crown outer surface 12*a* onto the outer surface of a side portion (skirt portion). As described below, the position of the protruding portion 20 is not limited in the present disclosure.

Of the crown outer surface 12*a*, a portion in which the protruding portion 20 is not present is formed by a base surface b1. The base surface b1 is a convex curved surface that is smooth and continuous. The convex curved surface is a curved surface that is convex toward the outside of the head 4. As shown in FIG. 3, the base surface b1 belonging to the crown outer surface 12*a* includes the geometric center CR of the head 4 in the plan view. The geometric center CR is the geometric center of a figure indicated by the outer contour line CL2.

Figure 5:
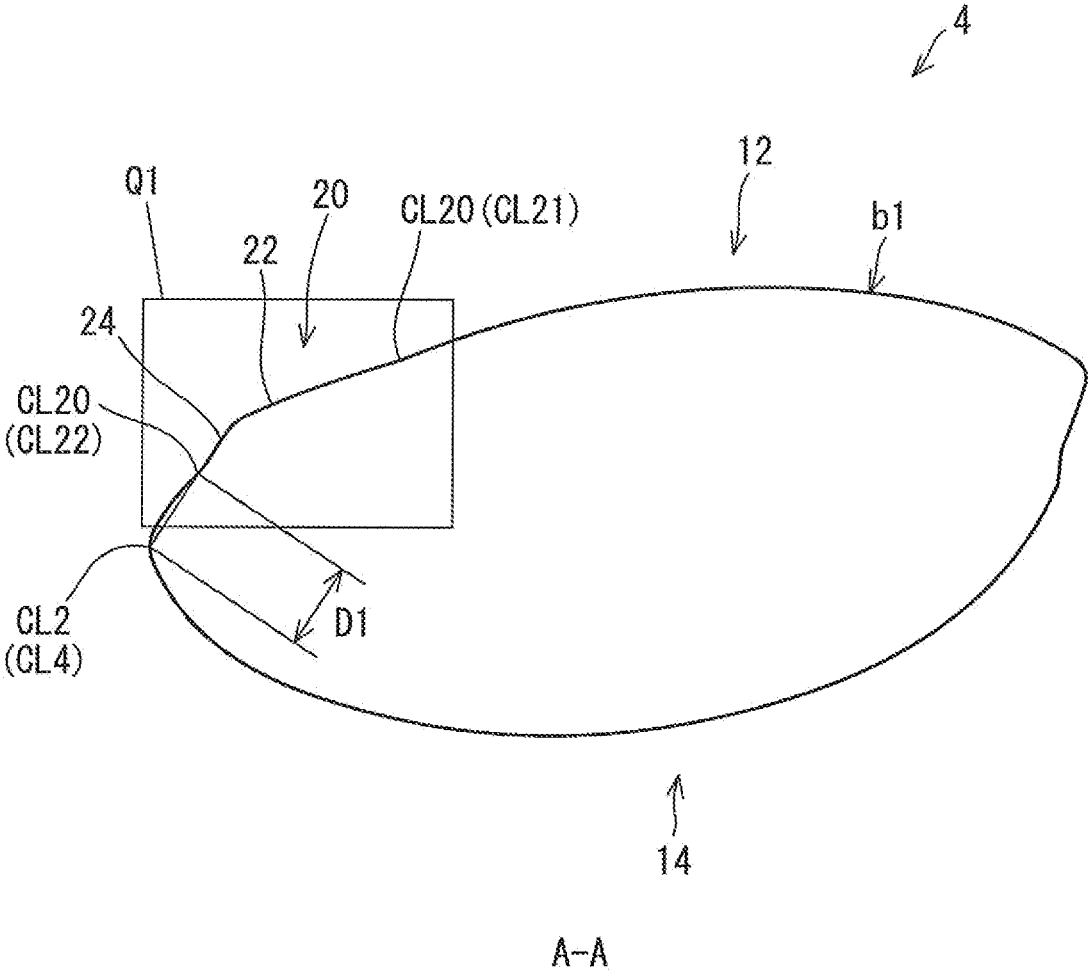
FIG. 5 shows a cross-sectional contour line of the outer surface of the head in a cross-sectional view taken along line A-A in FIG. 3.
Figure 6:
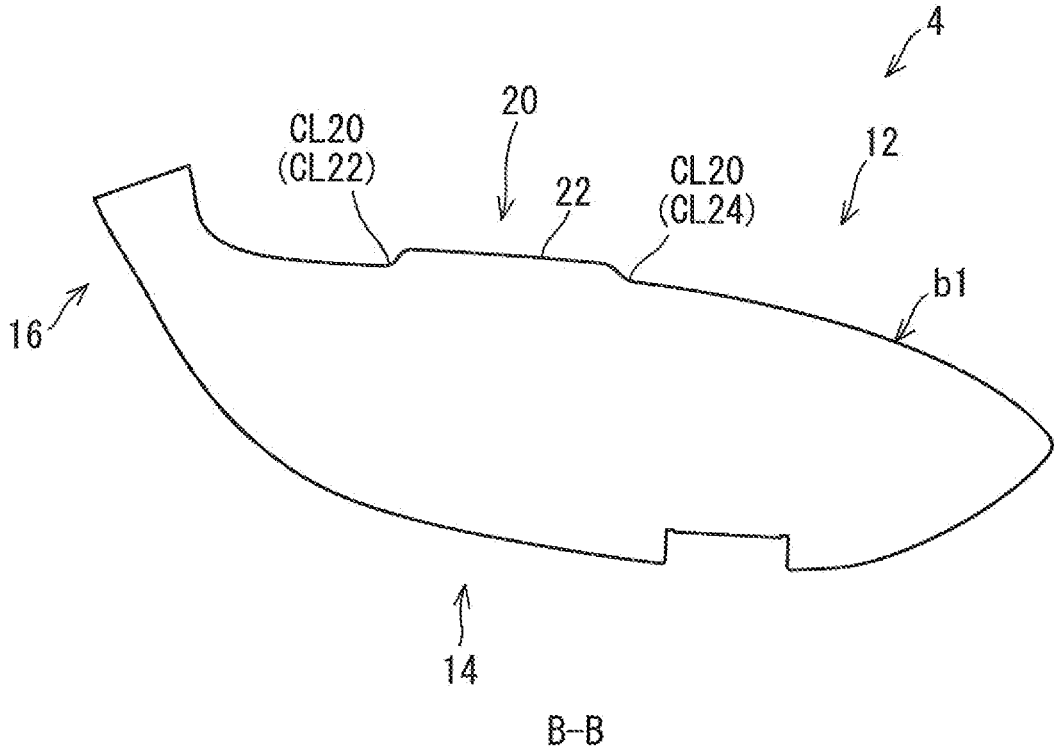
FIG. 6 shows a cross-sectional contour line of the outer surface of the head in a cross-sectional view taken along line B-B in FIG. 3.
Figure 7:
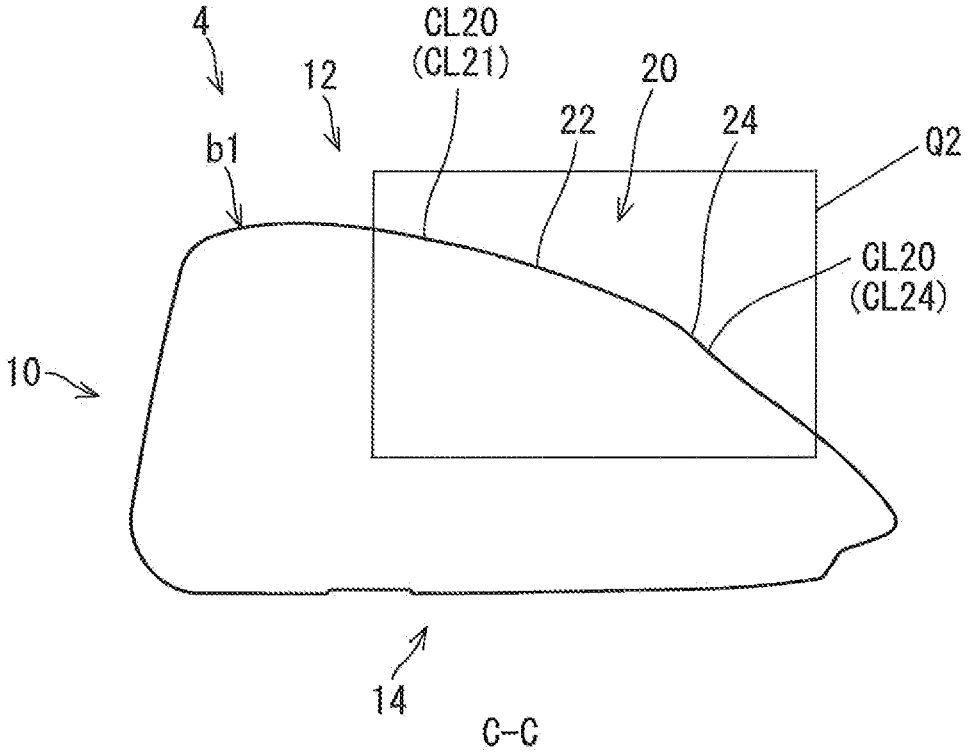
FIG. 7 shows a cross-sectional contour line of the outer surface of the head in a cross-sectional view taken along line C-C in FIG. 3.
Figure 8:
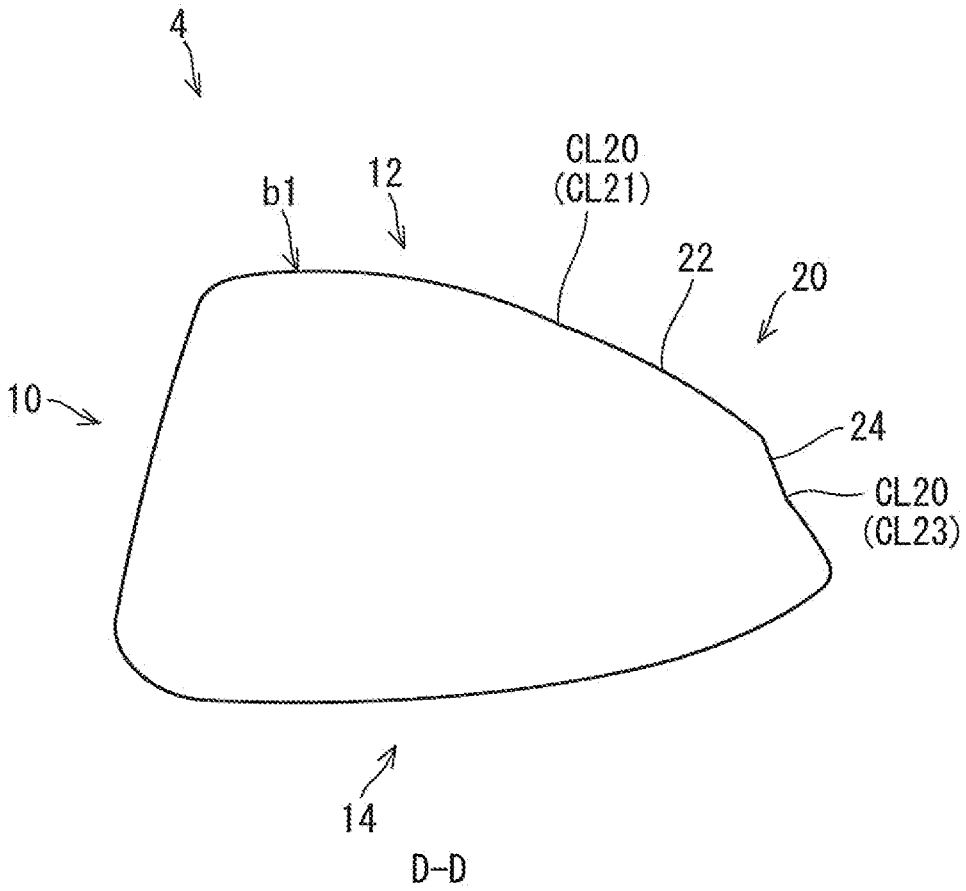
FIG. 8 shows a cross-sectional contour line of the outer surface of the head in a cross-sectional view taken along line D-D in FIG. 3.

FIG. 5 shows a cross-sectional contour line of the outer surface of the head 4 in a cross-sectional view taken along line A-A in FIG. 3. FIG. 6 shows a cross-sectional contour line of the outer surface of the head 4 in a cross-sectional view taken along line B-B in FIG. 3. FIG. 7 shows a cross-sectional contour line of the outer surface of the head 4 in a cross-sectional view taken along line C-C in FIG. 3. FIG. 8 shows a cross-sectional contour line of the outer surface of the head 4 in a cross-sectional view taken along line D-D in FIG. 3. Each of FIG. 5 to FIG. 8 includes a cross-sectional contour line of the crown outer surface 12*a*. In the present disclosure, a cross-sectional contour line of the outer surface of the head 4 is also simply referred to as a cross-sectional contour line.

The protruding portion 20 includes a contour line CL20, an upper surface 22, and a sidewall surface 24. The contour line CL20 is a boundary line between the base surface b1 and the protruding portion 20. In the plan view of the head 4 (FIG. 3), the contour line CL20 of the protruding portion 20 has a substantially quadrilateral shape (substantially trapezoidal shape). In the present disclosure, the word "substantially" means that a shape in question may have a curved side(s) (not straight side(s)) and/or a rounded corner(s). In the contour line CL20 in the plan view of the head (FIG. 3), the radius of curvature of the curved side(s) is preferably greater than or equal to 25 mm, more preferably greater than or equal to 40 mm, and still more preferably greater than or equal to 50 mm. In the contour line CL20 in the plan view of the head (FIG. 3), the radius of curvature of the rounded corner(s) is preferably less than or equal to 10 mm, more preferably less than or equal to 7 mm, and still more preferably less than or equal to 5 mm. The contour line CL20 forms the substantially quadrilateral shape.

The boundary between the upper surface 22 and the sidewall surface 24 can be defined by a ridgeline. The ridgeline can be specified as a point having a radius of curvature of less than or equal to 5 mm or as a vertex of an angle in a cross-sectional contour line of the outer surface of the protruding portion 20. Although the radius of curvature of the cross-sectional contour line can vary depending on the direction of the cross section, a cross section that has the smallest radius of curvature is selected for determining the radius of curvature to specify the ridgeline.

In the plan view (planar view) of the head 4, the protruding portion 20 can have a substantially polygonal shape. When this substantially polygonal shape is defined as a substantially N-sided polygonal shape, N can be an integer of greater than or equal to 3. N may be an integer that is greater than or equal to 3 and less than or equal to 20.

The contour line CL20 has a first side CL21, a second side CL22, a third side CL23, and a fourth side CL24. The first side CL21 constitutes a side on the toe-face side of the protruding portion 20. The first side CL21 extends in such a manner that it goes toward the back side as it goes to the toe side. The first side CL21 connects the second side CL22 and the fourth side CL24.

The second side CL22 constitutes a side on the heel-face side of the protruding portion 20. The second side CL22 extends in such a manner that it goes toward the back side as it goes to the heel side. The second side CL22 connects the first side CL21 and the third side CL23.

The third side CL23 constitutes a side on the heel-back side of the protruding portion 20. The third side CL23 extends in such a manner that it goes toward the back side as it goes to the toe side. The third side CL23 connects the second side CL22 and the fourth side CL24. The third side CL23 constitutes a curved line that projects toward the outside of the head 4.

The fourth side CL24 constitutes a side on the toe-back side of the protruding portion 20. The fourth side CL24 extends in such a manner that it goes toward the back side as it goes to the heel side. The fourth side CL24 connects the third side CL23 and the first side CL21.

The second side CL22, the third side CL23, and the fourth side CL24 constitute a starting line of the sidewall surface 24. That is, the second side CL22, the third side CL23, and the fourth side CL24 constitute the boundary line between the sidewall surface 24 and the base surface b1. On the other hand, the first side CL21 does not constitute a starting line of the sidewall surface 24. The first side CL21 constitutes the boundary line between the base surface b1 and the upper surface 22.

In the present disclosure, a cross-sectional contour line in a cross section taken along the toe-heel direction is also simply referred to as a t-h cross-sectional contour line. FIG. 5 shows one example of the t-h cross-sectional contour line. A t-h cross-sectional contour line of the outer surface of the head 4 is also simply referred to as a t-h cross-sectional contour line. In the present disclosure, a cross-sectional contour line in a cross section taken along the face-back direction is also simply referred to as an f-b cross-sectional contour line. FIG. 7 shows one example of the f-b cross-sectional contour line. An f-b cross-sectional contour line of the outer surface of the head 4 is also simply referred to as an f-b cross-sectional contour line.

An inflection point in the t-h cross-sectional contour line can be a point that forms the contour line CL20. In other words, this inflection point can be a starting point of the protruding portion 20. The t-h cross-sectional contour line of the base surface b1 is a curved line that projects toward the outside of the head 4. The inflection point is a point at which the curved line that projects toward the outside of the head 4 changes into a curved line that projects toward the inside of the head 4.

A vertex of an angle in the t-h cross-sectional contour line can be a point that forms the contour line CL20. In other words, this vertex can be a starting point of the protruding portion 20. The t-h cross-sectional contour line of the base surface b1 is a curved line that projects toward the outside of the head 4. A line that is connected to this curved line, makes an angle, and extends toward the outside of the head 4 forms a vertex. This vertex points toward the inside of the head 4. This vertex can be a starting point of the protruding portion 20.

An inflection point in the f-b cross-sectional contour line can be a point that forms the contour line CL20. In other words, this inflection point can be a starting point of the protruding portion 20. The f-b cross-sectional contour line of the base surface b1 is a curved line that projects toward the outside of the head 4. The inflection point is a point at which the curved line that projects toward the outside of the head 4 changes into a curved line that projects toward the inside of the head 4.

A vertex of an angle in the f-b cross-sectional contour line can be a point that forms the contour line CL20. In other words, this vertex can be a starting point of the protruding portion 20. The f-b cross-sectional contour line of the base surface b1 is a curved line that projects toward the outside of the head 4. A line that is connected to this curved line, makes an angle, and extends toward the outside of the head 4 forms a vertex. This vertex points toward the inside of the head 4. This vertex can be a starting point of the protruding portion 20.

Typically, the contour line CL20 can be determined by the inflection points or the vertices. For determining the contour line CL20, the t-h cross-sectional contour line may be selected in preference to the f-b cross-sectional contour line. In this case, the t-h cross-sectional contour line is used for specifying the inflection point or the vertex. When it is difficult to specify the inflection point or the vertex by using the t-h cross-sectional contour line, the f-b cross-sectional contour line can be used. When the contour line of the protruding portion 20 can be visually and clearly recognized, the contour line can be determined as the contour line CL20.

The protruding portion 20 is a portion that protrudes relative to the base surface b1. A virtually extended surface b2 that is obtained by extending the base surface b1 can be specified on the lower side of the protruding portion 20. The protruding portion 20 is a portion that protrudes relative to the virtually extended surface b2. The virtually extended surface b2 can be considered, if no protruding portion 20 is present, as a part of the base surface b1 formed in a region where any protruding portion 20 would be installed. The virtually extended surface b2 is formed so as to be continuous with the base surface b1. The virtually extended surface b2 is a curved surface that is convex toward the outside of the head 4. The virtually extended surface b2 is smoothly connected to the base surface b1.

Figure 9:
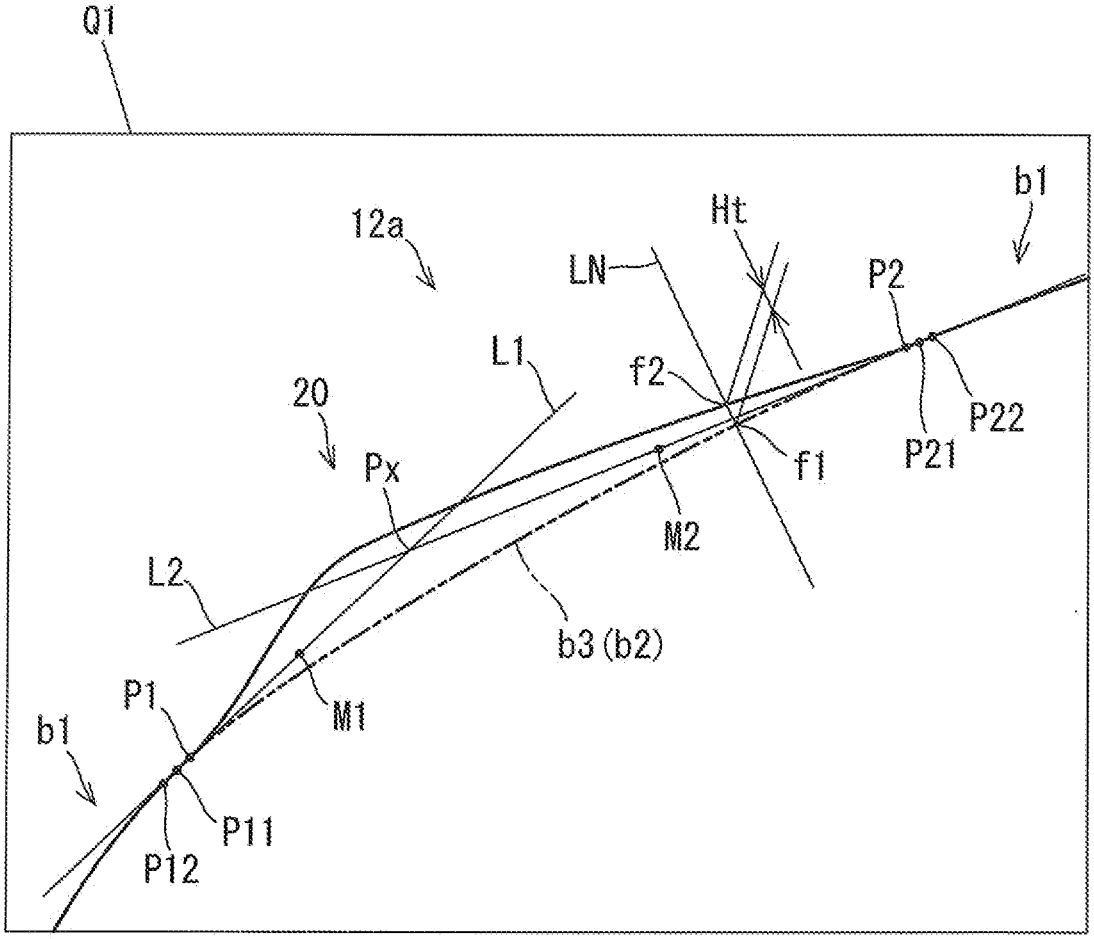
FIG. 9 is an enlarged view of a portion surrounded by a tetragon Q1 in FIG. 5, and a virtually extended line of a base surface is additionally drawn in FIG. 9.
Figure 10:
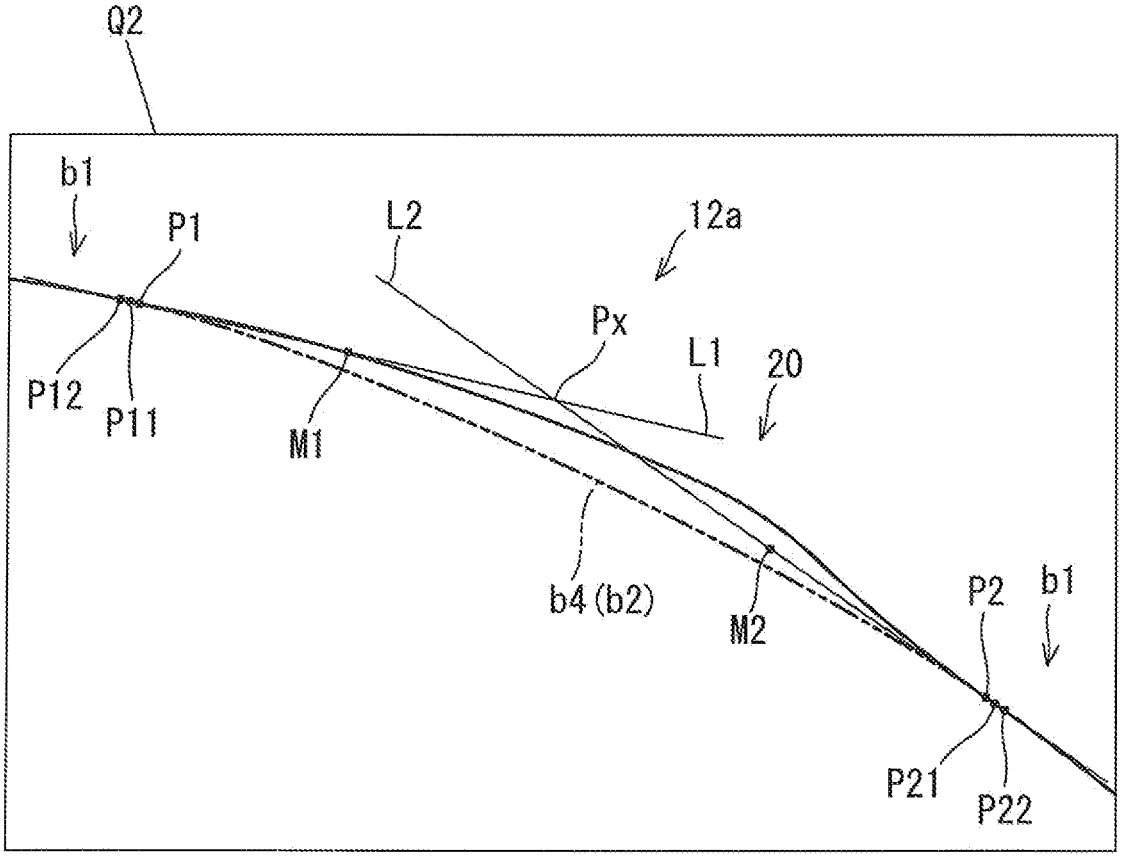
FIG. 10 is an enlarged view of a portion surrounded by a tetragon Q2 in FIG. 7, and a virtually extended line of the base surface is additionally drawn in FIG. 10.

FIG. 9 is an enlarged view of a portion that is surrounded by a tetragon Q1 in FIG. 5. FIG. 10 is an enlarged view of a portion that is surrounded by a tetragon Q2 in FIG. 7.

FIG. 9 shows the t-h cross-sectional contour line with a virtually extended line b3 that can form the virtually extended surface b2. The virtually extended line b3 is a curved line that projects toward the outside of the head 4. The virtually extended line b3 is smoothly connected to the t-h cross-sectional contour line of the base surface b1. The virtually extended surface b2 can be formed by a set of virtually extended lines b3.

The virtually extended line b3 smoothly connects one side end of the t-h cross-sectional contour line of the protruding portion 20 and the other side end of the t-h cross-sectional contour line of the protruding portion 20. The virtually extended line b3 can be drawn as a Bezier curve. A quadratic Bezier curve and a cubic Bezier curve are known as the Bezier curve. In the quadratic Bezier curve, the number of control points is one (excluding a starting point and an end point). In the cubic Bezier curve, the number of control points is two (excluding a starting point and an end point). The cubic Bezier curve is preferably used. Bezier curves drawn in FIG. 9 and FIG. 10 are cubic Bezier curves.

As shown in FIG. 9, the t-h cross-sectional contour line has a first starting point P1 and a second starting point P2. The first starting point P1 and the second starting point P2 are located on the contour line CL20.

Points P11 and P12 that are located on the opposite side of the first starting point P1 from the protruding portion 20 are plotted in order to define an effective tangent line to the t-h cross-sectional contour line at the first starting point P1. The point P11 is a point located 0.5 mm apart from the first starting point P1. The point P12 is a point located 0.5 mm apart from the point P11. These distances of "0.5 mm" for these points are route lengths measured along the t-h cross-sectional contour line. The points P11 and P12 are located on the t-h cross-sectional contour line. A tangent line L1 at the point P1 to a circle that passes through these three points P1, P11 and P12 is determined. When the points P1, P11 and P12 are positioned on a single straight line, this straight line can be determined as the tangent line L1.

Similarly, points P21 and P22 that are located on the opposite side of the second starting point P2 from the protruding portion 20 are plotted in order to define an effective tangent line to the t-h cross-sectional contour line at the second starting point P2. The point P21 is a point located 0.5 mm apart from the second starting point P2. The point P22 is a point located 0.5 mm apart from the point P21. These distances of "0.5 mm" for these points are route lengths measured along the t-h cross-sectional contour line. The points P21 and P22 are located on the t-h cross-sectional contour line. A tangent line L2 at the point P2 to a circle that passes through these three points P2, P21 and P22 is determined. When the points P2, P21 and P22 are positioned on a single straight line, this straight line can be determined as the tangent line L2.

When the tangent line L1 and the tangent line L2 are determined, then an intersection point Px between the tangent line L1 and the tangent line L2 is specified. Furthermore, a middle point M1 between the point P1 and the point Px is specified, and a middle point M2 between the point P2 and the point Px is specified.

A Bezier curve can be drawn by using the point P1 as the starting point, the middle point M1 as the first control point, the middle point M2 as the second control point, and the point P2 as the end point. In FIG. 9, a Bezier curve drawn in this manner is the virtually extended line b3. Because of having two control points, this Bezier curve is a cubic Bezier curve.

The virtually extended line b3 can be defined at any position in the face-back direction. The virtually extended surface b2 can be defined as the set of these virtually extended lines b3.

A similar Bezier curve can be defined in the f-b cross-sectional contour line. As shown in FIG. 10, the f-b cross-sectional contour line has a first starting point P1 and a second starting point P2. The first starting point P1 and the second starting point P2 are located on the contour line CL20.

Points P11 and P12 that are located on the opposite side of the first starting point P1 from the protruding portion 20 are plotted in order to define an effective tangent line to the f-b cross-sectional contour line at the first starting point P1. The point P11 is a point located 0.5 mm apart from the first starting point P1. The point P12 is a point located 0.5 mm apart from the point P11. These distances of "0.5 mm" for these points are route lengths measured along the f-b cross-sectional contour line. The points P11 and P12 are located on the f-b cross-sectional contour line. A tangent line L1 at the point P1 to a circle that passes through these three points P1, P11 and P12 is determined. When the points P1, P11 and P12 are positioned on a single straight line, this straight line can be determined as the tangent line L1.

Similarly, points P21 and P22 that are located on the opposite side of the second starting point P2 from the protruding portion 20 are plotted in order to define an effective tangent line to the f-b cross-sectional contour line at the second starting point P2. The point P21 is a point located 0.5 mm apart from the second starting point P2. The point P22 is a point located 0.5 mm apart from the point P21. These distances of "0.5 mm" for these points are route lengths measured along the f-b cross-sectional contour line. The points P21 and P22 are located on the f-b cross-sectional contour line. A tangent line L2 at the point P2 to a circle that passes through these three points P2, P21 and P22 is determined. When the points P2, P21 and P22 are positioned on a single straight line, this straight line can be determined as the tangent line L2.

When the tangent line L1 and the tangent line L2 are determined, then an intersection point Px between the tangent line L1 and the tangent line L2 is specified. Furthermore, a middle point M1 between the point P1 and the point Px is specified, and a middle point M2 between the point P2 and the point Px is specified.

A Bezier curve can be drawn by using the point P1 as the starting point, the middle point M1 as the first control point, the middle point M2 as the second control point, and the point P2 as the end point. In FIG. 10, a Bezier curve drawn in this manner is a virtually extended line b4.

The virtually extended line b4 can be defined at any position in the toe-heel direction. The virtually extended surface b2 can be defined as the set of these virtually extended lines b4.

In some cases, the protruding portion may reach an outer peripheral edge (outer contour line CL4) of the crown portion. In such a case, the number of the starting point(s) of the protruding portion which is/are formed on the boundary between the protruding portion and the base surface b1 can be only one in the t-h cross-sectional contour line and/or the f-b cross-sectional contour line. When only one starting point is present as in this case, a circular arc that is drawn so as to path through the starting point and have a radius of curvature at the starting point can be the virtually extended line b3. That is, in this case, the virtually extended line b3 can be a circle that passes through the following three points: a first point that is the starting point; a second point located 0.5 mm apart from the first point; and a third point located 0.5 mm apart from the second point.

For determining the virtually extended surface b2, the t-h cross-sectional contour line may be used in preference to the f-b cross-sectional contour line. The virtually extended surface b2 can be determined as a set of the virtually extended lines b3 obtained from the t-h cross-sectional contour lines. When the virtually extended surface b2 is not clearly determined by the set of the virtually extended lines b3, the virtually extended surface b2 may be determined as a set of the virtually extended lines b4 obtained from the f-b cross-sectional contour lines.

A height Ht of the protruding portion 20 can be defined as a height from the virtually extended surface b2. As shown in FIG. 9, a normal line LN that is normal to the virtually extended surface b2 at a certain point f1 has an intersection point f2 at which the normal line LN intersects the outer surface of the protruding portion 20. A distance between the point f1 and the intersection point f2 can be defined as the height Ht of the protruding portion 20 at the intersection point f2. If the protruding portion does not intersect the normal line LN of the virtually extended surface b2 and has a point at which the protruding portion intersects a normal line that is normal to the base surface b1, the height Ht of the protruding portion at the point is defined as a height from the base surface b1. Also in this case, the length of the normal line is the height Ht.

[0-degree state, θ-degree state, projection direction]

In the present disclosure, a 0-degree state, and a θ-degree state that encompasses this 0-degree state are defined. In addition, a projection direction is defined.

Figure 11A:
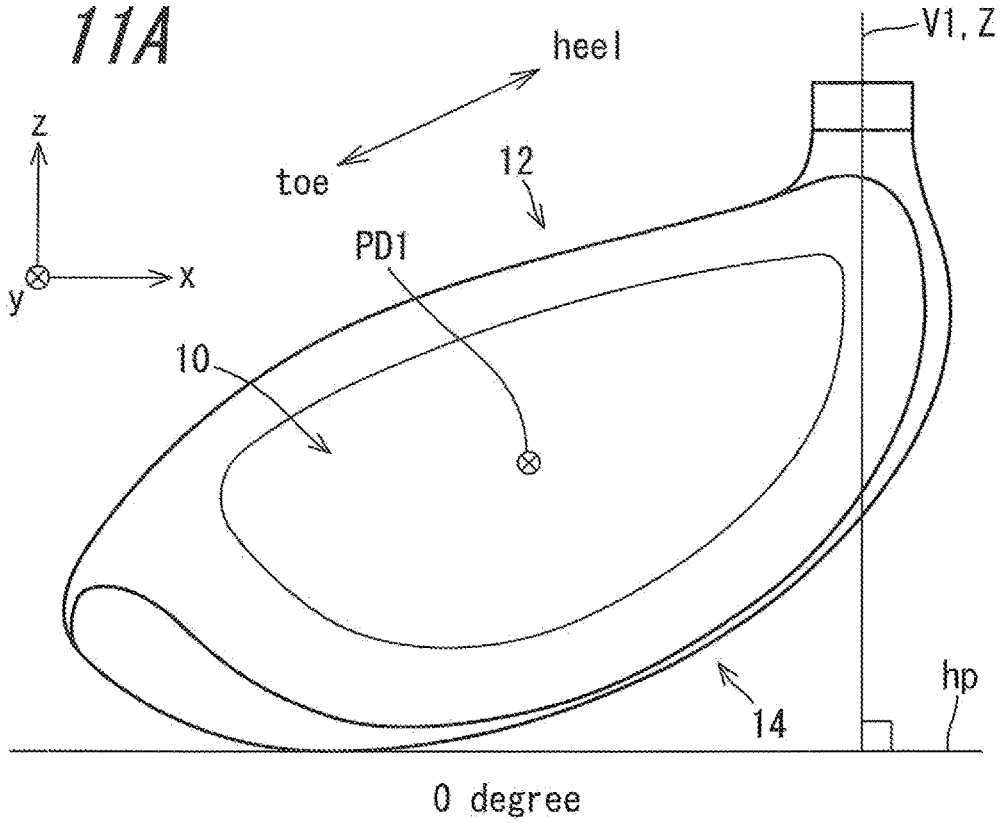
FIG. 11A shows the head in a 0-degree state as viewed from a face side.
Figure 11B:
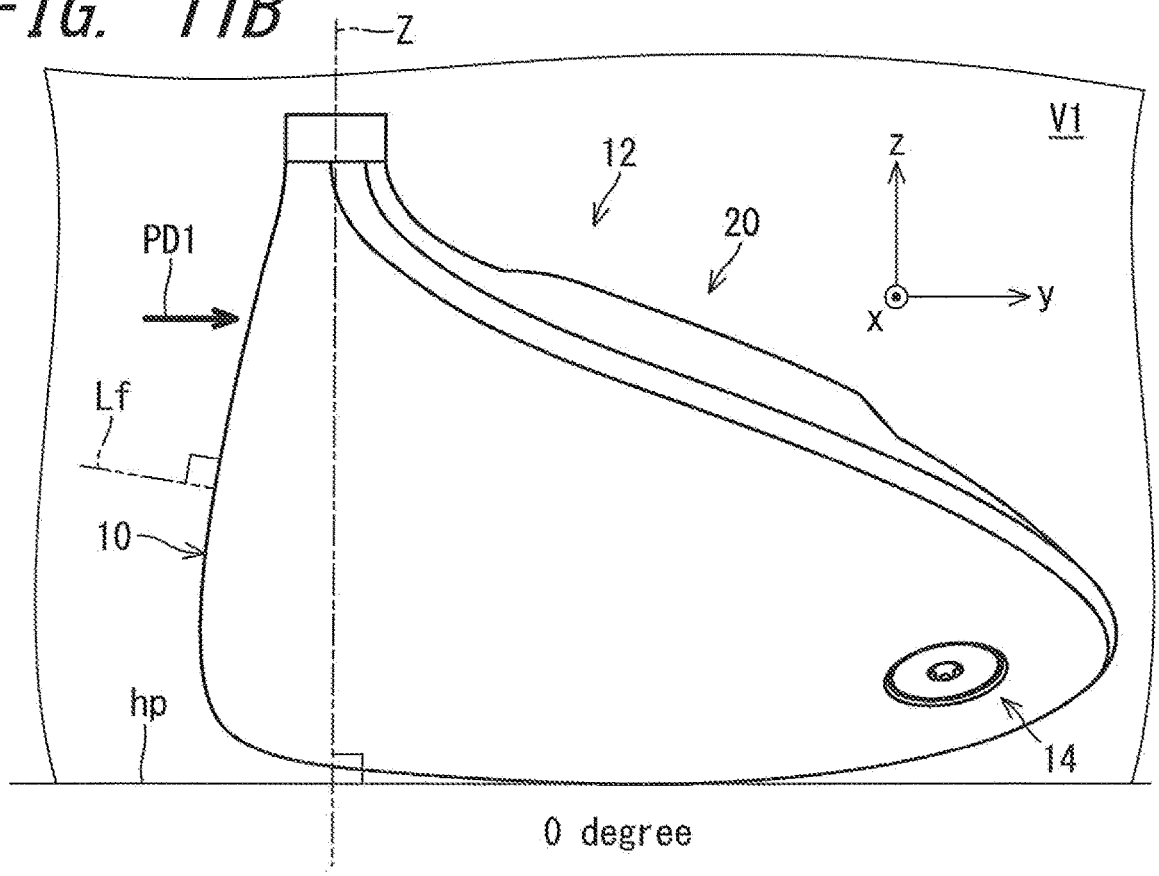
FIG. 11B shows the head in the 0-degree state as viewed from a heel side.

FIG. 11A and FIG. 11B show the head 4 in the 0-degree state. The viewing direction of FIG. 11A and that of FIG. 11B are different by 90°. For easier comparison between FIG. 11A and FIG. 11B, three axes (x-axis, y-axis, z-axis) of a three-dimensional orthogonal coordinate system are added to these drawings.

A state of a head placed in such a manner that the shaft axis line Z is vertical to a horizontal plane hp and the normal line Lf of the striking face 10*a* is parallel to a first perpendicular plane V1 on which the shaft axis line Z lies is defined as a 0-degree state.

The first perpendicular plane V1 is perpendicular to the horizontal plane hp. In FIG. 11A, the first perpendicular plane V1 is shown as a straight line that coincides with the shaft axis line Z. In FIG. 11B, the first perpendicular plane V1 is a plane parallel to the drawing sheet of this figure.

A direction that is parallel to the first perpendicular plane V1 and is parallel to the horizontal plane hp is defined as a projection direction PD1. The projection direction PD1 is perpendicular to the shaft axis line Z.

The projection direction PD1 is specified in one direction. As is described below, the head 4 is rotated by θ° about the shaft axis line Z, but even with the rotation of the head 4, the first perpendicular plane V1 does not rotate, to make the projection direction PD1 unchanged.

Figure 12:
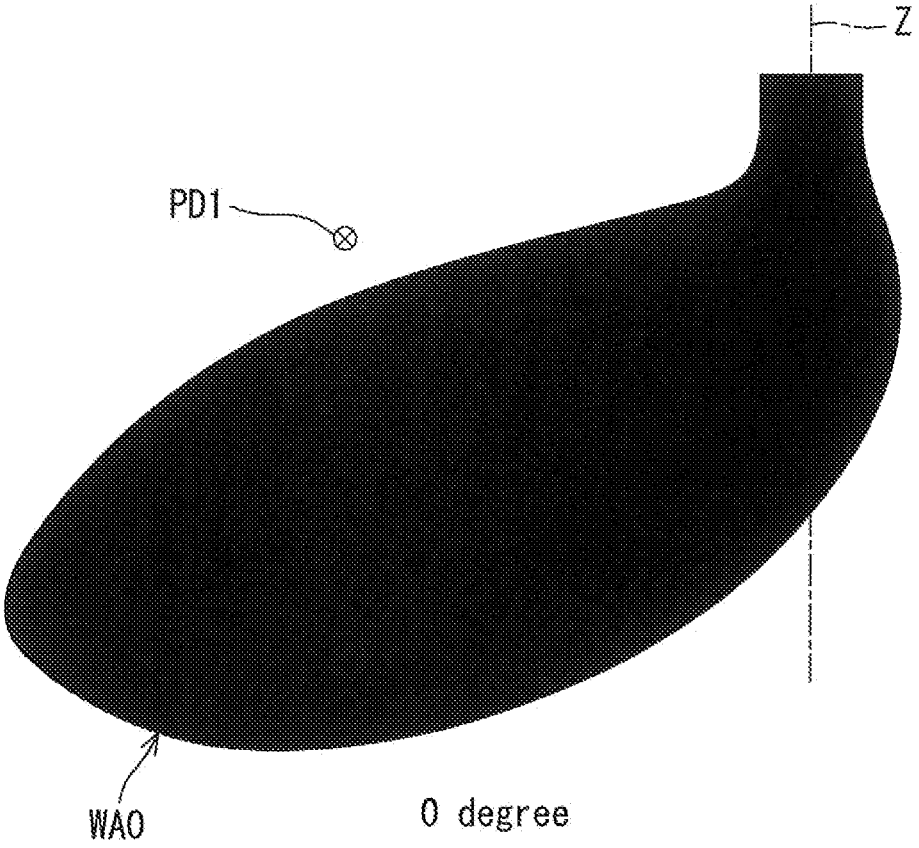
FIG. 12 shows a silhouette of a projection figure of the head in the 0-degree state.

FIG. 12 is a projection figure obtained by projecting the head 4 in the 0-degree state in the projection direction PD1. This projection figure is shown in silhouette. As is described below, the silhouette has an area that is denoted by WA0.

Unless otherwise noted, a projection figure in the present disclosure is a projection figure obtained by projecting an object in the projection direction PD1. This projection figure is a parallel projection figure obtained by projecting an object with light rays parallel to the projection direction PD1.

In the present disclosure, a state in which the head 4 in the 0-degree state is rotated by θ° about the shaft axis line Z toward the back side is defined as a θ-degree state. For example, a state in which the head 4 in the 0-degree state is rotated by 15° about the shaft axis line Z toward the back side is defined as a 15-degree state. For example, a state in which the head 4 in the 0-degree state is rotated by 30° about the shaft axis line Z toward the back side is defined as a 30-degree state. For example, a state in which the head 4 in the 0-degree state is rotated by 90° about the shaft axis line Z toward the back side is defined as a 90-degree state.

The angle θ is set to be greater than or equal to 0° and less than or equal to 90°. This range of θ corresponds to the motion of the head 4 from the start of face rotation to the impact in downswing.

Figure 13A:
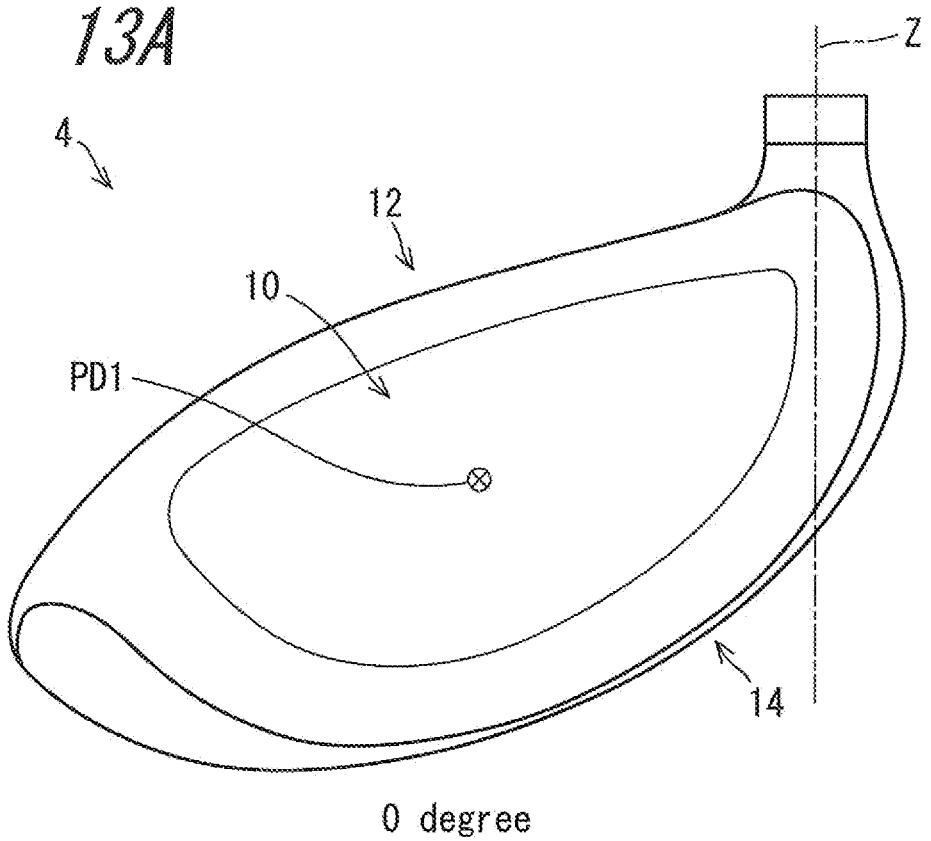
FIG. 13A is a projection figure of the head (of the first embodiment) in the 0-degree state.
Figure 14A:
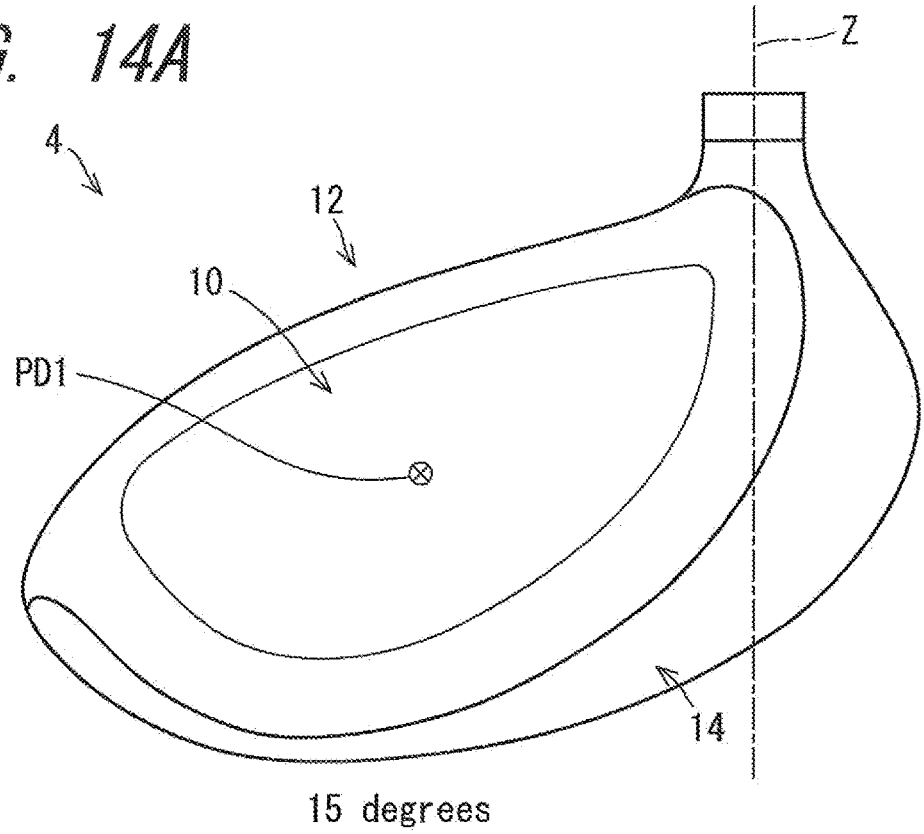
FIG. 14A is a projection figure of the head (of the first embodiment) in a 15-degree state.
Figure 15A:
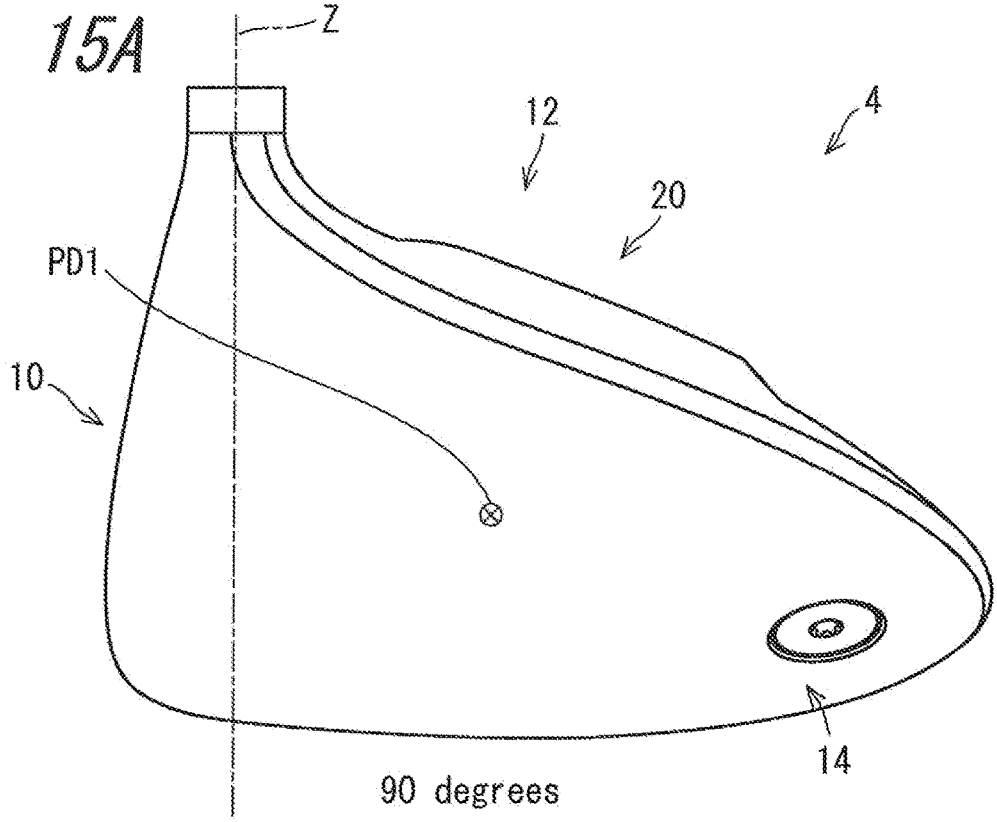
FIG. 15A is a projection figure of the head (of the first embodiment) in a 90-degree state.

FIG. 13A shows the head 4 in the 0-degree state. FIG. 14A shows the head 4 in the 15-degree state. FIG. 15A shows the head 4 in the 90-degree state. In FIG. 13A, FIG. 14A, and FIG. 15A, the projection direction PD1 is a direction perpendicular to the drawing sheets of these figures. As shown in these drawings, regarding the head 4 in the θ-degree state, the posture of the head 4 with respect to the projection direction PD1 changes with the angle θ.

The θ-degree state reflects the relationship between the posture of the head 4 and the moving direction of the head 4 during downswing. The projection direction PD1 corresponds to the moving direction of the head 4 during downswing. In other words, the projection direction PD1 corresponds to the direction of air flow hitting the head 4 during downswing. In the projection direction PD1, the sense of the vector of movement of the head and the sense of the vector of the air flow are opposite to each other. In the drawings of the present disclosure, the projection direction PD1 is indicated by the sense of the vector of the air flow. Note that in the expressions of "the projection direction", "the moving direction of the head", "the sense of the vector of movement of the head", "the direction of the air flow", and "the sense of the vector of the air flow", the terms of "direction" and "sense of the vector" are used as different meanings. In these phrases, the terms of "direction" and "sense of a vector" are used in the mathematical meanings. More specifically, the "direction" means an expression implying two (opposite) "senses of a vector", and there are two "senses of the vector" in one "direction" along a straight line.

Figure 16:
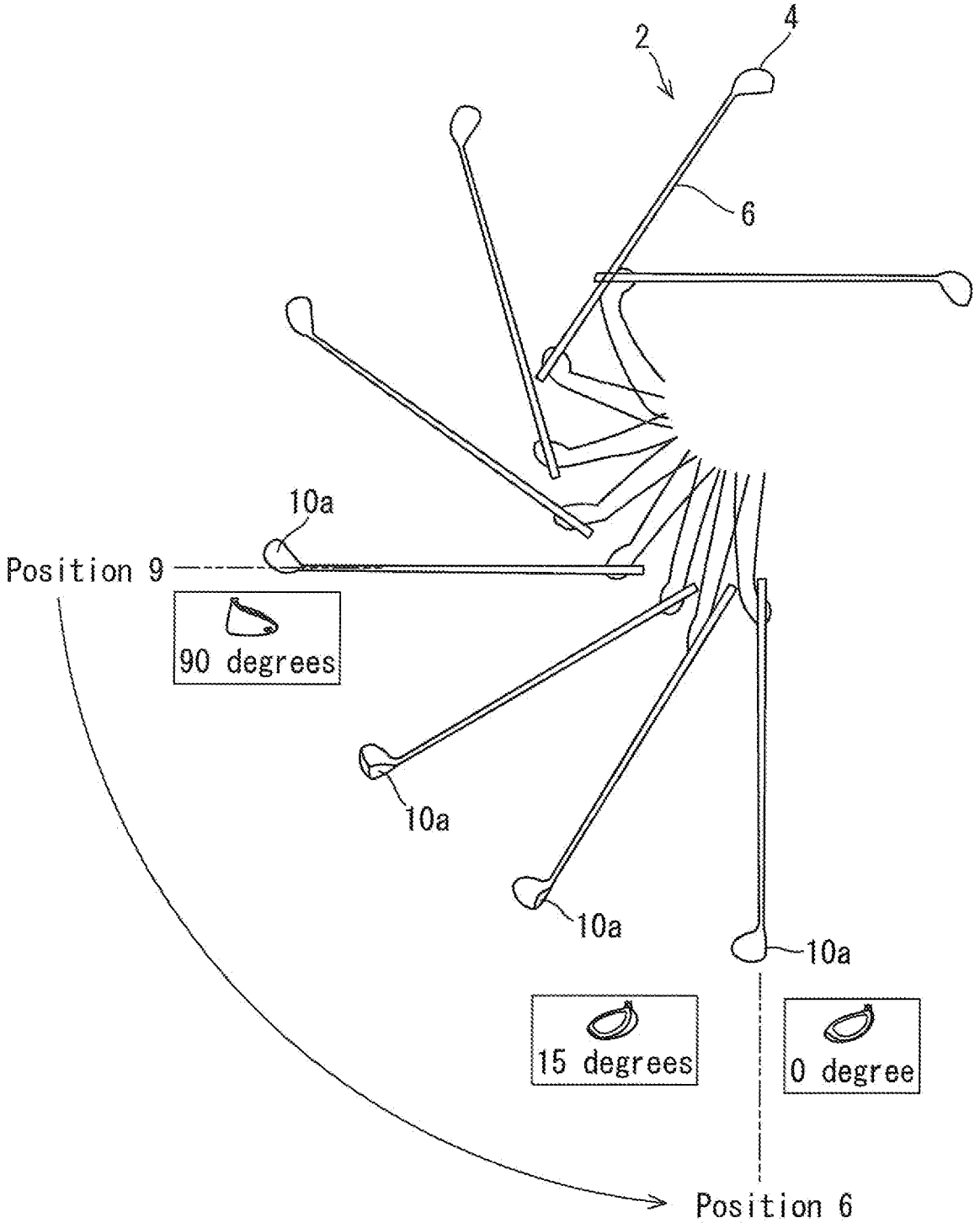
FIG. 16 shows the motion of a golf club during downswing.

FIG. 16 shows the motion of the golf club 2 during downswing. A swinging motion starts from backswing, then transitions from the top of swing to downswing, and reaches impact. With the progress of the downswing, head speed is accelerated. In addition, with the progress of the downswing, the posture of the head changes.

At a certain point of time during downswing, the shaft 6 of the golf club 2 is made parallel to the ground surface. The position of the golf club 2 at this point of time is also referred to as position 9. A position of the golf club at impact is also referred to as position 6. These positions are named by considering the golf club 2 during swing as an hour hand of a clock. That is, for example, the position 9 coincides with the position of an hour hand at nine o'clock in a clock with hands (analog clock).

Wrists of a golfer turn during downswing, and the face rotation progresses. The face rotation is typically started at the position 9 or in the vicinity thereof. The face rotation allows the striking face 10*a* to be oriented toward a target direction at impact.

Given that the moving direction of the head 4 corresponds to the projection direction PD1, the posture of the head 4 is in the 90-degree state when the head 4 starts face rotation. Given that the moving direction of the head 4 corresponds to the projection direction PD1, the posture of the head 4 is in the 0-degree state when the head 4 is positioned at impact. The posture of the head 4 from the start of face rotation till impact corresponds to the θ-degree state when the angle θ is continuously changed from 90° to 0°. The angle θ decreases as the head approaches the impact position.

During downswing, the head 4 moves with its heel side ahead, and receives air resistance during this movement. The inventors of the present disclosure have found that the moving direction of the head 4 in the process of face rotation substantially corresponds to the above-described projection direction PD1. The θ-degree state, with θ ranging from 0 to 90, reflects changes of the posture of the head with the progress of face rotation. With the θ-degree state and the projection direction PD1 taken into consideration, the state of the head 4 during downswing can be appropriately evaluated.

[WAθ, Afθ, Abθ, Sθ]

A projected area of the head 4 projected in the projection direction PD1 when the head 4 is rotated by θ° about the shaft axis line Z toward the back side from the 0-degree state is denoted by WAθ ($mm^2$). For example, a projected area of the head 4 projected in the projection direction PD1 when the head 4 is in the 0-degree state is denoted by WA0 ($mm^2$). WA0 represents the projected area of the head 4 in the 0-degree state. For example, a projected area of the head 4 projected in the projection direction PD1 when the head 4 is rotated by 15° about the shaft axis line Z toward the back side from the 0-degree state is denoted by WA15 ($mm^2$). WA15 represents the projected area of the head 4 in the 15-degree state. For example, a projected area of the head 4 projected in the projection direction PD1 when the head 4 is rotated by 30° about the shaft axis line Z toward the back side from the 0-degree state is denoted by WA30 ($mm^2$). WA30 represents the projected area of the head 4 in the 30-degree state. For example, a projected area of the head 4 projected in the projection direction PD1 when the head 4 is rotated by 90° about the shaft axis line Z toward the back side from the 0-degree state is denoted by WA90 ($mm^2$). WA90 represents the projected area of the head 4 in the 90-degree state. WAθ is the projected area of the entirety of the head 4.

Accordingly, for example, the silhouette in the projection figure shown in FIG. 12, which is in the 0-degree state, has a projected area of WA0.

Each projection figure can be divided into a first region and a second region by the shaft axis line Z. A region to which a force acting in such a direction that the striking face is opened is applied due to air resistance during downswing is defined as the first region. A region to which a force acting in such a direction that the striking face is closed is applied due to the air resistance is defined as the second region. The first region is a region on the face side or the toe side with respect to the shaft axis line Z. The second region is a region on the back side or the heel side with respect to the shaft axis line Z.

Of the projected area WAθ, the area of its first region is denoted by Afθ ($mm^2$). For example, of the projected area WA0, the area of its first region is denoted by Af0. For example, of the projected area WA15, the area of its first region is denoted by Af15. For example, of the projected area WA30, the area of its first region is denoted by Af30. For example, of the projected area WA90, the area of its first region is denoted by Af90.

On the other hand, of the projected area WAθ, the area of its second region is denoted by Abθ ($mm^2$). For example, of the projected area WA0, the area of its second region is denoted by Abθ. For example, of the projected area WA15, the area of its second region is denoted by Ab15. For example, of the projected area WA30, the area of its second region is denoted by Ab30. For example, of the projected area WA90, the area of its second region is denoted by Ab90.

Figure 13B:
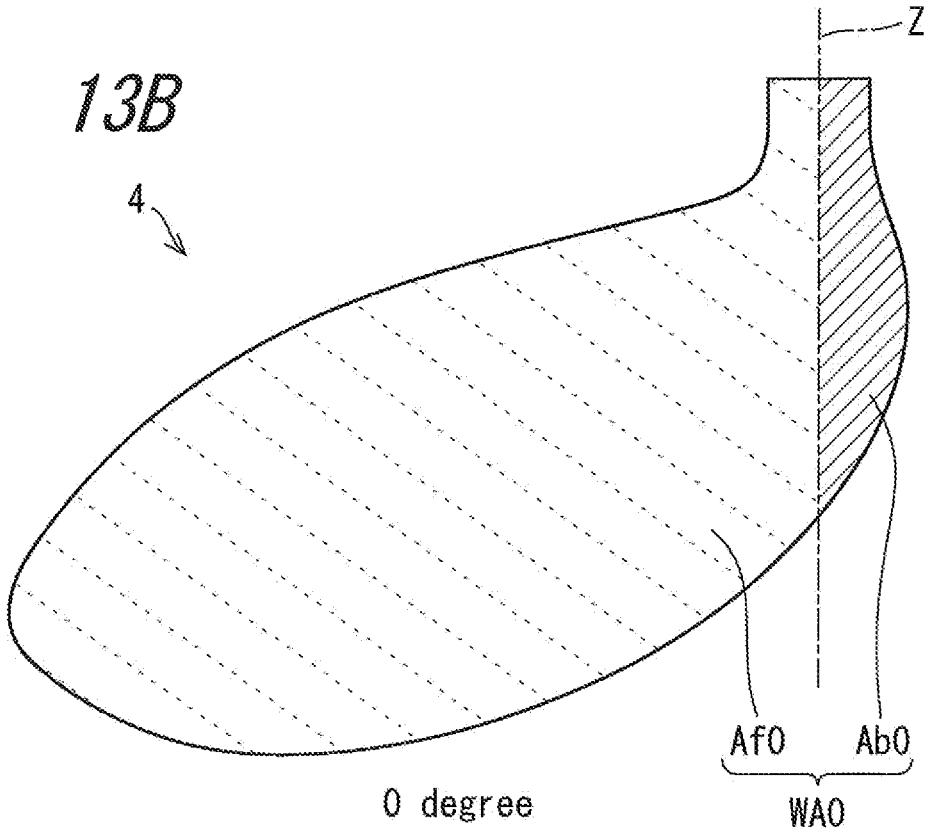
FIG. 13B shows a projected area of the head in the 0-degree state, the projected area being divided by a shaft axis line into a first region and a second region.
Figure 14B:
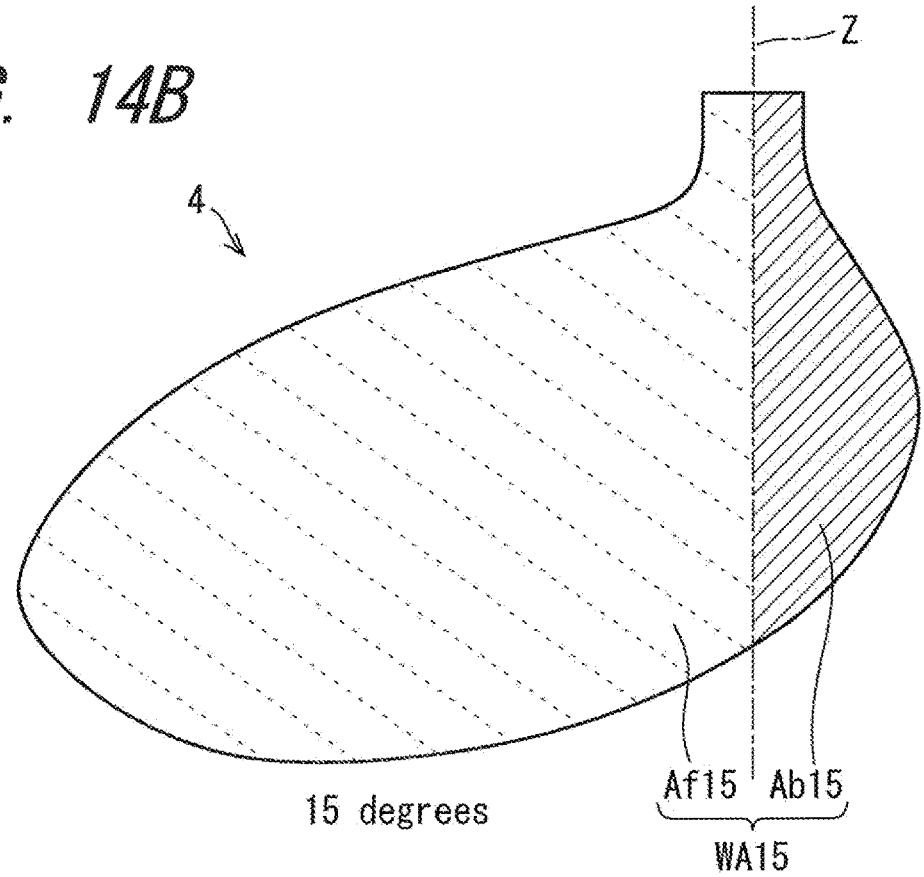
FIG. 14B shows a projected area of the head in the 15-degree state, the projected area being divided by the shaft axis line into a first region and a second region.
Figure 15B:
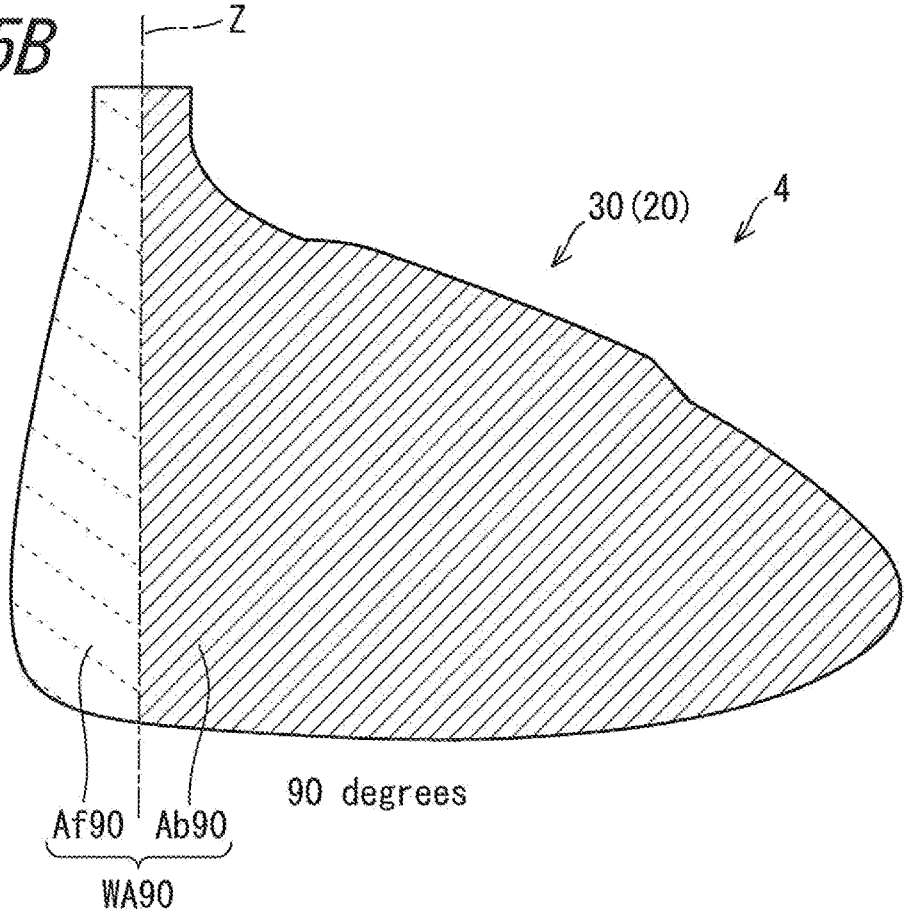
FIG. 15B shows a projected area of the head in the 90-degree state, the projected area being divided by the shaft axis line into a first region and a second region.

FIG. 13B is a projection figure of the head 4 in the 0-degree state divided by the shaft axis line Z into two regions. FIG. 14B is a projection figure of the head 4 in the 15-degree state divided by the shaft axis line Z into two regions. FIG. 15B is a projection figure of the head 4 in the 90-degree state divided by the shaft axis line Z into two regions. Since the head 4 is for a right-hander, in these projection figures, the left side with respect to the shaft axis line Z is the first region, and the right side with respect to the shaft axis line Z is the second region.

For example, in the 0-degree state in FIG. 13B, a portion indicated with broken line hatching has an area that is denoted by Af0, and a portion indicated with solid line hatching has an area that is denoted by Ab0. The sum of Af0 and Ab0 is WA0.

For example, in the 15-degree state in FIG. 14B, a portion indicated with broken line hatching has an area that is denoted by Af15, and a portion indicated with solid line hatching has an area that is denoted by Ab15. The sum of Af15 and Ab15 is WA15.

For example, in the 90-degree state in FIG. 15B, a portion indicated with broken line hatching has an area that is denoted by Af90, and a portion indicated with solid line hatching has an area that is denoted by Ab90. The sum of Af90 and Ab90 is WA90.

In this way, even when θ is any angle within the range of 0° to 90° inclusive, the projected area WAθ in the θ-degree state is divided into the area Afθ of the first region, and the area Abθ of the second region.

A value of Afθ minus Abθ, that is, a difference (Afθ−Abθ) is denoted by Sθ ($mm^2$). For example, a difference (Af0−Ab0) is denoted by S0. For example, a difference (Af15−Ab15) is denoted by S15. For example, a difference (Af30−Ab30) is denoted by S30. For example, a difference (Af90−Ab90) is denoted by S90.

During swing, air resistance acts on the head 4. This air resistance can act as a force that causes the head 4 to rotate about the shaft axis line Z. The influence of this air resistance on the head 4 varies depending on the projected area of the head 4 projected in the projection direction corresponding to the sense of the vector of the air flow.

The air resistance received by the first region rotates the head 4 in such a direction that the face 10*a* is opened. Accordingly, the greater the area Afθ is, the more easily the face 10*a* is opened. On the other hand, the air resistance received by the second region rotates the head 4 in such a direction that the face 10*a* is closed. Accordingly, the greater the area Abθ is, the more easily the face 10*a* is closed. In addition, as the area Abθ becomes greater with respect to the area Afθ, the face 10*a* is more easily closed.

The head 4 is designed so that the second region has a large area when the head 4 is positioned at the start of face rotation. That is, the head 4 is designed so that Ab90 is large. This increases the air resistance acting on the second region, thereby allowing a force to easily act in such a direction that the face 10*a* is closed. In the 90-degree state, the area Ab90 of the second region is large (see FIG. 15B), and by utilizing such a large Ab90, the face rotation is promoted. In addition, the head 4 is designed so that the first region has a small area when the head 4 is positioned immediately before impact. That is, the head 4 is designed so that Af15 is small. This decreases the air resistance acting on the first region, thereby facilitating the face rotation. Further, by decreasing Af15 of the first region, which occupies a large proportion in the projected area WA15 when the head 4 is positioned immediately before impact, the air resistance acting on the head as a whole is suppressed, whereby head speed can be increased. As the head speed is high immediately before impact, the air resistance is likely to increase. Accordingly, by decreasing Af15, the air resistance acting on the head 4 can be suppressed effectively.

The promotion of face rotation leads to excellent ball catchability. Such excellent ball catchability can prevent an impact in a state in which the face 10*a* is opened, which can increase the flight distance. In addition, the increase in the head speed leads to an increase in the flight distance.

The "excellent ball catchability" means that the face 10*a* is unlikely to be open at impact. When a head having excellent ball catchability is used, the face 10*a* is likely to be square or slightly closed at impact. When a head having excellent ball catchability is used, the energy of the head is efficiently transmitted to a ball, which can produce a strong trajectory of the hit ball and increase the flight distance.

With a view to promoting the face rotation and increasing the head speed, S90 ($mm^2$), which is the difference (Af90−Ab90), is preferably small. From this viewpoint, S90 is preferably less than or equal to −4500 ($mm^2$), more preferably less than or equal to −4550 ($mm^2$), still more preferably less than or equal to −4600 ($mm^2$), and even more preferably less than or equal to −4700 ($mm^2$). Considering a restriction in head volume, S90 is preferably greater than or equal to −5100 ($mm^2$), more preferably greater than or equal to −5000 ($mm^2$), and further preferably greater than or equal to −4900 ($mm^2$).

With a view to promoting the face rotation and increasing the head speed, S15 ($mm^2$), which is the difference (Af15−Ab15), is preferably small. From this viewpoint, S15 is preferably less than or equal to 4700 ($mm^2$), more preferably less than or equal to 4650 ($mm^2$), still more preferably less than or equal to 4600 ($mm^2$), even more preferably less than or equal to 4550 ($mm^2$), and further more preferably less than or equal to 4500 ($mm^2$). With a view to increasing the moment of inertia of the head 4 and enlarging a sweet area, the head 4 preferably has a large head volume. From this viewpoint, S15 is preferably greater than or equal to 4200 ($mm^2$), more preferably greater than or equal to 4300 ($mm^2$), and still more preferably greater than or equal to 4400 ($mm^2$).

The head can be designed so that the second region has a large projected area while the projected area of the entirety of the head is suppressed, when the head is positioned at the start of face rotation. An increase in the air resistance acting on the second region allows the face 10*a* to be easily closed. From these viewpoints, a ratio (WA90/Ab90) is preferably less than or equal to 1.205, more preferably less than or equal to 1.200, and still more preferably less than or equal to 1.195. A head having Ab90 excessively large with respect to Af90 could cause golfers to feel a sense of incongruity in the shape of the head. From this viewpoint, the ratio (WA90/Ab90) is preferably greater than or equal to 1.100, more preferably greater than or equal to 1.130, and still more preferably greater than or equal to 1.160.

The head can be designed so that the second region has a large projected area, while the projected area of the entirety of the head is suppressed, when the head is positioned immediately before impact. This reduces air resistance acting on the head as a whole, which can increase the head speed. In addition, this increases air resistance acting on the second region, which allows the face 10*a* to be easily closed and promotes the face rotation. From these viewpoints, a ratio (WA15/Ab15) is preferably less than or equal to 7.00, more preferably less than or equal to 6.80, and still more preferably less than or equal to 6.50. A head having Ab15 excessively small with respect to Af15 could cause golfers to feel a sense of incongruity in the shape of the head. From this viewpoint, the ratio (WA15/Ab15) is preferably greater than or equal to 5.50, more preferably greater than or equal to 5.80, and still more preferably greater than or equal to 6.00.

Increasing an absolute value of S90 at the start of face rotation enables to increase a force acting in such a direction that the face 10*a* is closed. In addition, decreasing an absolute value of S15 immediately before impact enables to decrease a force acting in such a direction that the face 10*a* is opened, and to reduce air resistance. With a view to promoting the face rotation and increasing the head speed, a ratio (|S90|/|S15|) is preferably greater than or equal to 1.00, more preferably greater than or equal to 1.06, still more preferably greater than or equal to 1.10, and further preferably greater than or equal to 1.12. From the viewpoint of the sense of incongruity in the shape of the head, the ratio (|S90|/|S15|) is preferably less than or equal to 1.20, more preferably less than or equal to 1.18, and still more preferably less than or equal to 1.16.

Note that "|S90|" means the absolute value of S90, and "|S15|" means the absolute value of S15. In the present embodiment, since S90 is a negative value, |S90| is equal to −S90. On the other hand, since S15 is a positive value, |S15| is equal to S15.

As shown in FIG. 15A, the protruding portion 20 is viewable in the projection figure of the head 4 in the 90-degree state. The protruding portion 20 constitutes a part of the outer contour line in the projection figure of the head 4 in the 90-degree state. The protruding portion 20 affects Ab90. The protruding portion 20 increases Ab90. On the other hand, as shown in FIG. 13A, the protruding portion 20 is not viewable in the projection figure of the head 4 in the 0-degree state. The protruding portion 20 does not constitute any part of the outer contour line in the projection figure of the head 4 in the 0-degree state. The protruding portion 20 does not affect Af0. The protruding portion 20 does not increase Af0. The protruding portion 20 does not increase Ab0. As shown in FIG. 14A, the protruding portion 20 is not viewable in the projection figure of the head 4 in the 15-degree state. The protruding portion 20 does not constitute any part of the outer contour line in the projection figure of the head 4 in the 15-degree state. The protruding portion 20 does not affect Af15. The protruding portion 20 does not increase Af15. The protruding portion 20 does not increase Ab15. The protruding portion 20 contributes to decreasing S90 and not increasing S15. The protruding portion 20 contributes to decreasing the ratio (WA90/Ab90) and not increasing the ratio (WA15/Ab15). The protruding portion 20 contributes to increasing the ratio (|S90|/|S15|).

Figure 17A:
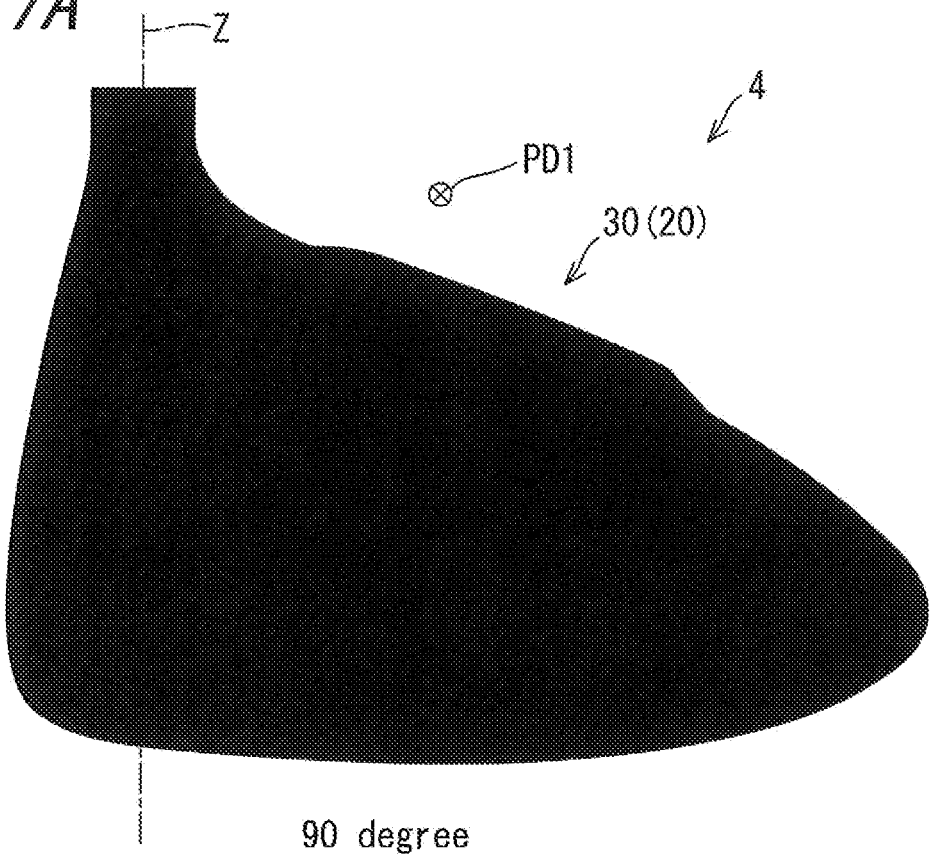
FIG. 17A shows a silhouette of a projection figure of the head in the 90-degree state.

FIG. 17A shows a silhouette of the projection figure of the head 4 in the 90-degree state. In this projection figure, the contour line of the head 4 includes a protuberance 30. This protuberance 30 is also referred to as a silhouette protuberance. As described above, the protruding portion 20 can be seen in the projection figure of the head 4 in the 90-degree state. The silhouette protuberance 30 is formed by the protruding portion 20. Ab90 is enlarged by the presence of the silhouette protuberance 30.

Figure 17B:
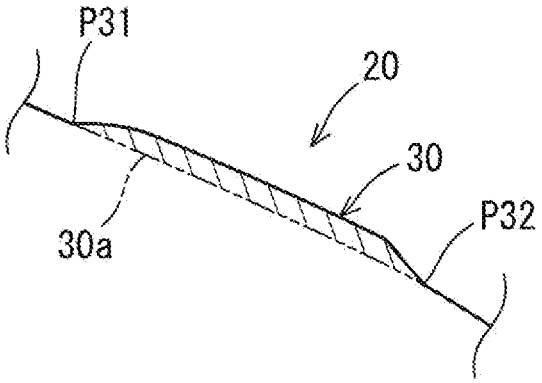
FIG. 17B illustrates an additional area provided by a silhouette protuberance.

An inflection point of the contour line of the projection figure of the head 4 can be a starting point of the silhouette protuberance 30. A vertex of an angle of the contour line of the projection figure of the head 4 can be a starting point of the silhouette protuberance 30. In the present embodiment, not an inflection point but a vertex is the starting point of the silhouette protuberance 30 on each side of the silhouette protuberance 30. As shown in FIG. 17B, in the silhouette protuberance 30 of the present embodiment, vertices P31 and P32 of angles are the starting points of the silhouette protuberance 30.

A cubic Bezier curve can be drawn also for the silhouette protuberance 30 in the same manner as discussed above. A two-dot chain line in FIG. 17B shows the Bezier curve. This Bezier curve is a curved line that smoothly connects curved lines adjacent to both ends of the silhouette protuberance 30. This Bezier curve can be a contour line 30*a* of the projection figure when the protruding portion 20 is not present. An area of a portion surrounded by the line of the silhouette protuberance 30 and the virtual contour line 30*a* is indicated with hatching. This area is an area added by the protruding portion 20. This area is also referred to as an additional area. The protruding portion 20 increases WA90 by this additional area. The protruding portion 20 increases Ab90 by this additional area.

With a view to increasing the additional area in Ab90 in the 90-degree state to increase air resistance on the second region, the maximum value of the height Ht of the protruding portion 20 is preferably greater than or equal to 2 mm, more preferably greater than or equal to 2.5 mm, and still more preferably greater than or equal to 3 mm. An excessively large height Ht produces the additional area in Af15 of the 15-degree state and increases air resistance on the first region. From this viewpoint, the maximum value of the height Ht of the protruding portion 20 is preferably less than or equal to 12 mm, more preferably less than or equal to 10 mm, and still more preferably less than or equal to 8 mm.

Note that even when the protruding portion forms a part of the contour line of the projection figure, the silhouette protuberance is not formed in the projection figure in some cases. For example, when the protruding portion reaches the outer peripheral edge of the crown portion and extends along the outer peripheral edge, the silhouette protuberance might not be formed. Even in such a case, however, the protruding portion increases the projected area WAθ in the projection figure.

Figure 18:
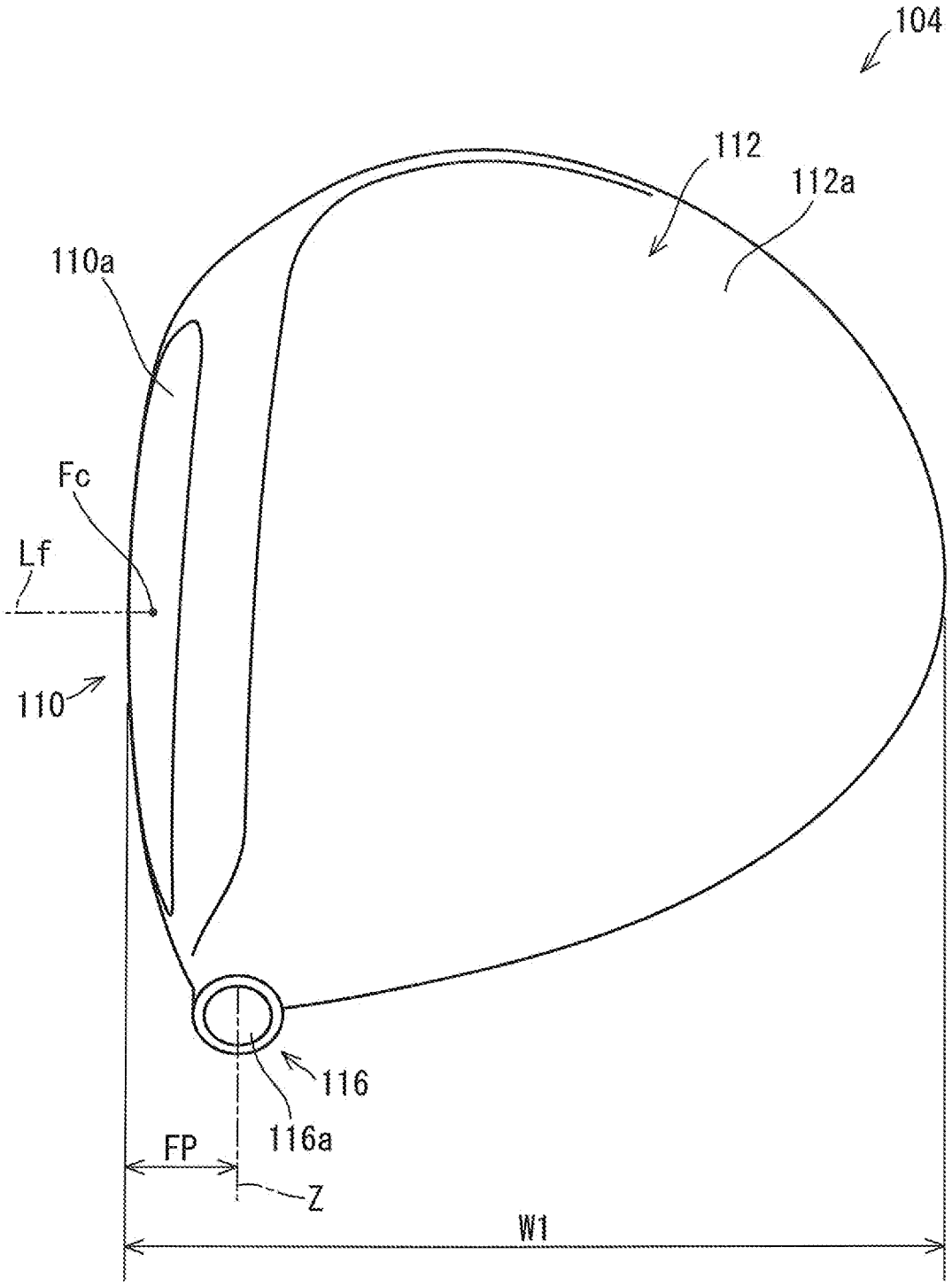
FIG. 18 is a plan view of a head of a second embodiment as viewed from the crown side.
Figure 19:
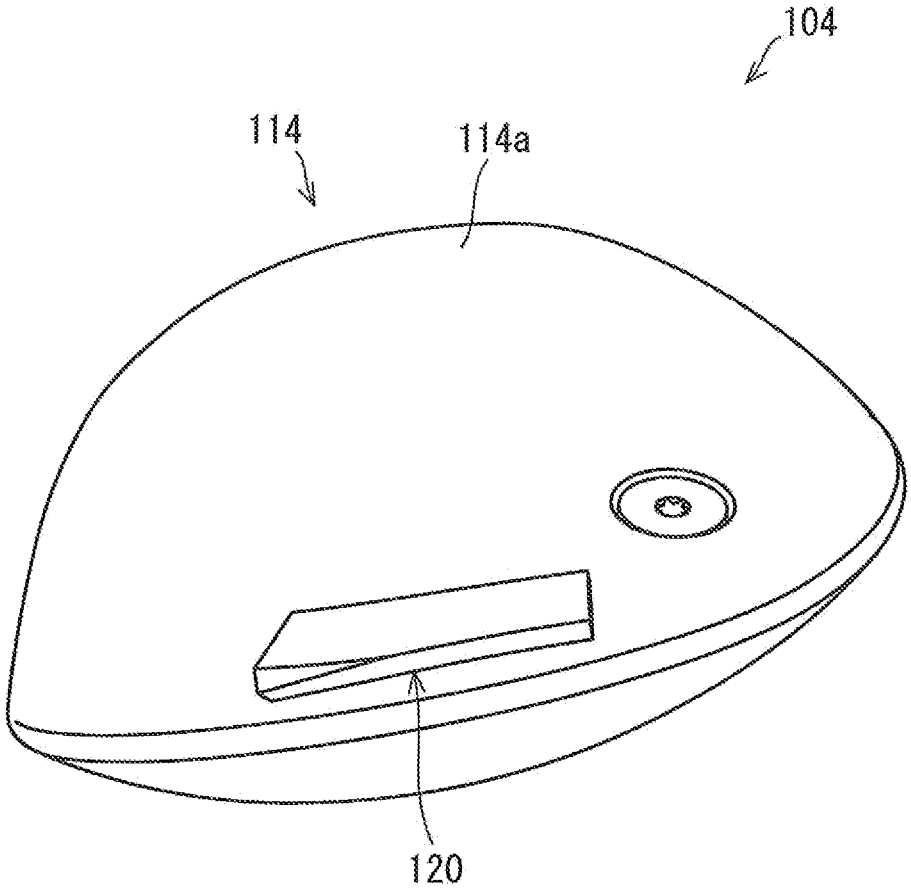
FIG. 19 is a perspective view of the head of the second embodiment, with its sole faced upward, as viewed from a back toe side.
Figure 20A:
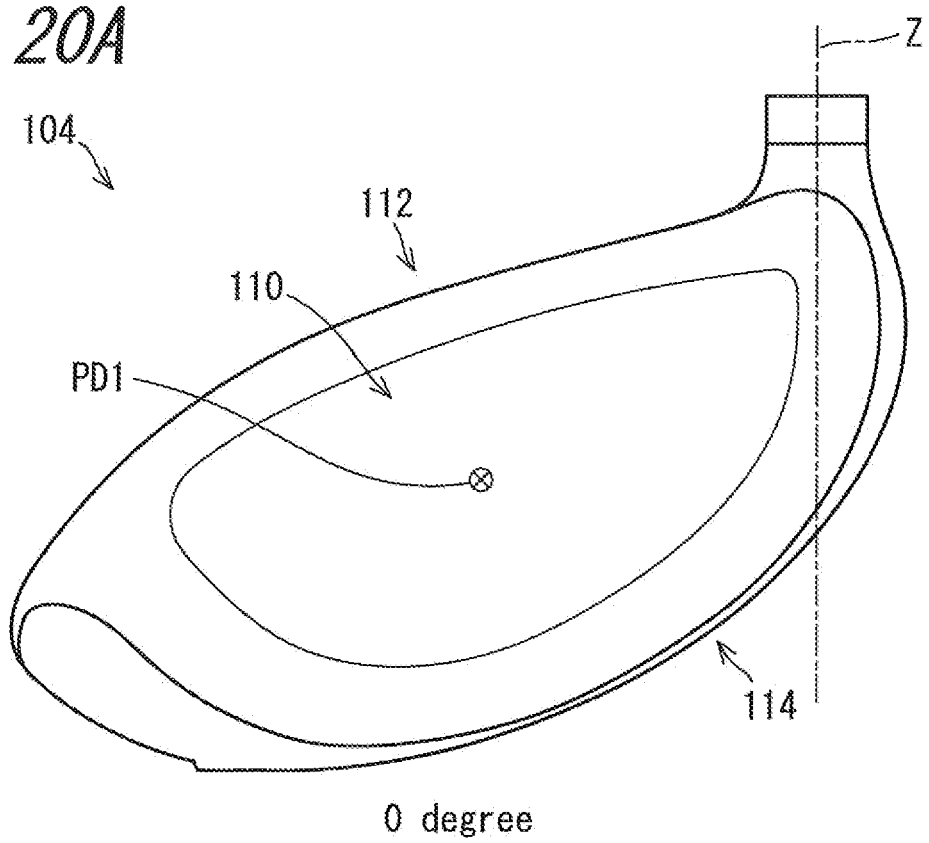
FIG. 20A is a projection figure of the head (of the second embodiment) in the 0-degree state.
Figure 21A:
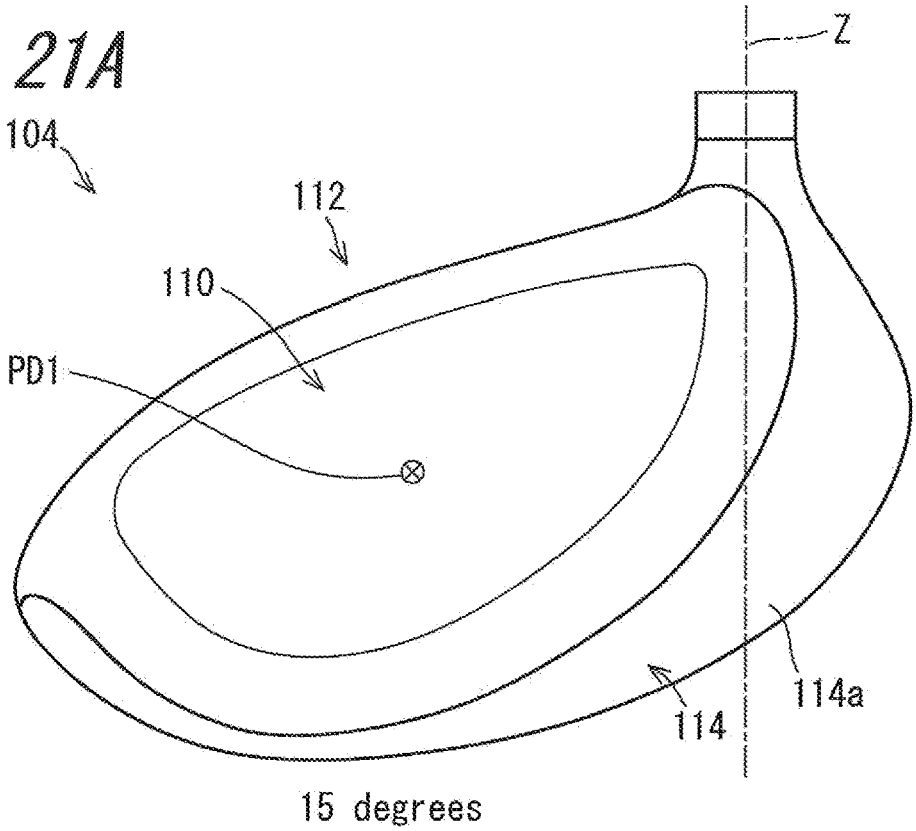
FIG. 21A is a projection figure of the head (of the second embodiment) in the 15-degree state.
Figure 22A:
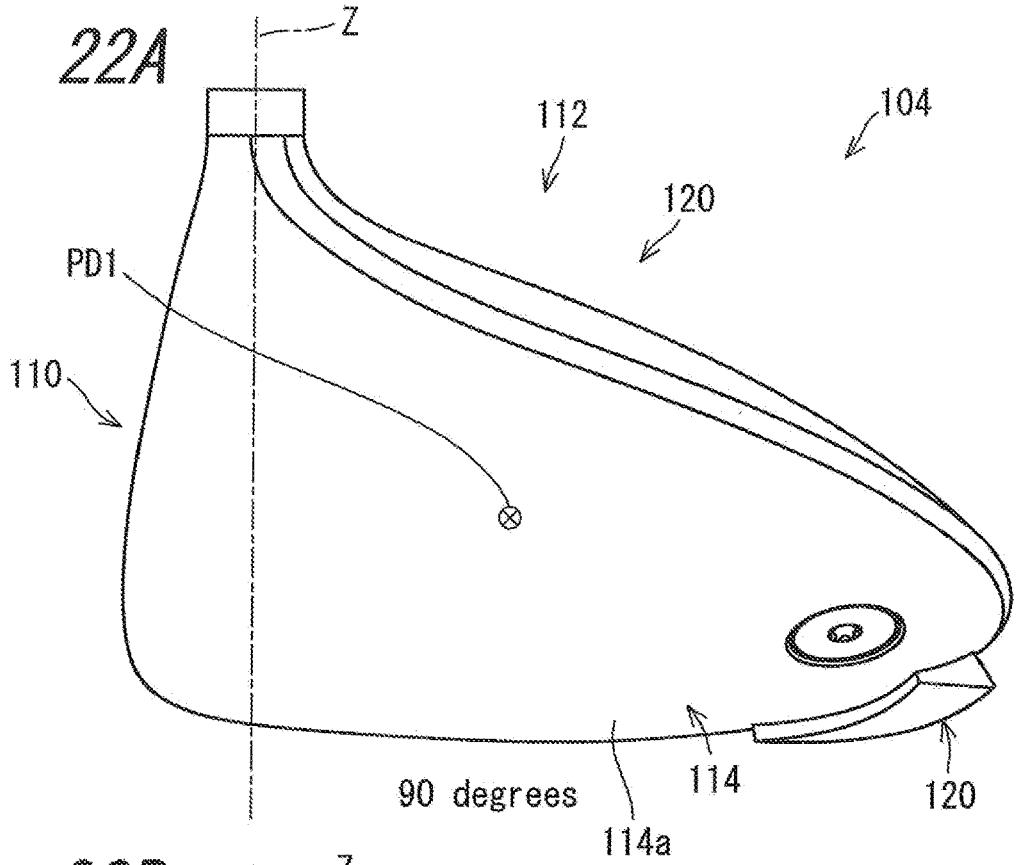
FIG. 22A is a projection figure of the head (of the second embodiment) in the 90-degree state.

FIG. 18 is a plan view of a head 104 according to a second embodiment. FIG. 19 is a perspective view of the head 104, with its sole 114 faced upward, as viewed from the back toe side. FIG. 20A shows the head 104 in the 0-degree state. FIG. 21A shows the head 104 in the 15-degree state. FIG. 22A shows the head 104 in the 90-degree state. In FIG. 20A, FIG. 21A, and FIG. 22A, the projection direction PD1 is a direction perpendicular to the drawing sheets of these figures.

Figure 20B:
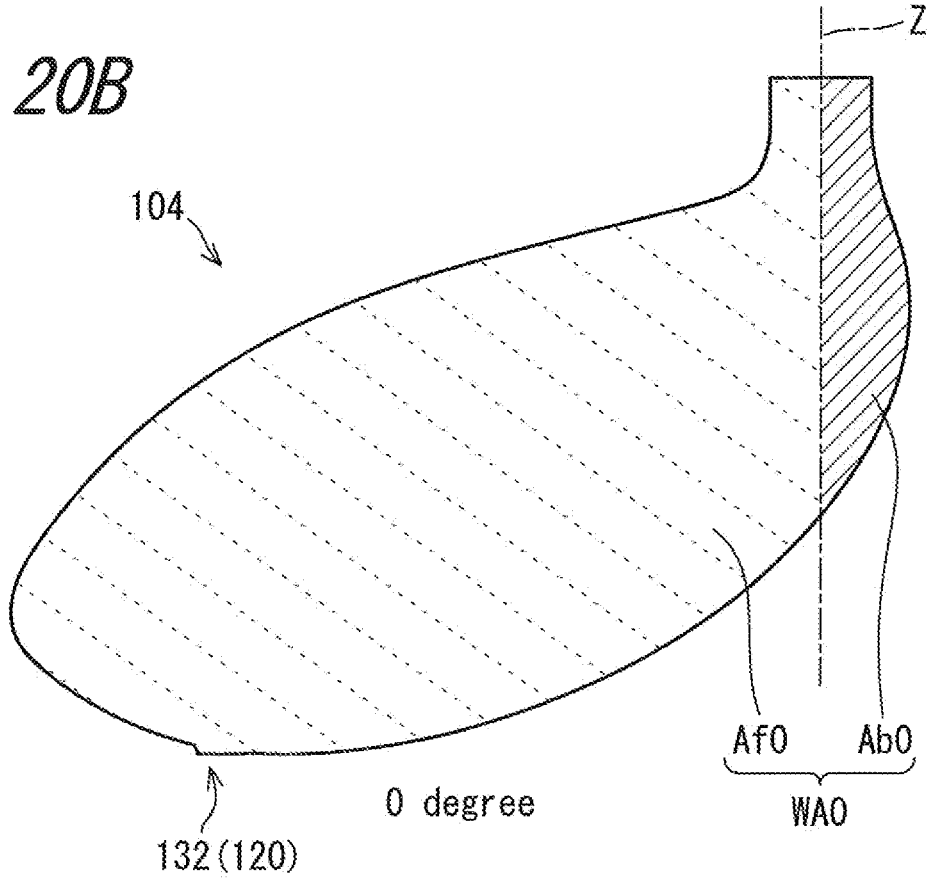
FIG. 20B shows a projected area of the head in the 0-degree state, the projected area being divided by the shaft axis line into a first region and a second region.
Figure 21B:
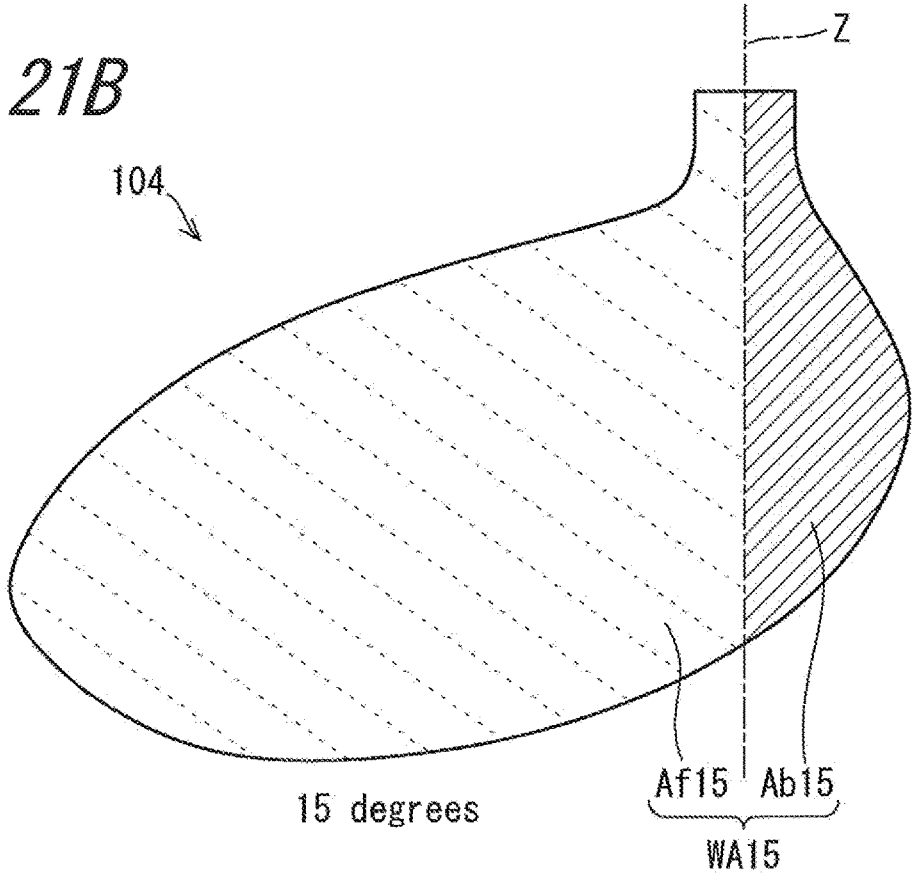
FIG. 21B shows a projected area of the head in the 15-degree state, the projected area being divided by the shaft axis line into a first region and a second region.
Figure 22B:
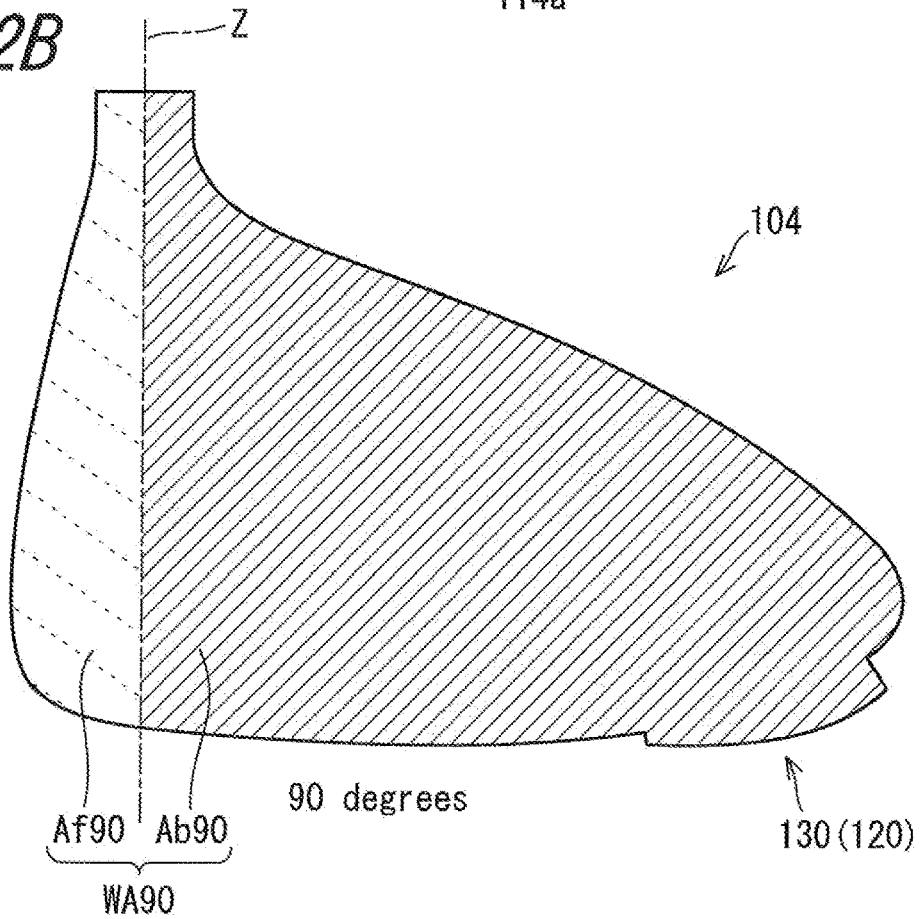
FIG. 22B shows a projected area of the head in the 90-degree state, the projected area being divided by the shaft axis line into a first region and a second region.

FIG. 20B is a projection figure of the head 104 in the 0-degree state divided by the shaft axis line Z into two regions. FIG. 21B is a projection figure of the head 104 in the 15-degree state divided by the shaft axis line Z into two regions. FIG. 22B is a projection figure of the head 104 in the 90-degree state divided by the shaft axis line Z into two regions.

The head 104 includes a face portion 110, a crown portion 112, a sole portion 114, and a hosel portion 116. The face portion 110 includes a striking face 110*a*. The striking face 110*a* is the outer surface of the face portion 110. The crown portion 112 forms a crown outer surface 112*a*. The sole portion 114 forms a sole outer surface 114*a*. The hosel portion 116 has a shaft hole 116*a*.

The striking face 110*a* has a face center Fc as defined above. The striking face 110*a* has a normal line Lf. The normal line Lf is a line normal to the striking face 110*a* at the face center Fc.

The head 104 includes, on its outer surface, a protruding portion 120. In the present embodiment, the protruding portion 120 is formed on the sole portion 114. The sole portion 114 includes the protruding portion 120 on the sole outer surface 114*a*. Although not shown in the drawings, the protruding portion 120 is hollow. The protruding portion 120 forms a projection on the sole outer surface 114*a* and forms a recess on a sole inner surface. The protruding portion 120 may be solid (not hollow). The protruding portion 120 is positioned on the back side in the sole portion 114. The protruding portion 120 is positioned on the back side with respect to the center of gravity of the head 104.

In the present embodiment, the entirety of the protruding portion 120 is formed on the sole outer surface 114*a*. The protruding portion 120 does not extend to other portions than the sole outer surface 114*a*.

In the 0-degree state shown in FIG. 20B, a portion indicated with broken line hatching has an area that is denoted by Afθ, and a portion indicated with solid line hatching has an area that is denoted by Ab0. The sum of Af0 and Ab0 is WA0.

In the 15-degree state shown in FIG. 21B, a portion indicated with broken line hatching has an area that is denoted by Af15, and a portion indicated with solid line hatching has an area that is denoted by Ab15. The sum of Af15 and Ab15 is WA15.

In the 90-degree state shown in FIG. 22B, a portion indicated with broken line hatching has an area that is denoted by Af90, and a portion indicated with solid line hatching has an area that is denoted by Ab90. The sum of Af90 and Ab90 is WA90.

As shown in FIG. 22A, the protruding portion 120 is viewable in the projection figure of the head 104 in the 90-degree state. As shown in FIG. 22B, the protruding portion 120 constitutes a part of the outer contour line in the projection figure of the head 104 in the 90-degree state. The protruding portion 120 affects Ab90. The protruding portion 120 increases Ab90. The protruding portion 120 does not increase Af90. As shown in FIG. 20A, the protruding portion 120 is viewable in the projection figure of the head 104 in the 0-degree state. As shown in FIG. 20B, the protruding portion 120 constitutes a part of the outer contour line in the projection figure of the head 104 in the 0-degree state. The protruding portion 120, however, has a small effect on Af0. The protruding portion 120 hardly increases Af0. The protruding portion 120 does not increase Ab0. As shown in FIG. 21A, the protruding portion 120 is not viewable in the projection figure of the head 104 in the 15-degree state. As shown in FIG. 21B, the protruding portion 120 does not constitute any part of the outer contour line in the projection figure of the head 104 in the 15-degree state. The protruding portion 120 does not affect Af15. The protruding portion 120 does not increase Af15. The protruding portion 120 does not increase Ab15. The protruding portion 120 contributes to decreasing S90 and not increasing S15. The protruding portion 120 contributes to decreasing the ratio (WA90/

Ab90) and not increasing the ratio (WA15/Ab15). The protruding portion 120 contributes to increasing the ratio (|S90|/|S15|).

As shown in FIG. 22B, the projection figure of the head 104 in the 90-degree state includes a silhouette protuberance 130. As described above, the protruding portion 120 can be seen in the projection figure of the 90-degree state. The silhouette protuberance 130 is formed by the protruding portion 120. Ab90 is enlarged by the presence of the silhouette protuberance 130.

As shown in FIG. 20B, the projection figure of the head 104 in the 0-degree state includes a silhouette protuberance 132. The silhouette protuberance 132 is formed by the protruding portion 120. Af0 is enlarged by the presence of the silhouette protuberance 132. The additional area added by the presence of the silhouette protuberance 132, however, is small.

In the 90-degree state, the protruding portion 120 forms an additional area in the second region, and does not form an additional area in the first region (see FIG. 22A and FIG. 22B). In the 15-degree state, the protruding portion 120 does not form an additional area in the first region, and does not form an additional area in the second region (see FIG. 21A and FIG. 21B). In the 0-degree state, the protruding portion 120 hardly forms an additional area in the first region, and does not form an additional area in the second region (see FIG. 20A and FIG. 20B). The additional area in the second region of the 90-degree state is denoted by D90. The additional area in the first region of the 15-degree state is denoted by M15. The additional area in the first region of the 0-degree state is denoted by M0. As described above, M0 is small in the head 104. From the viewpoint of the face rotation, M0/D90 is preferably less than or equal to 0.3, more preferably less than or equal to 0.2, still more preferably less than or equal to 0.1, and even more preferably 0. M15/D90 is preferably less than or equal to 0.3, more preferably less than or equal to 0.2, still more preferably less than or equal to 0.1, and even more preferably 0. In the head 104, the additional area M15 is zero.

Figure 23:
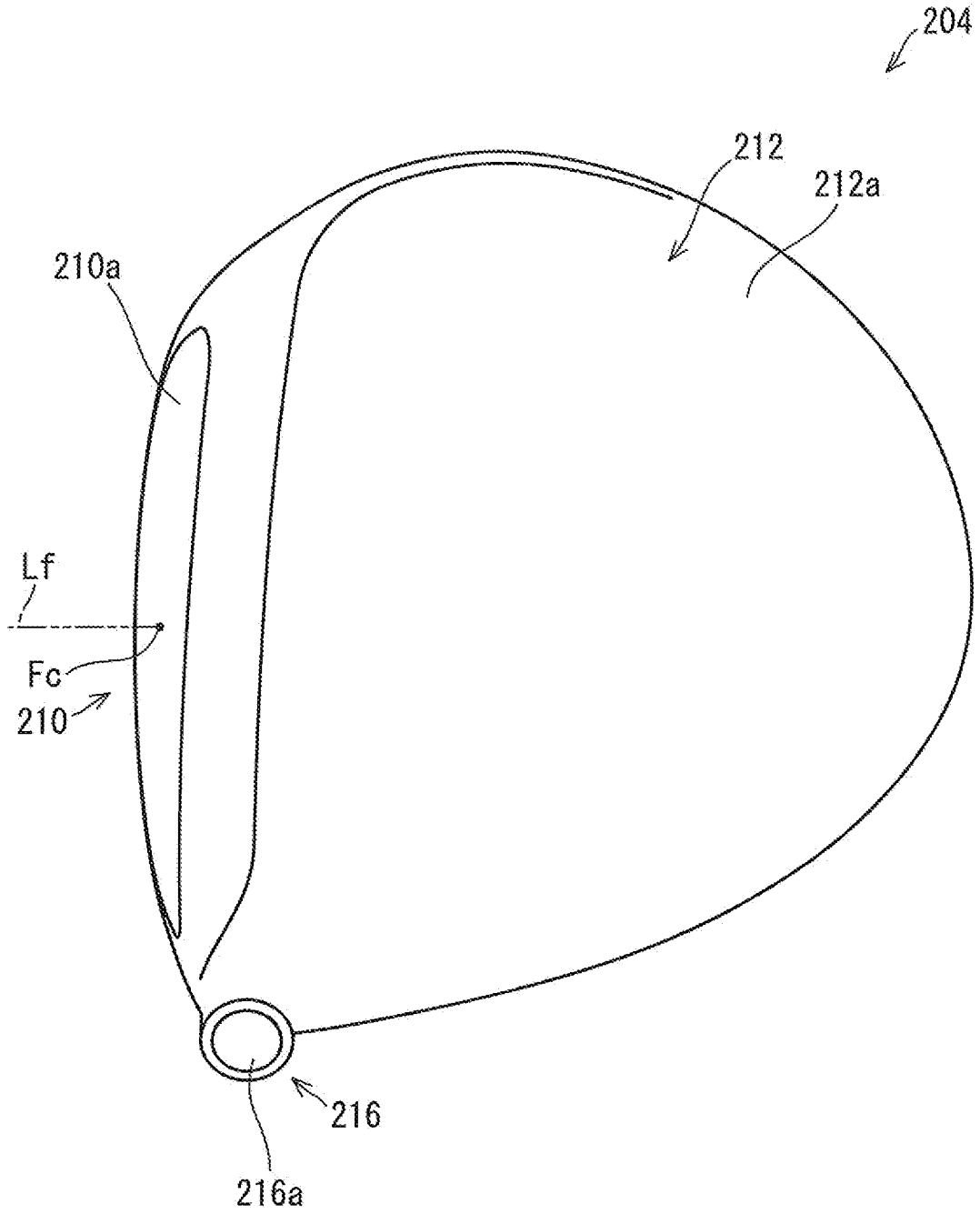
FIG. 23 is a plan view of a head of a third embodiment as viewed from the crown side.
Figure 24:
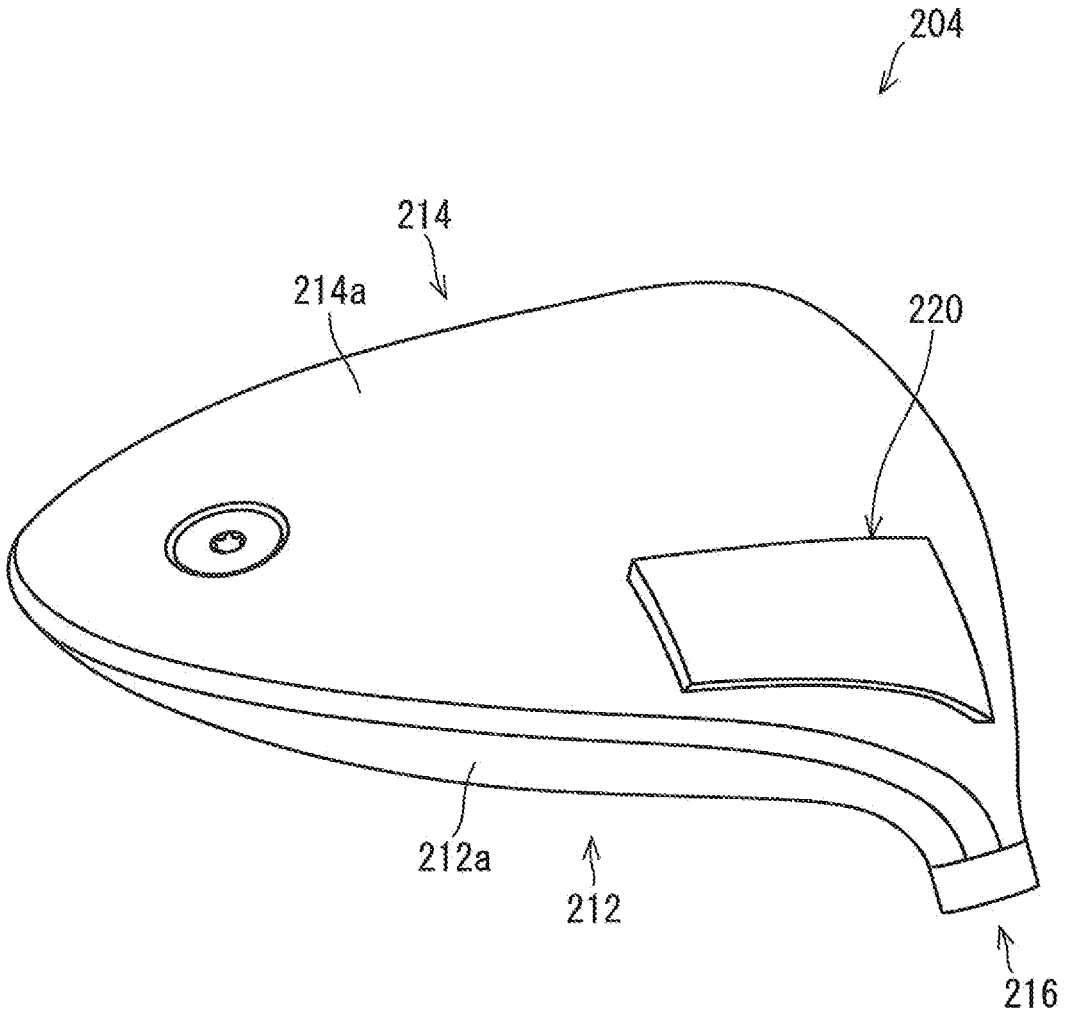
FIG. 24 is a perspective view of the head of the third embodiment, with its sole faced upward, as viewed from the heel back side.
Figure 25A:
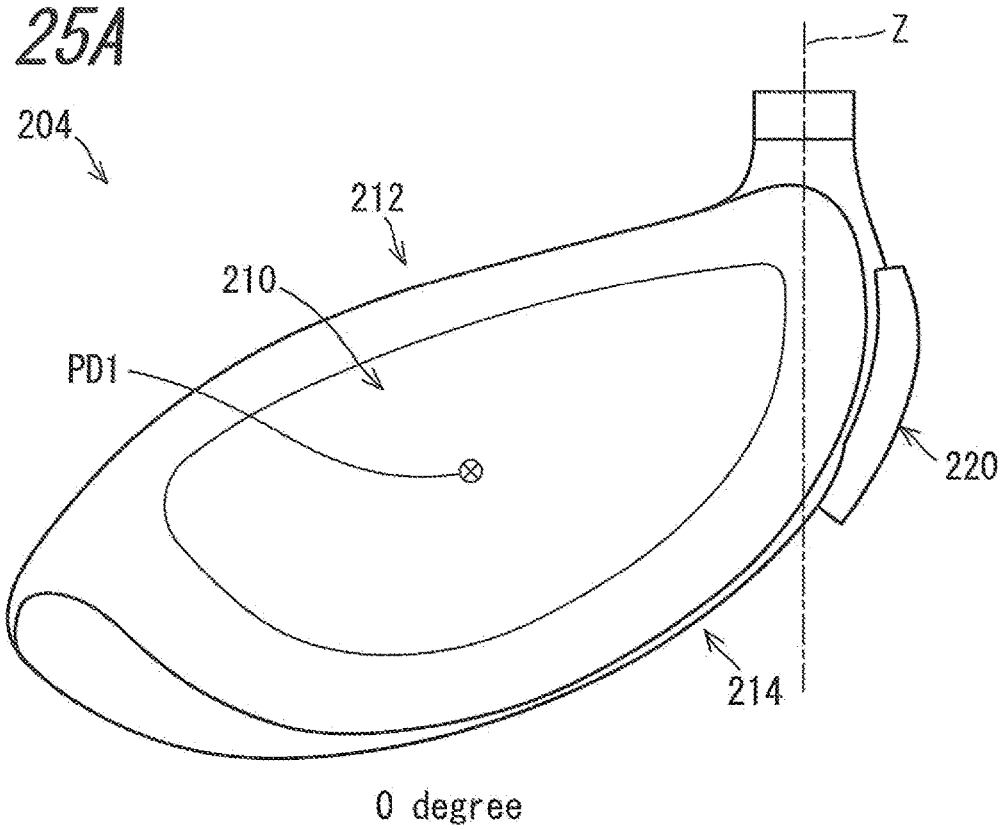
FIG. 25A is a projection figure of the head (of the third embodiment) in the 0-degree state.
Figure 26A:
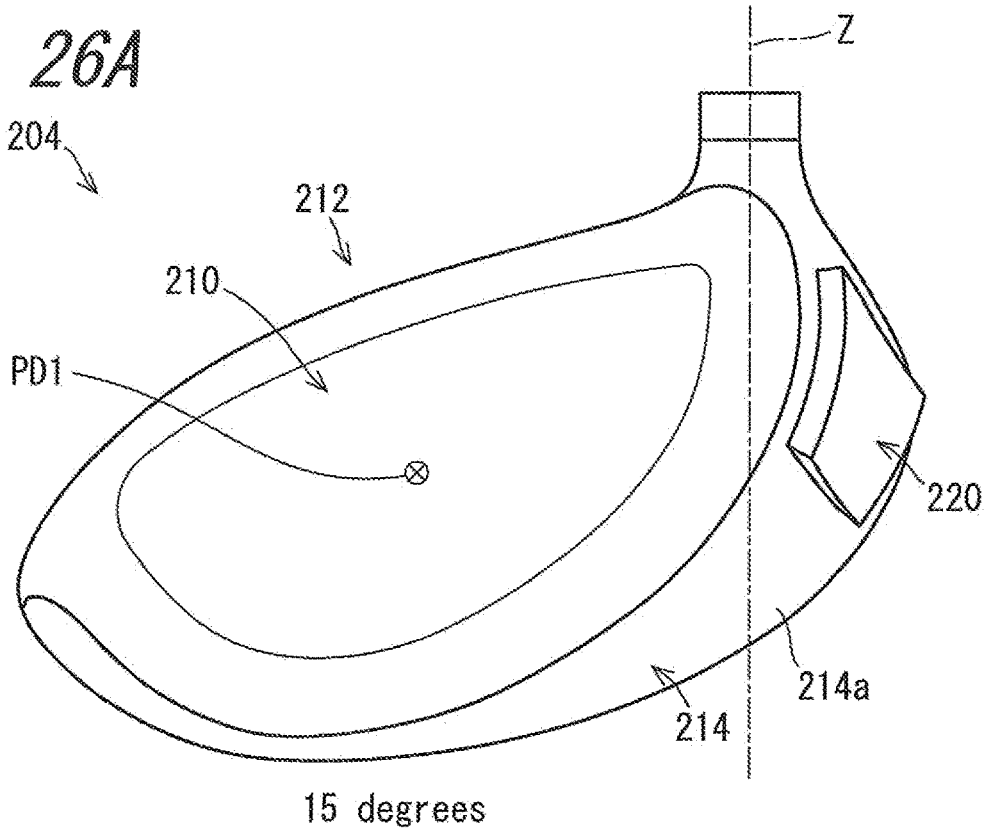
FIG. 26A is a projection figure of the head (of the third embodiment) in the 15-degree state.
Figure 27A:
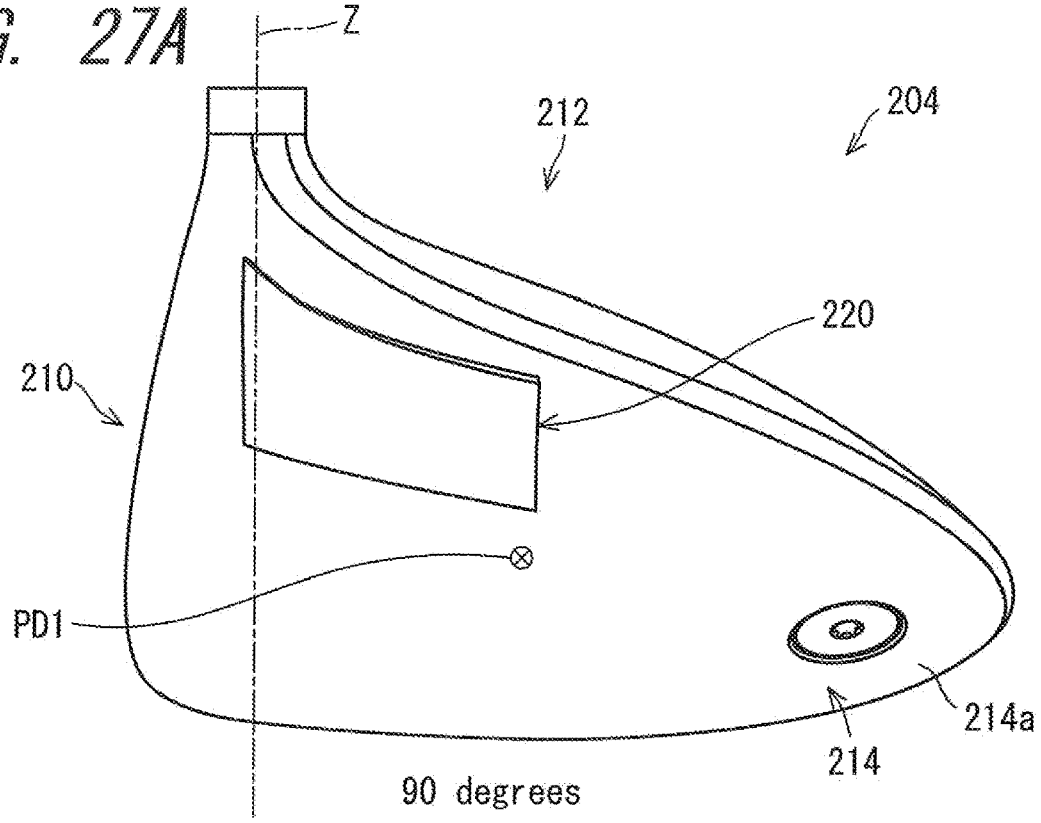
FIG. 27A is a projection figure of the head (of the third embodiment) in the 90-degree state.

FIG. 23 is a plan view of a head 204 according to a third embodiment. FIG. 24 is a perspective view of the head 204, with its sole 214 faced upward, as viewed from the heel back side. FIG. 25A shows the head 204 in the 0-degree state. FIG. 26A shows the head 204 in the 15-degree state. FIG. 27A shows the head 204 in the 90-degree state. In FIG. 25A, FIG. 26A, and FIG. 27A, the projection direction PD1 is a direction perpendicular to the drawing sheets of these figures.

Figure 25B:
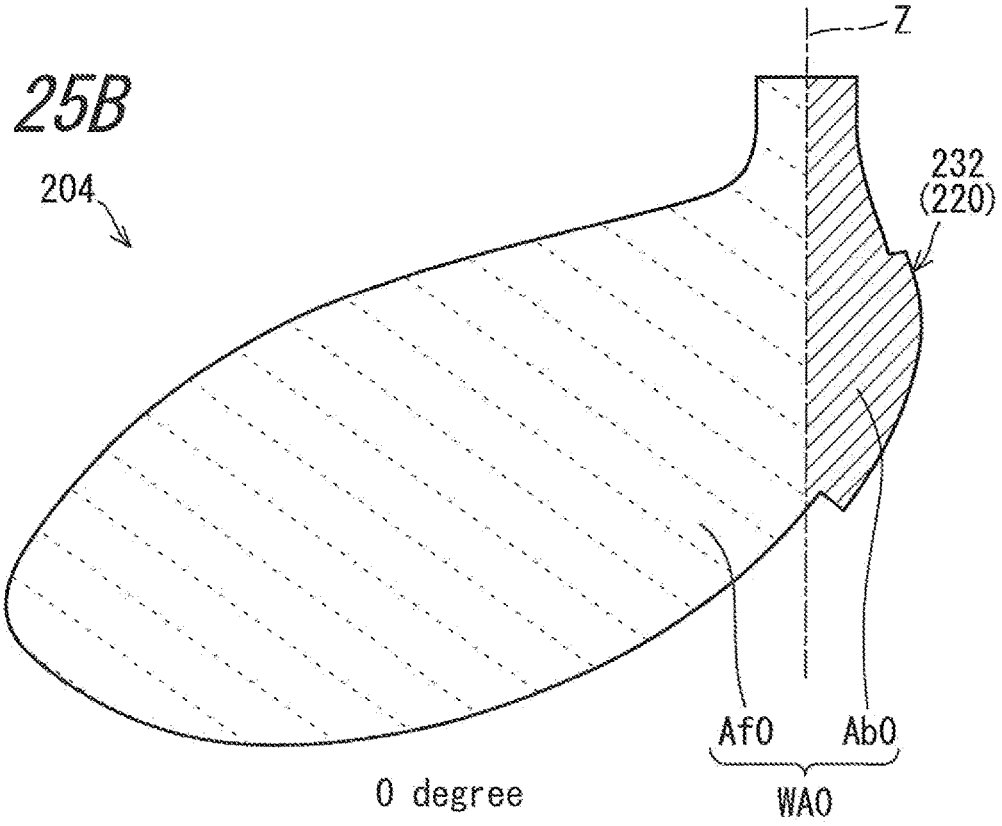
FIG. 25B shows a projected area of the head in the 0-degree state, the projected area being divided by the shaft axis line into a first region and a second region.
Figure 26B:
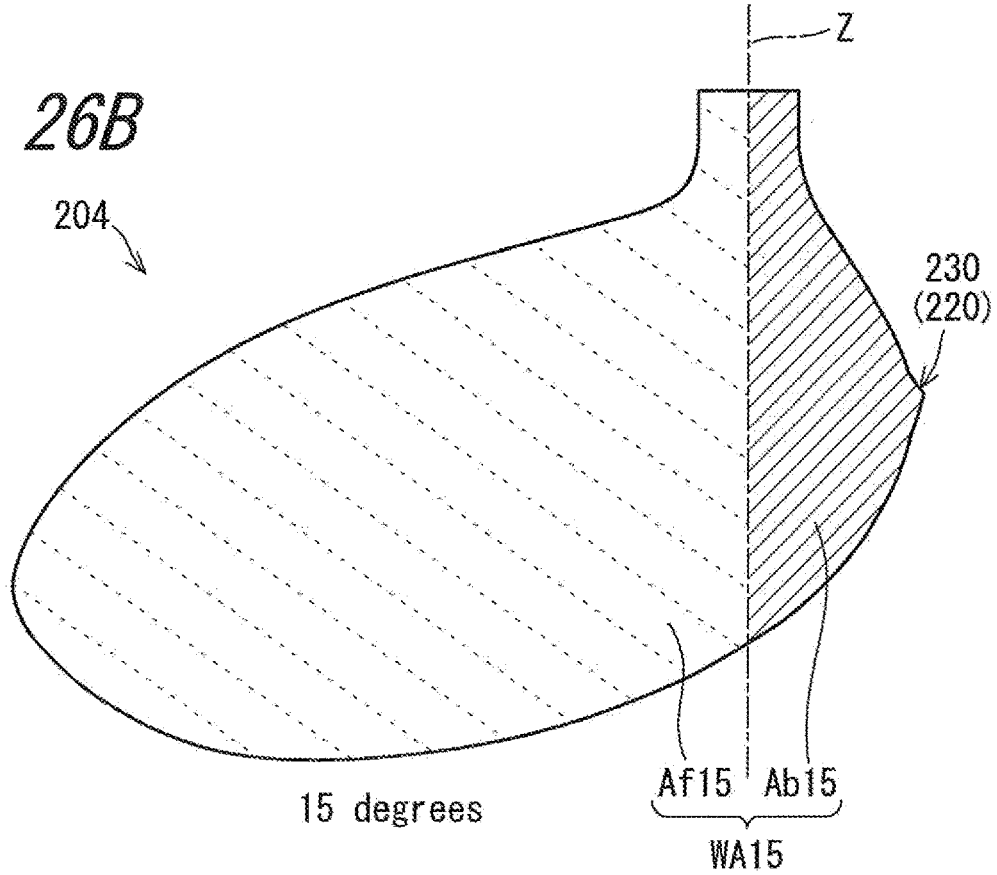
FIG. 26B shows a projected area of the head in the 15-degree state, the projected area being divided by the shaft axis line into a first region and a second region.
Figure 27B:
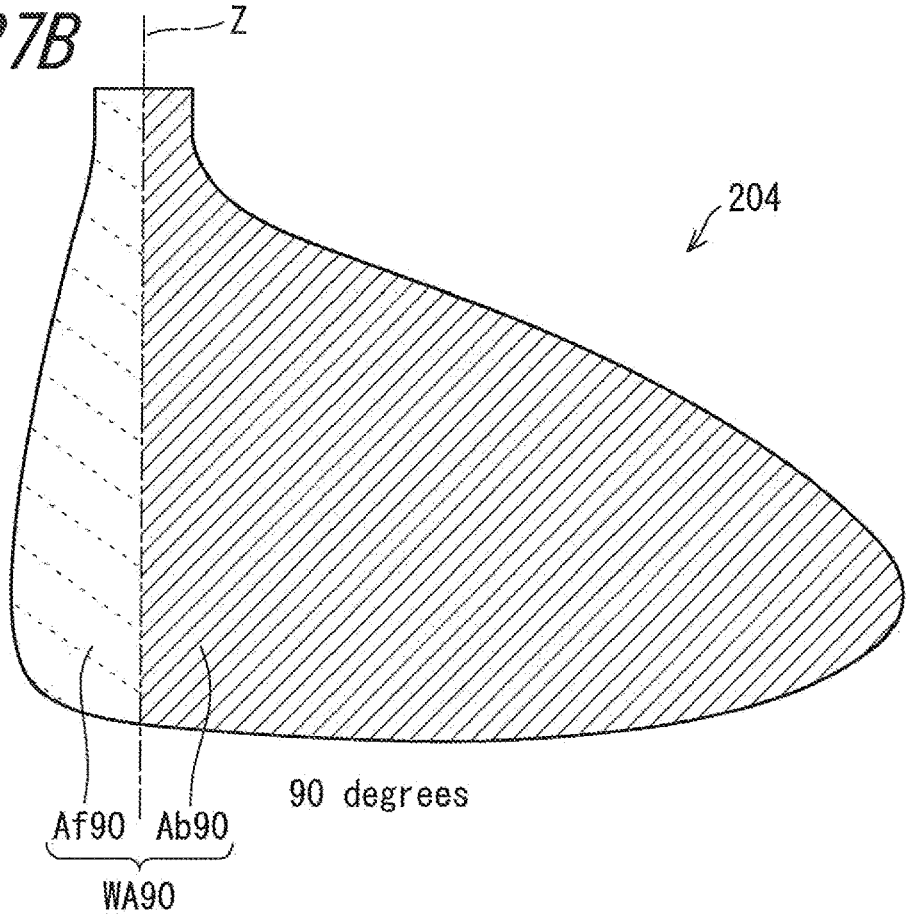
FIG. 27B shows a projected area of the head in the 90-degree state, the projected area being divided by the shaft axis line into a first region and a second region.

FIG. 25B is a projection figure of the head 204 in the 0-degree state divided by the shaft axis line Z into two regions. FIG. 26B is a projection figure of the head 204 in the 15-degree state divided by the shaft axis line Z into two regions. FIG. 27B is a projection figure of the head 204 in the 90-degree state divided by the shaft axis line Z into two regions.

The head 204 includes a face portion 210, a crown portion 212, a sole portion 214, and a hosel portion 216. The face portion 210 includes a striking face 210*a*. The striking face 210*a* is the outer surface of the face portion 210. The crown portion 212 forms a crown outer surface 212*a*. The sole portion 214 forms a sole outer surface 214*a*. The hosel portion 216 has a shaft hole 216*a*.

The striking face 210*a* has a face center Fc as defined above. The striking face 210*a* has a normal line Lf. The normal line Lf is a line normal to the striking face 210*a* at the face center Fc.

The head 204 includes, on its outer surface, a protruding portion 220. In the present embodiment, the protruding portion 220 is formed on the sole portion 214. The sole portion 214 includes the protruding portion 220 on the sole outer surface 214*a*. Although not shown in the drawings, the protruding portion 220 is hollow. The protruding portion 220 forms a projection on the sole outer surface 214*a* and forms a recess on a sole inner surface. The protruding portion 220 may be solid (not hollow).

The protruding portion 220 is positioned on the heel side in the sole portion 214. The protruding portion 220 is positioned on the heel side with respect to the center of gravity of the head 204. The protruding portion 220 is positioned on the heel side with respect to the shaft axis line Z. The head 204 does not include a skirt portion (side portion). The sole outer surface 214*a* of the head 204 extends to an outer edge of the crown outer surface 212*a*. When the head includes a skirt portion between the crown portion 212 and the sole portion 214, the protruding portion 220 may be provided on the skirt portion.

In the 0-degree state shown in FIG. 25B, a portion indicated with broken line hatching has an area that is denoted by Af0, and a portion indicated with solid line hatching has an area that is denoted by Ab0. The sum of Af0 and Ab0 is WA0.

In the 15-degree state shown in FIG. 26B, a portion indicated with broken line hatching has an area that is denoted by Af15, and a portion indicated with solid line hatching has an area that is denoted by Ab15. The sum of Af15 and Ab15 is WA15.

In the 90-degree state shown in FIG. 27B, a portion indicated with broken line hatching has an area that is denoted by Af90, and a portion indicated with solid line hatching has an area that is denoted by Ab90. The sum of Af90 and Ab90 is WA90.

As shown in FIG. 27A, the protruding portion 220 is viewable in the projection figure of the head 204 in the 90-degree state. As shown in FIG. 27B, however, the protruding portion 220 does not constitute any part of the outer contour line in the projection figure of the 90-degree state. The protruding portion 220 does not affect Ab90. The protruding portion 220 does not increase Ab90. The protruding portion 220 does not affect Af90. The protruding portion 220 does not increase Af90. As shown in FIG. 25A, the protruding portion 220 is viewable in the projection figure of the head 204 in the 0-degree state. As shown in FIG. 25B, the protruding portion 220 constitutes a part of the outer contour line in the projection figure of the 0-degree state. The protruding portion 220 increases Ab0. On the other hand, the protruding portion 220 does not increase Af0. As shown in FIG. 26A, the protruding portion 220 is viewable in the projection figure of the head 204 in the 15-degree state. As shown in FIG. 26B, the protruding portion 220 constitutes a part of the outer contour line in the projection figure of the 15-degree state. The protruding portion 220 increases Ab15. On the other hand, the protruding portion 220 does not affect Af15. The protruding portion 220 does not increase Af15. The protruding portion 220 contributes to decreasing S15 without increasing S90. The protruding portion 220 contributes to decreasing the ratio (WA15/Ab15) without increasing the ratio (WA90/Ab90). The protruding portion 220 contributes to increasing the ratio (|S90|/|S15|).

As shown in FIG. 26B, in the projection figure of the 15-degree state, the contour line of the head 204 includes a silhouette protuberance 230. The silhouette protuberance 230 is formed by the protruding portion 220. Ab15 is enlarged by the presence of the silhouette protuberance 230. In the projection figure of the head 204 in the 15-degree state, Ab15 includes an additional area added by the presence of the protruding portion 220.

As shown in FIG. 25B, in the projection figure of the 0-degree state, the contour line of the head 204 includes a silhouette protuberance 232. The silhouette protuberance 232 is formed by the protruding portion 220. Ab0 is enlarged by the presence of the silhouette protuberance 232. In the projection figure of the 0-degree state, Ab0 includes an additional area added by the presence of the protruding portion 220. The additional area in the 0-degree state is greater than that in the 15-degree state.

In the 90-degree state, the protruding portion 220 does not form an additional area in the second region, and does not form an additional area in the first region (see FIG. 27A and FIG. 27B). In the 15-degree state, the protruding portion 220 does not form an additional area in the first region, and forms the additional area in the second region (see FIG. 26A and FIG. 26B). In the 0-degree state, the protruding portion 220 does not form an additional area in the first region, and forms the additional area in the second region (see FIG. 25A and FIG. 25B).

When the head 204 is positioned at the start of face rotation (90-degree state), Abθ is greater than Afθ. Accordingly, S90 is a negative value. As the face rotation progresses, the angle θ continuously decreases from 90° toward 0°. As the angle θ decreases, Afθ increases and Abθ decreases. Afθ is greater than Abθ when the head 204 is positioned immediately before impact. That is, S15 is a positive value.

While θ changes continuously from 90° to 0°, the difference (Afθ−Abθ) turns from a negative value to a positive value. Accordingly, the angle θ has a value at which Afθ is equal to Abθ, that is, at which the difference (Afθ−Abθ) is zero. In other words, the angle θ has a value at which Sθ is zero.

In a phase where Sθ is a negative value, the projected area Abθ of the second region is greater than the projected area Afθ of the first region. Since Abθ is relatively larger, the face rotation can be promoted. By prolonging the period while Sθ is a negative value during downswing, the period while the face rotation is assisted can be longer. From this viewpoint, the value of θ at which Sθ is zero is preferably less than or equal to 55°, more preferably less than or equal to 53°, still more preferably less than or equal to 52°, and further preferably less than or equal to 51°. With a view to not causing golfers to feel a sense of incongruity in the shape of the head, the value of θ at which Sθ is zero is preferably greater than or equal to 43°, more preferably greater than or equal to 45°, and still more preferably greater than or equal to 47°.

As described above, at the start of face rotation, Abθ is large, and the ratio (WAθ/Abθ) is smaller than 2.0. That is, WA90/Ab90 is smaller than 2.0. As the face rotation progresses and θ decreases, Abθ decreases and Afθ increases. While θ changes continuously from 90° to 0°, Afθ becomes equal to Abθ, and WAθ/Abθ becomes 2.0. WA15/Ab15 is greater than 2.0 immediately before impact. WA0/Ab0 is greater than 2.0 at impact.

When WAθ/Abθ is smaller than 2.0, Abθ is greater than Afθ. By shortening the period while WAθ/Abθ is smaller than 2.0, the period while the face rotation is assisted can be longer. From this viewpoint, the value of θ at which WAθ/Abθ is 2.0 is preferably less than or equal to 55°, more preferably less than or equal to 53°, still more preferably less than or equal to 52°, and further preferably less than or equal to 51°. With a view to not causing golfers to feel a sense of incongruity in the shape of the head, the value of θ at which WAθ/Abθ is 2.0 is preferably greater than or equal to 43°, more preferably greater than or equal to 45°, and still more preferably greater than or equal to 47°.

(S15−S0)/15 represents the rate of change of Sθ with respect to θ immediately before impact (a phase where θ ranges from 0° to 15°). As the head moves from the 15-degree state (immediately before impact) toward the 0-degree state (at impact), Afθ increases, and Sθ increases. Accordingly, (S15−S0)/15 has a negative value. Immediately before impact, the head speed is being accelerated, and the influence of the air resistance acting on the head is increasing. By decreasing an absolute value of the rate of change, in the phase where θ ranges from 0° to 15°, Afθ is suppressed, and the face is easily turned. From this viewpoint, (S15−S0)/15 is preferably greater than −45, more preferably greater than −35, and still more preferably greater than −30. When the face is turned too much, a sharp hook shot can be caused (this is called "Chipin" in Japanese, or "duck hook" in English). With a view to preventing such a hook shot, (S15−S0)/15 is preferably less than or equal to −10, more preferably less than or equal to −15, and still more preferably less than or equal to −20.

(S30−S15)/15 represents the rate of change of Sθ with respect to θ before impact (a phase where θ ranges from 15° to 30°). As the head moves from the 30-degree state (before impact) toward the 15-degree state (immediately before impact), Afθ increases, and Sθ increases. Accordingly, as with (S15−S0)/15, (S30−S15)/15 has a negative value. The absolute value of the rate of change in the range of θ from 0° to 15° is made smaller than the absolute value of the rate of change in the range of θ from 15° to 30°, whereby Afθ is suppressed in the phase where θ ranges from 0° to 15° and the face is easily turned. From this viewpoint, (S30−S15)/15 is preferably smaller than (S15−S0)/15. That is, the following relational expression is preferably established:

$$SL_{0\text{-}15} > SL_{15\text{-}30},$$

where "$SL_{0\text{-}15}$" means [(S15−S0)/15] and "$SL_{15\text{-}30}$" means [(S30−S15)/15]. As described above, both of $SL_{0\text{-}15}$ and $SL_{15\text{-}30}$ have negative values, and accordingly, in comparison of their absolute values, the magnitude relationship is reversed.

A double-pointed arrow H1 in FIG. 2 shows a head length in the toe-heel direction. In a head that is in the reference state, a plane XP that is parallel to the ground plane GP and is positioned 0.875 inches above the ground plane GP is determined. Among points on an intersection line between this plane XP and the outer surface of the head, a point that is located at a heel-most position is defined as a heel reference point Ph. This heel reference point Ph is defined as a heel-side starting point of the head length H1. A double-pointed arrow W1 in FIG. 18 shows a head width in the face-back direction.

A large head has a large moment of inertia and a large sweet area, but air resistance acting thereon is large. In the present disclosure, this air resistance is utilized to increase a force acting in such a direction that the striking face is closed, thereby improving the ball catchability. From this viewpoint, a head having large dimensions is preferred.

With a view to improving the ball catchability by utilizing air resistance, and from the viewpoint of moment of inertia, the head width W1 in the face-back direction is preferably greater than or equal to 100 mm, more preferably greater than or equal to 101 mm, and still more preferably greater than or equal to 102 mm. From the viewpoint of the rules of golf regulating a head volume, the head width W1 is preferably less than or equal to 127 mm, more preferably less than or equal to 126 mm, and still more preferably less than or equal to 125 mm.

With a view to improving the ball catchability by utilizing air resistance, and from the viewpoint of moment of inertia, the head length H1 in the toe-heel direction is preferably greater than or equal to 110 mm, more preferably greater than or equal to 111 mm, and still more preferably greater than or equal to 112 mm. From the viewpoint of rules of golf regulating a head volume, the head length H1 is preferably less than or equal to 129 mm, more preferably less than or equal to 128 mm, and still more preferably less than or equal to 127 mm.

With a view to improving the ball catchability by utilizing air resistance, and from the viewpoint of moment of inertia, the head volume is preferably greater than or equal to 400 $cm^3$, more preferably greater than or equal to 410 $cm^3$, still more preferably greater than or equal to 420 $cm^3$, further more preferably greater than or equal to 430 $cm^3$, even more preferably greater than or equal to 440 $cm^3$, and still even more preferably greater than or equal to 450 $cm^3$. From the viewpoint of the rules of golf, the head volume is preferably less than or equal to 470 $cm^3$, more preferably less than or equal to 465 $cm^3$, and still more preferably less than or equal to 460 $cm^3$.

A double-pointed arrow FP in FIG. 18 shows face progression. The face progression FP is a length from the shaft axis line Z to the frontmost point (face-most point) of the head. The face progression FP is measured in the face-back direction.

An excessively small face progression FP causes golfers to feel a sense of incongruity in the shape of the head. From this viewpoint, the face progression FP is preferably greater than or equal to 13 mm, more preferably greater than or equal to 14 mm, and still more preferably greater than or equal to 15 mm. An excessively large face progression FP also causes golfers to feel a sense of incongruity in the shape of the head. From this viewpoint, the face progression FP is preferably less than or equal to 23 mm, more preferably less than or equal to 22 mm, and still more preferably less than or equal to 21 mm.

Figure 28:
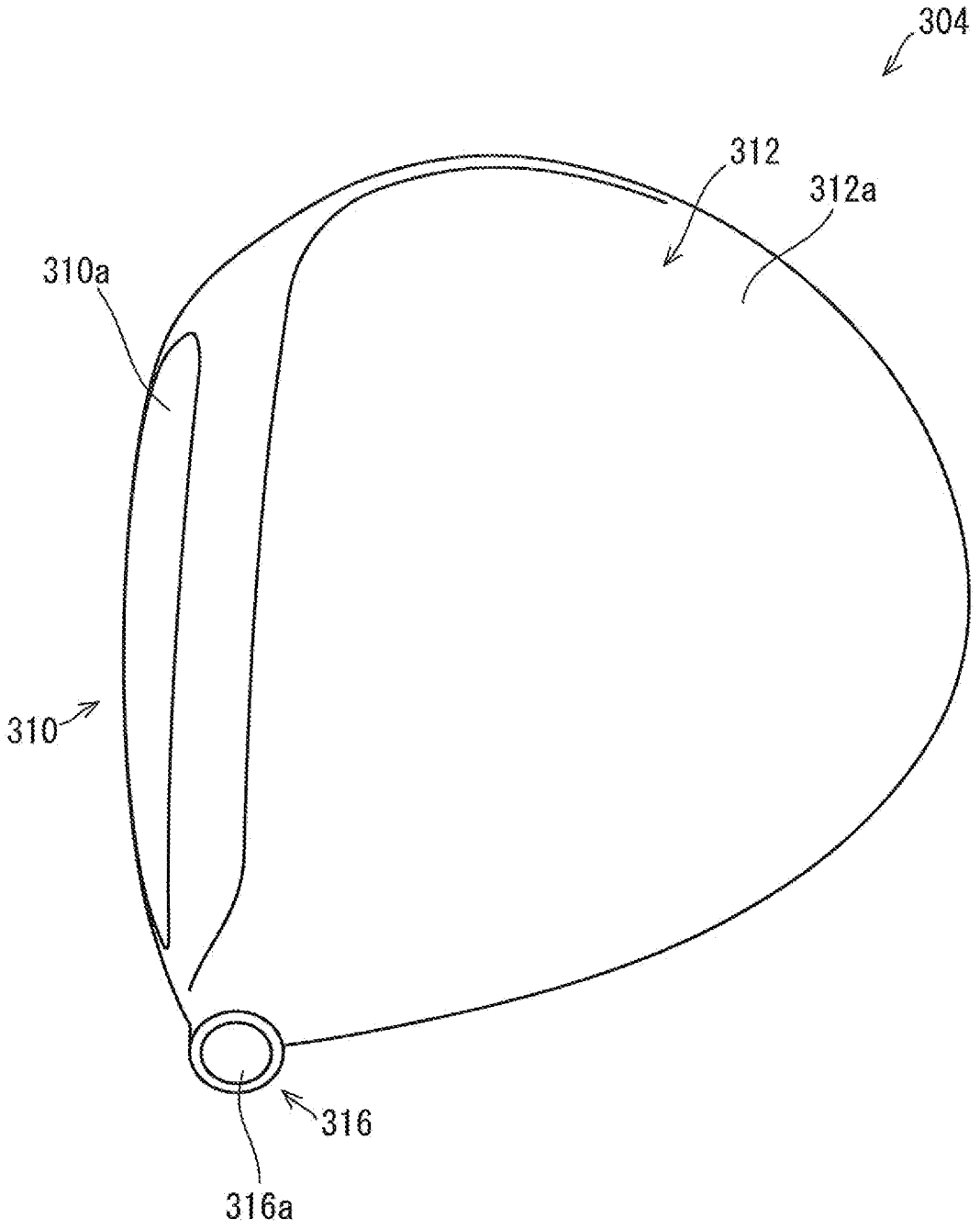
FIG. 28 is a plan view of a head of Reference Example as viewed from the crown side.
Figure 29:
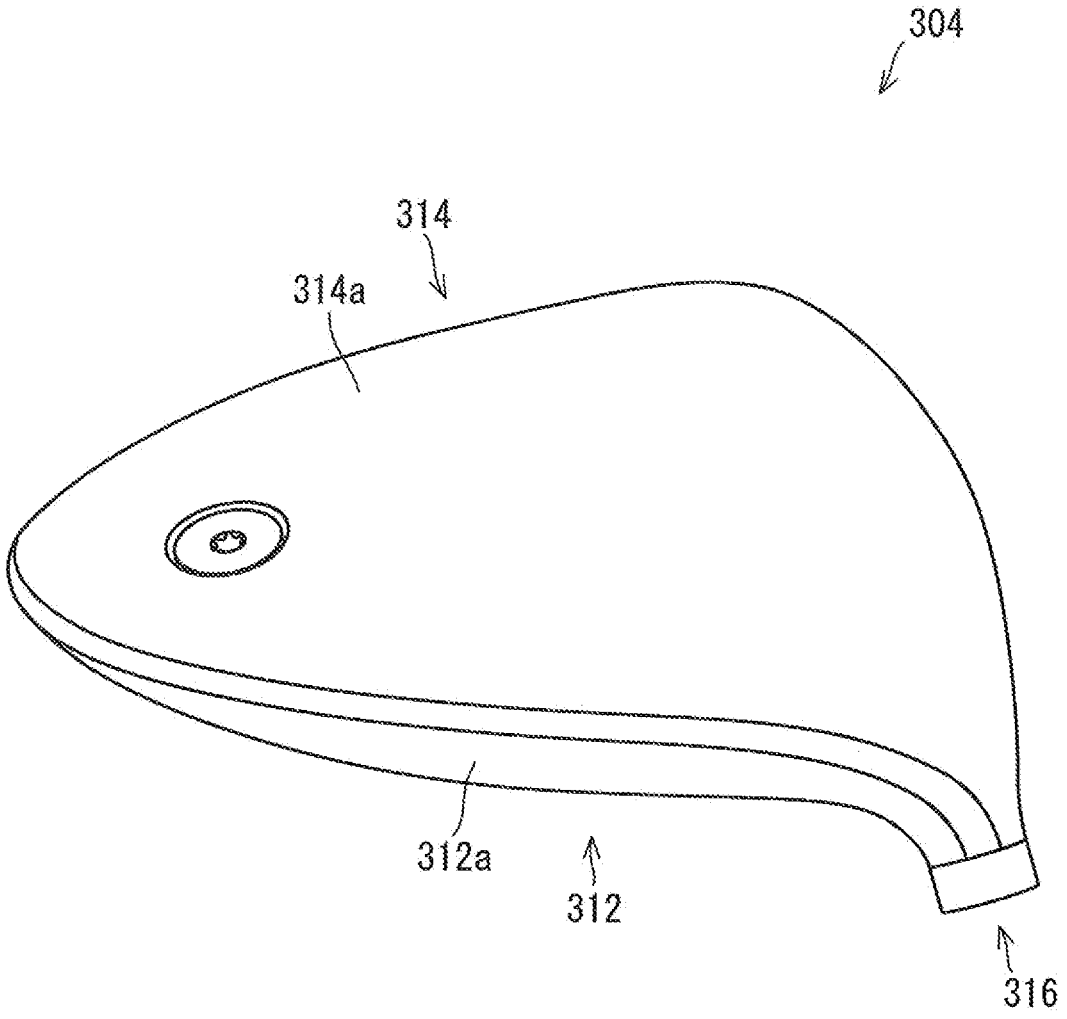
FIG. 29 is a perspective view of the head of Reference Example, with its sole faced upward, as viewed from the heel back side.
Figure 30A:
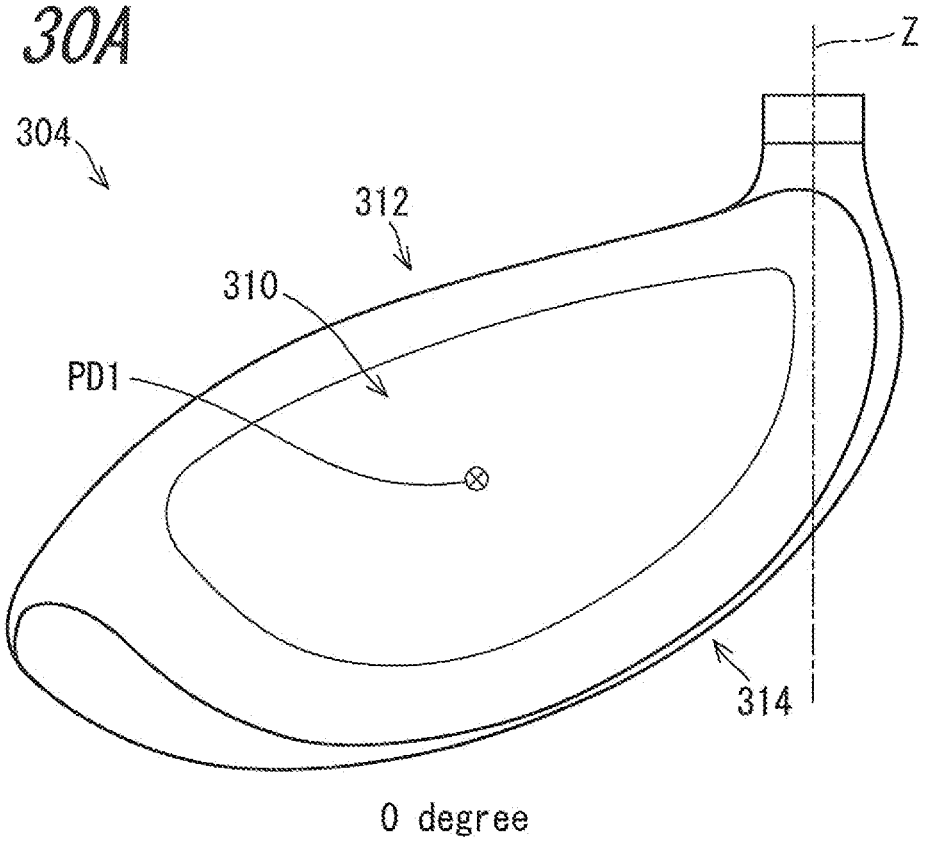
FIG. 30A is a projection figure of the head (of Reference Example) in the 0-degree state.
Figure 31A:
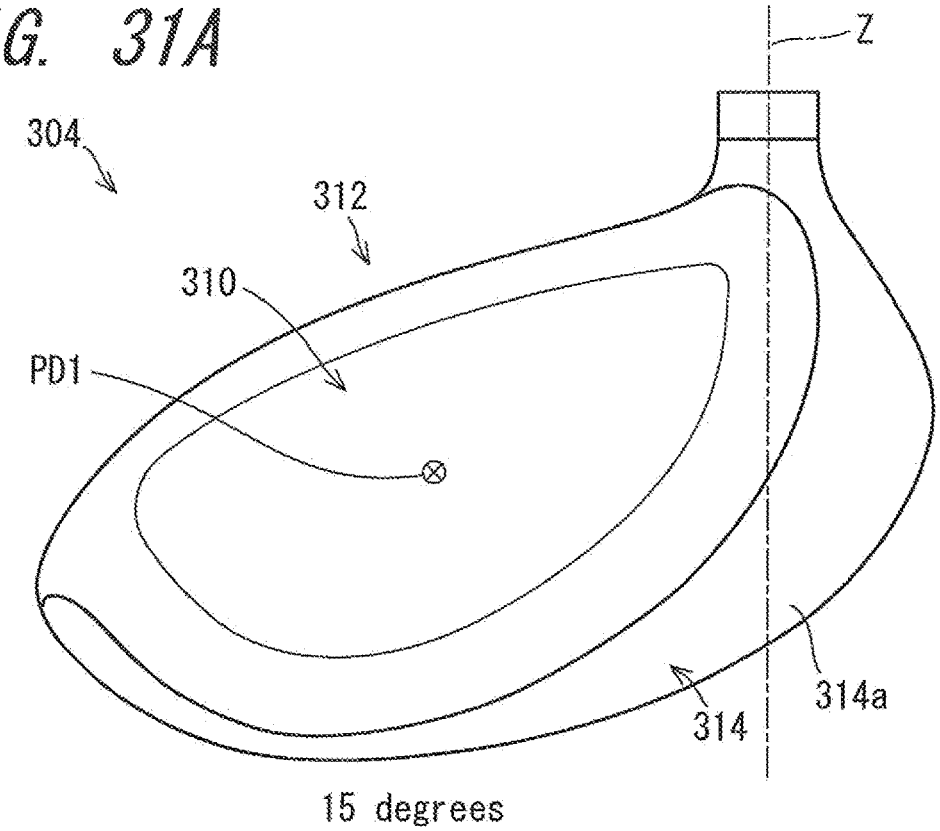
FIG. 31A is a projection figure of the head (of Reference Example) in the 15-degree state.
Figure 32A:
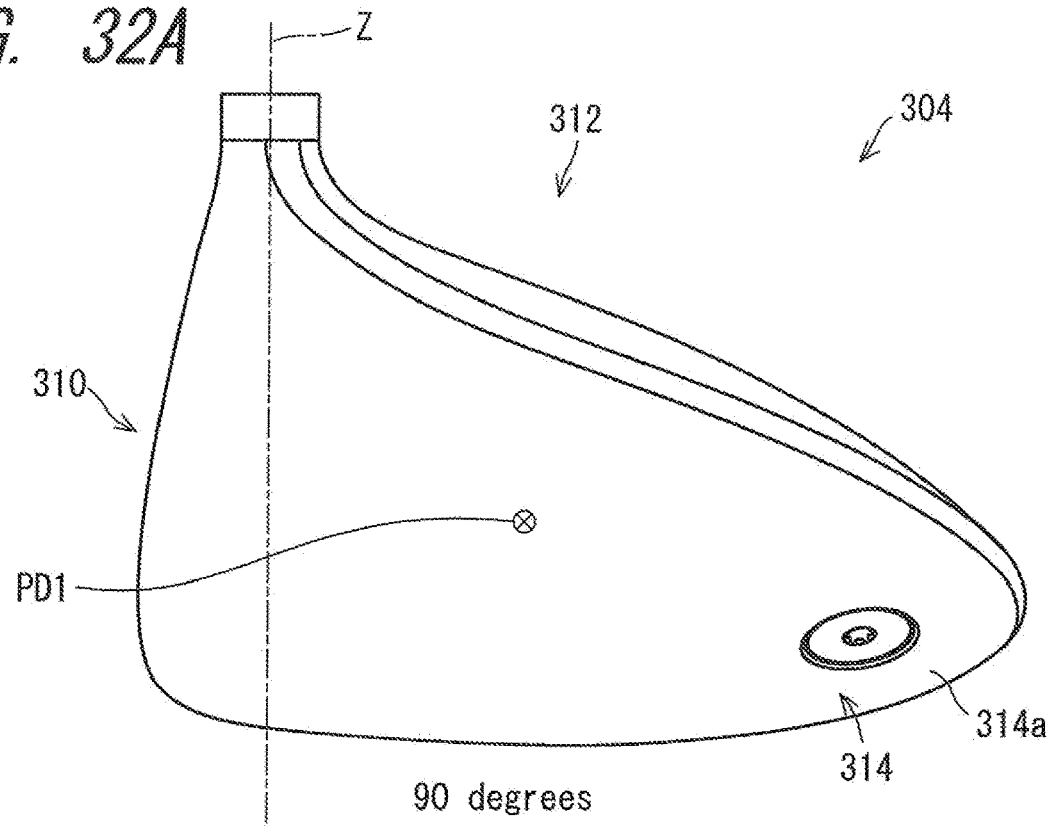
FIG. 32A is a projection figure of the head (of Reference Example) in the 90-degree state.

FIG. 28 is a plan view of a head 304 according to Reference Example. FIG. 29 is a perspective view of the head 304, with its sole 314 faced upward, as viewed from the heel back side. FIG. 30A shows the head 304 in the 0-degree state. FIG. 31A shows the head 304 in the 15-degree state. FIG. 32A shows the head 304 in the 90-degree state. In FIG. 30A, FIG. 31A, and FIG. 32A, the projection direction PD1 is a direction perpendicular to the drawing sheets of these figures.

Figure 30B:
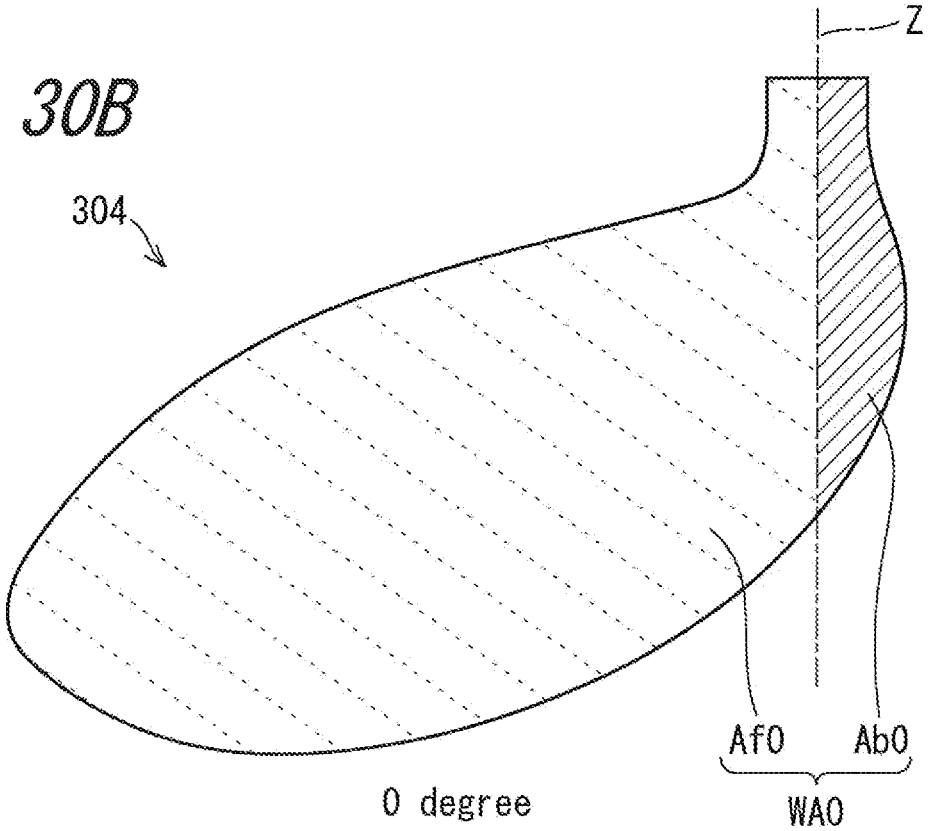
FIG. 30B shows a projected area of the head in the 0-degree state, the projected area being divided by the shaft axis line into a first region and a second region.
Figure 31B:
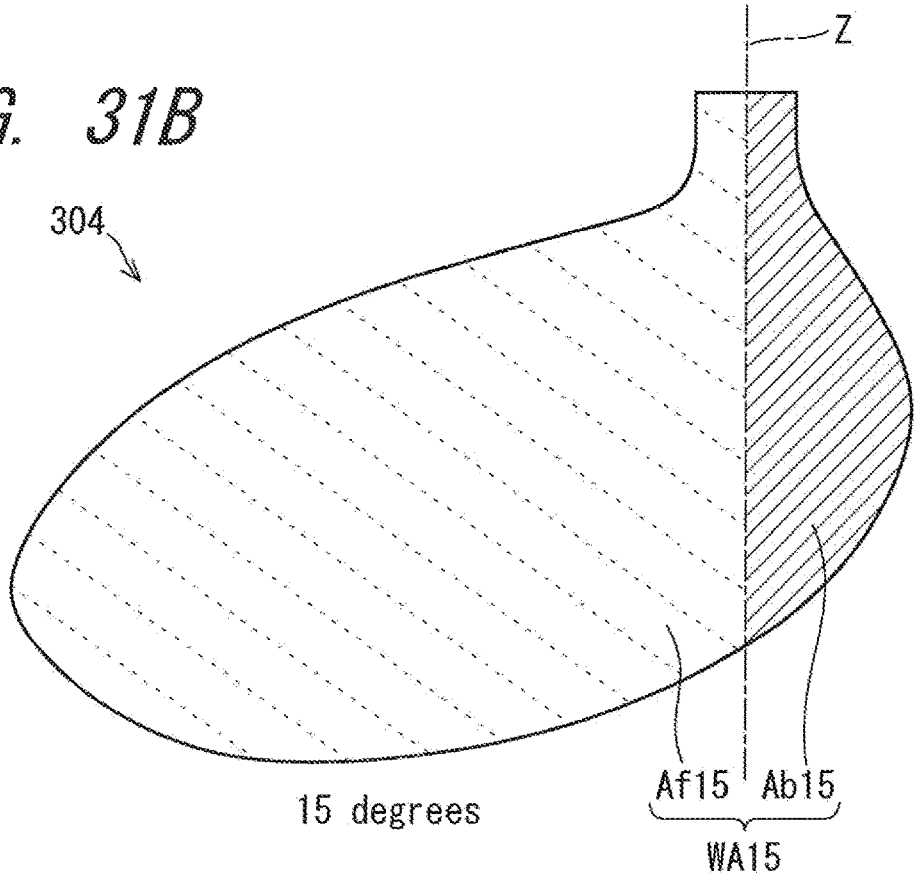
FIG. 31B shows a projected area of the head in the 15-degree state, the projected area being divided by the shaft axis line into a first region and a second region.
Figure 32B:
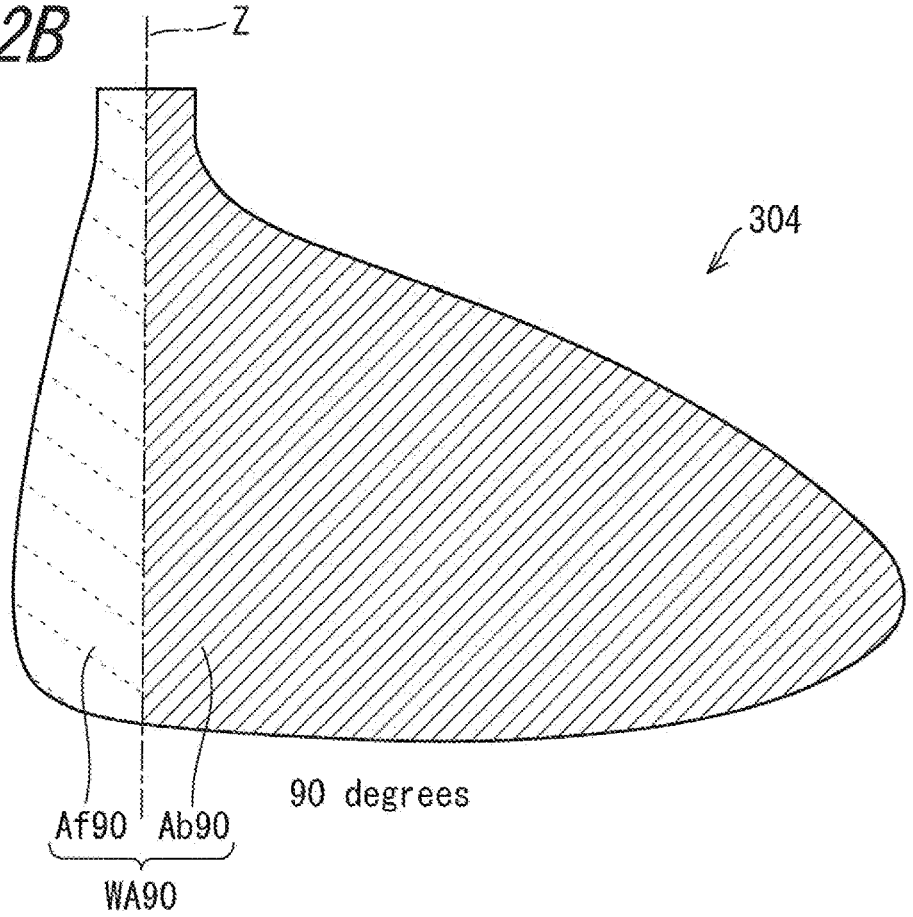
FIG. 32B shows a projected area of the head in the 90-degree state, the projected area being divided by the shaft axis line into a first region and a second region.

FIG. 30B is a projection figure of the head 304 in the 0-degree state divided by the shaft axis line Z into two regions. FIG. 31B is a projection figure of the head 304 in the 15-degree state divided by the shaft axis line Z into two regions. FIG. 32B is a projection figure of the head 304 in the 90-degree state divided by the shaft axis line Z into two regions.

The head 304 includes a face portion 310, a crown portion 312, a sole portion 314, and a hosel portion 316. The face portion 310 includes a striking face 310*a*. The striking face 310*a* is the outer surface of the face portion 310. The crown portion 312 forms a crown outer surface 312*a*. The sole portion 314 forms a sole outer surface 314*a*. The hosel portion 316 has a shaft hole 316*a*.

The head 304 includes no protruding portion on its outer surface. There is no additional area added by the presence of a protruding portion in any projection figure of the head 304. Ab90 (FIG. 32B) includes no additional area added by the presence of a protruding portion. Ab15 (FIG. 31B) includes no additional area added by the presence of a protruding portion. Ab0 (FIG. 30B) includes no additional area added by the presence of a protruding portion.

When the head 304 is made shallower, Af15 and Af0 decrease, and Ab90 also decreases. At an initial stage of face rotation, accordingly, a force acting in such a direction that the face 10*a* is closed can decrease. A shallow head means a head having a small dimension in the up-down direction.

When the head 304 is made deeper, Ab90 increases, and Af15 and Af0 also decrease. A force acting in such a direction that the face 10*a* is opened, accordingly, can increase at and/or near impact. In addition, air resistance acting on the entirety of the head 304 increase at and/or near impact, whereby the head speed can decrease. A deep head means a head having a large dimension in the up-down direction.

EXAMPLES

Hereinafter, advantageous effects of the present disclosure are clarified by examples, but the present disclosure should not be exclusively interpreted based on the descriptions of the examples.

Examples 1 to 3

A head having the same shape as that of the head 4 of the first embodiment was produced as Example 1. A head having the same shape as that of the head 104 of the second embodiment was produced as Example 2. A head having the same shape as that of the head 204 of the third embodiment was produced as Example 3.

Comparative Examples 1 to 5

As Comparative Example 1, a driver head sold as "XXIO 10 PRIME" manufactured by Sumitomo Rubber Industries, Ltd. was used. As Comparative Example 2, a driver head (loft angle: 10.5°) sold as "SRIXON Z725" manufactured by Sumitomo Rubber Industries, Ltd. was used. As Comparative Example 3, a driver head (loft angle: 10.5°) sold as "SRIXON ZR-30" manufactured by Sumitomo Rubber Industries, Ltd. was used. As Comparative Example 4, a driver head (loft angle: 10.5°) sold as "SRIXON ZR-700" manufactured by Sumitomo Rubber Industries, Ltd. was used. As Comparative Example 5, a driver head (loft angle: 10.5°) sold as "XXIO 11" manufactured by Sumitomo Rubber Industries, Ltd. was used. As with the above-described Reference Example, each of Comparative Examples 1 to 5 does not include any protruding portion in the crown portion or the sole portion.

Comparative Example 6

Figure 33:
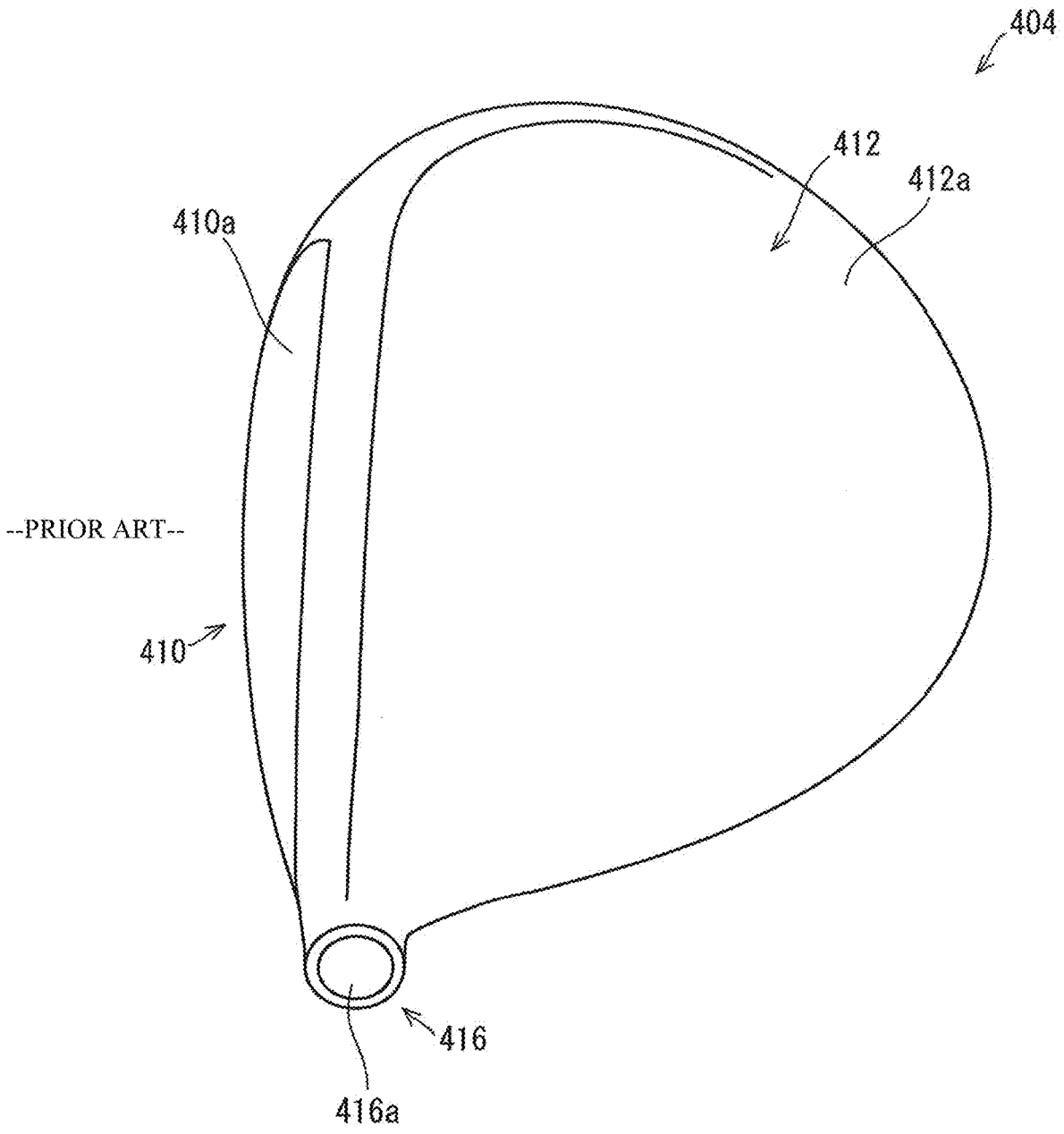
FIG. 33 is a plan view of a head of Comparative Example 6 as viewed from the crown side.
Figure 34A:
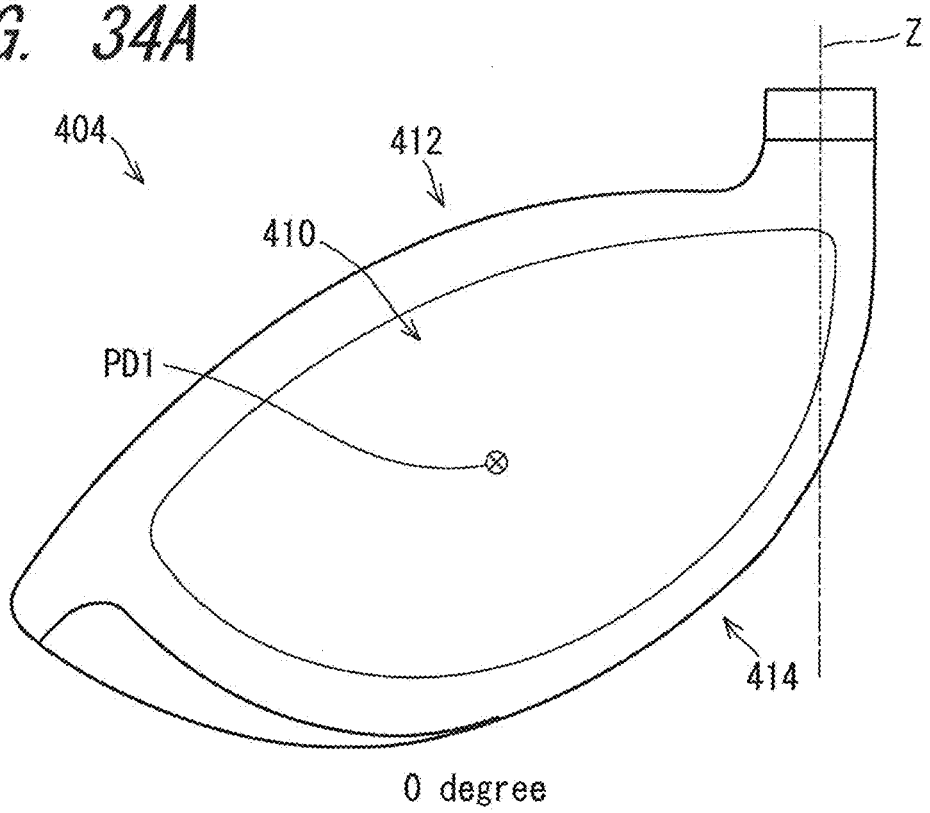
FIG. 34A is a projection figure of the head (of Comparative Example 6) in the 0-degree state.
Figure 34B:
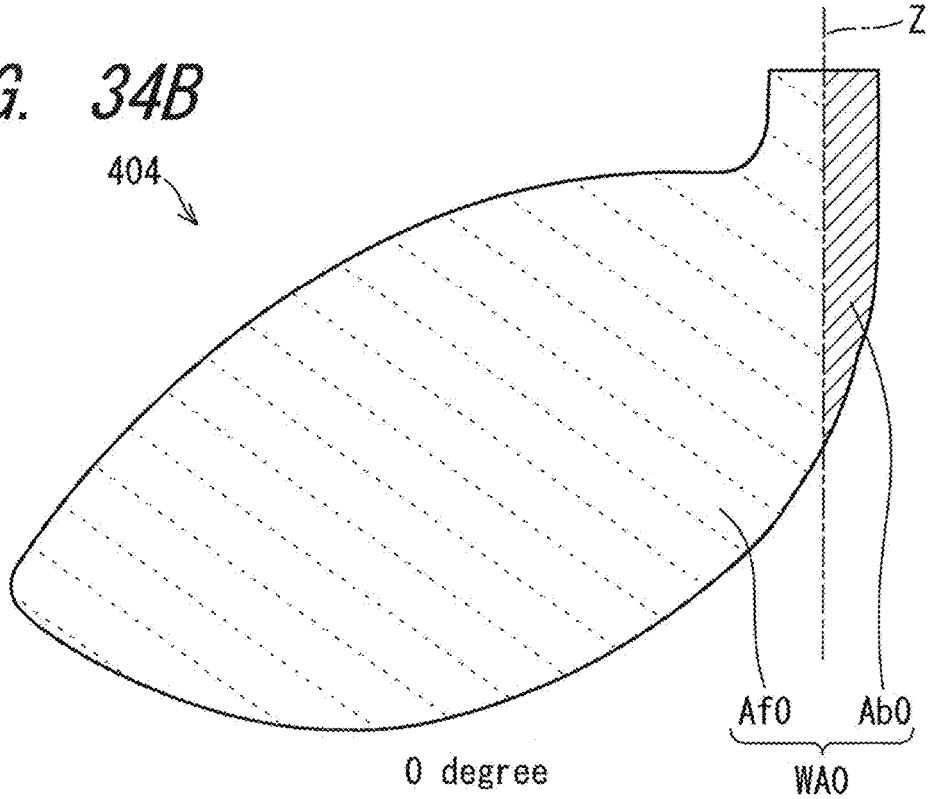
FIG. 34B shows a projected area of the head in the 0-degree state, the projected area being divided by the shaft axis line into a first region and a second region.
Figure 35A:
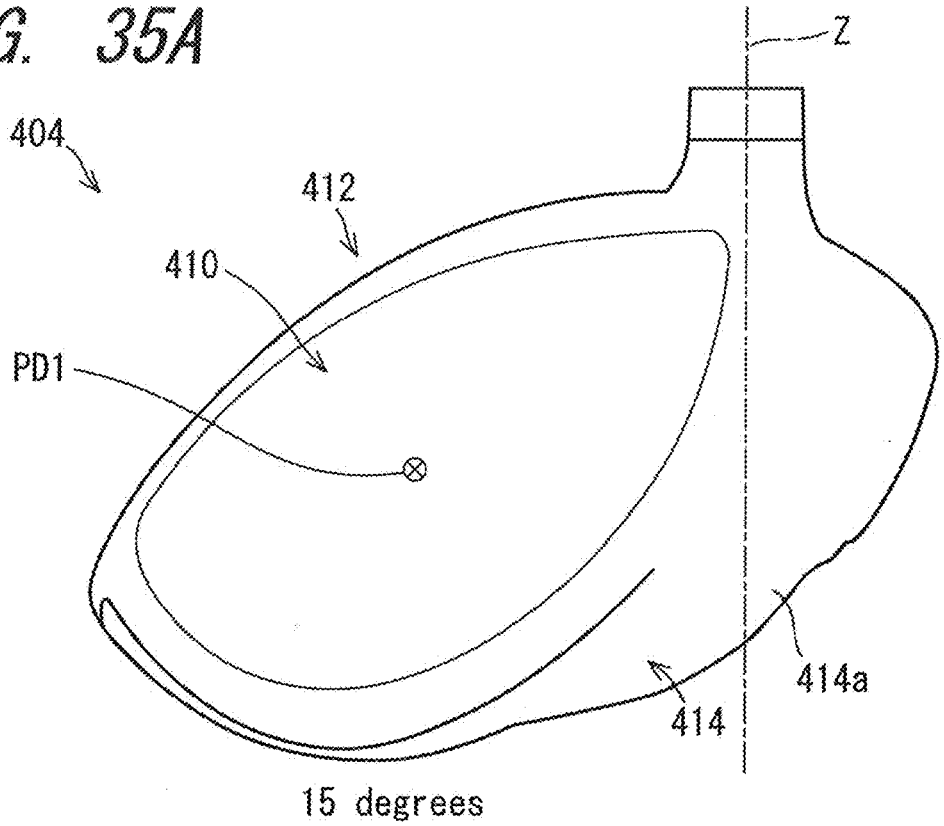
FIG. 35A is a projection figure of the head (of Comparative Example 6) in the 15-degree state.
Figure 35B:
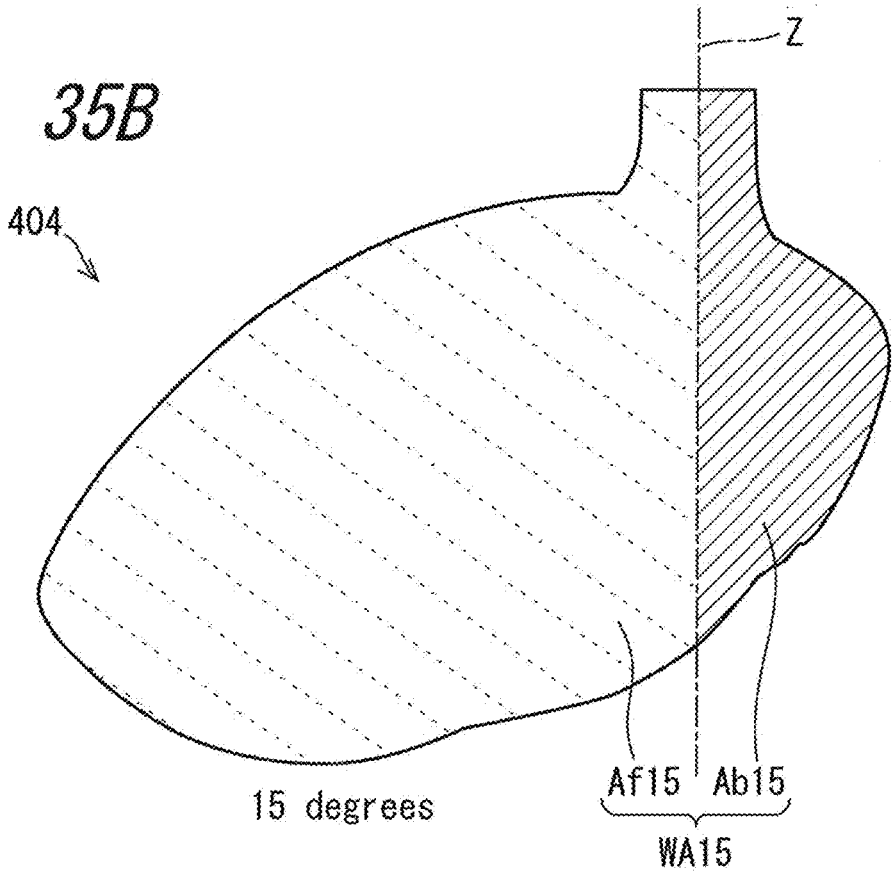
FIG. 35B shows a projected area of the head in the 15-degree state, the projected area being divided by the shaft axis line into a first region and a second region.
Figure 36A:
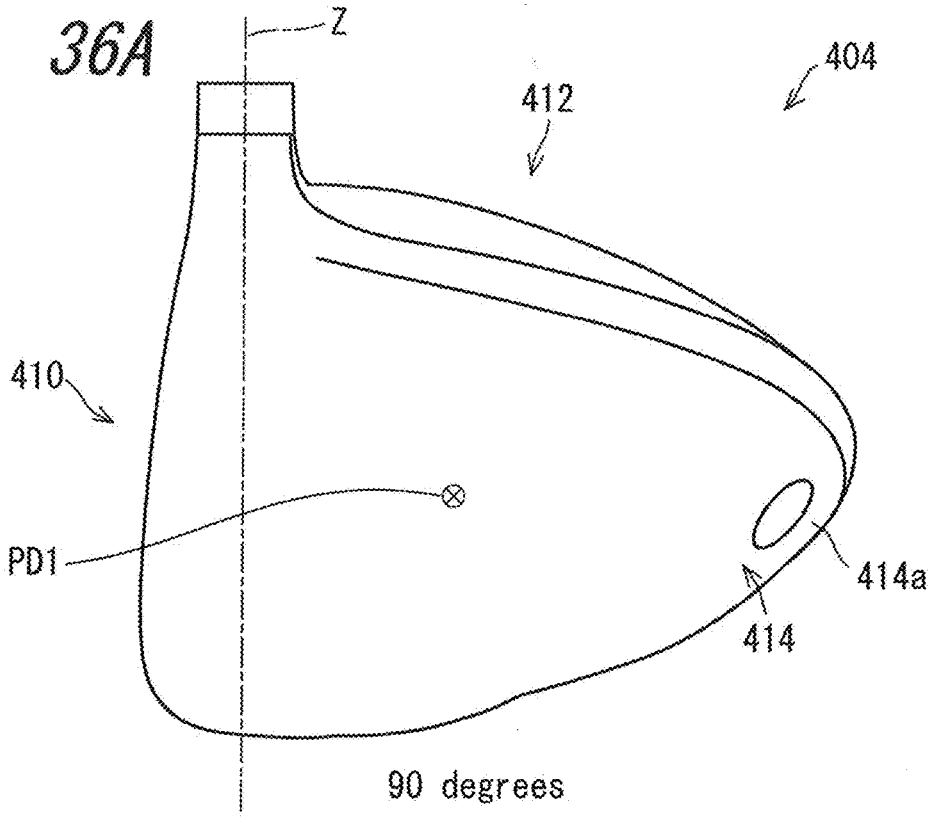
FIG. 36A is a projection figure of the head (of Comparative Example 6) in the 90-degree state.

FIG. 33 is a plan view of a head 404 of Comparative Example 6 as viewed from the crown side. FIG. 34A is a projection figure of the head 404 in the 0-degree state. FIG. 34B shows a projected area of the head 404 in the 0-degree state divided by the shaft axis line into a first region and a second region. FIG. 35A is a projection figure of the head 404 in the 15-degree state. FIG. 35B shows a projected area of the head 404 in the 15-degree state divided by the shaft axis line into a first region and a second region. FIG. 36A is a projection figure of the head 404 in the 90-degree state.

Figure 36B:
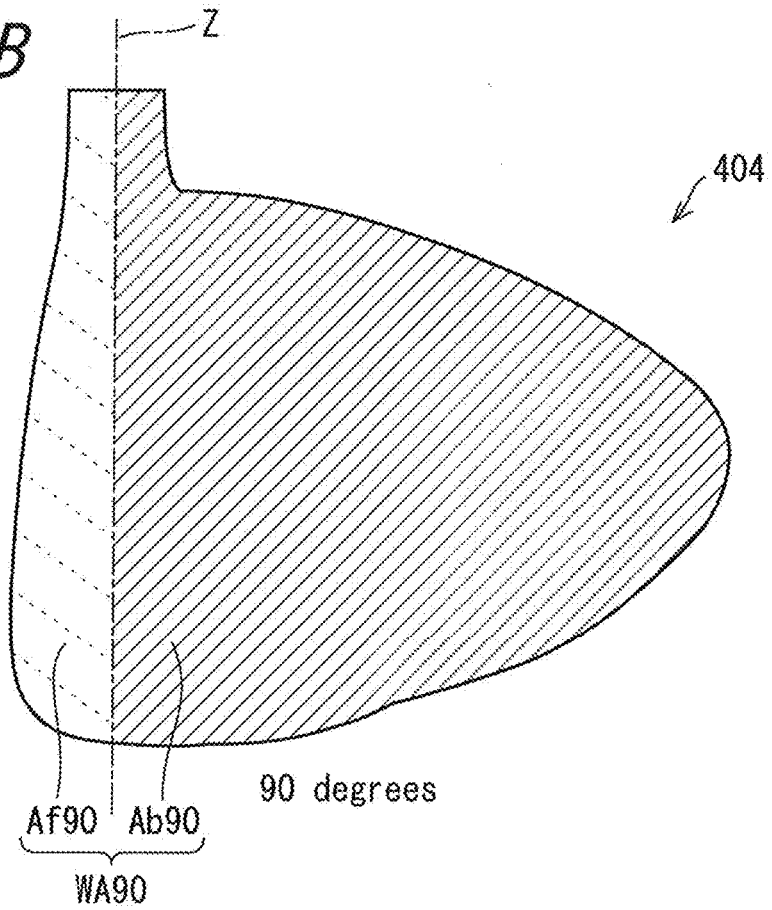
FIG. 36B shows a projected area of the head in the 90-degree state, the projected area being divided by the shaft axis line into a first region and a second region.

FIG. 36B shows a projected area of the head 404 in the 90-degree state divided by the shaft axis line into a first region and a second region. The head 404 includes a face portion 410, a crown portion 412, a sole portion 414, and a hosel portion 416. The face portion 410 includes a striking face 410*a*. The crown portion 412 forms a crown outer surface 412*a*. The sole portion 414 forms a sole outer surface 414*a*. The hosel portion 416 has a shaft hole 416*a*. The head 404 includes a protruding portion at a substantially center position of the sole outer surface 414*a*. Golf clubs each having the head of Comparative Example 6 are now widely available on the market.

Respective specifications and evaluation results of Examples are shown in Table 1 below. Respective specifications and evaluation results of Comparative Examples are shown in Table 2 below.

TABLE 1

Specifications and Evaluation Results of Examples

| | Unit | Ex. 1 | Ex. 2 | Ex. 3 |
|---|---|---|---|---|
| WA90 | $mm^2$ | 6881 | 6910 | 6768 |
| Af90 | $mm^2$ | 1160 | 1160 | 1160 |
| Ab90 | $mm^2$ | 5721 | 5750 | 5608 |
| S90 | $mm^2$ | −4561 | −4590 | −4448 |
| WA90/Ab90 | $mm^2$ | 1.203 | 1.202 | 1.207 |

TABLE 1-continued

Specifications and Evaluation Results of Examples

| | Unit | Ex. 1 | Ex. 2 | Ex. 3 |
|---|---|---|---|---|
| WA30 | $mm^2$ | 6960 | 7017 | 6960 |
| Af30 | $mm^2$ | 4967 | 5000 | 4967 |
| Ab30 | $mm^2$ | 1993 | 2017 | 1993 |
| S30 | $mm^2$ | 2974 | 2983 | 2974 |
| WA30/Ab30 | $mm^2$ | 3.49 | 3.48 | 3.49 |
| WA15 | $mm^2$ | 6547 | 6546 | 6562 |
| Af15 | $mm^2$ | 5503 | 5502 | 5502 |
| Ab15 | $mm^2$ | 1044 | 1044 | 1060 |
| S15 | $mm^2$ | 4459 | 4458 | 4442 |
| WA15/Ab15 | $mm^2$ | 6.269 | 6.271 | 6.193 |
| WA0 | $mm^2$ | 6058 | 6062 | 6193 |
| Af0 | $mm^2$ | 5571 | 5575 | 5571 |
| Ab0 | $mm^2$ | 487 | 487 | 622 |
| S0 | $mm^2$ | 5084 | 5088 | 4949 |
| \|S90\|/\|S15\| | — | 1.02 | 1.03 | 1.00 |
| (S15-S0)/15 | $mm^2$/deg | −42 | −42 | −34 |
| Value of θ at which Sθ is zero | degree | 52.1 | 51.7 | 52.6 |
| Value of θ at which WAθ/Abθ is 2.0 | degree | 52.1 | 51.7 | 52.6 |
| Head length H1 | mm | 125.0 | 125.0 | 127.0 |
| Head width W1 | mm | 123.0 | 123.0 | 123.0 |
| Head volume | $cm^3$ | 450 | 448 | 449 |
| Face progression FP | mm | 17.5 | 17.5 | 17.5 |

TABLE 2

Specifications and Evaluation Results of Comparative Examples

| | Unit | Comp. Ex. 1 PRIME 10 | Comp. Ex. 2 Z725 | Comp. Ex. 3 ZR-30 | Comp. Ex. 4 ZR-700 | Comp. Ex. 5 XXIO 11 | Comp. Ex. 6 |
|---|---|---|---|---|---|---|---|
| WA90 | $mm^2$ | 6666 | 6827 | 6835 | 7225 | 6784 | 7546 |
| Af90 | $mm^2$ | 1220 | 1270 | 1302 | 1384 | 1267 | 1388 |
| Ab90 | $mm^2$ | 5446 | 5557 | 5533 | 5841 | 5517 | 6159 |
| S90 | $mm^2$ | −4226 | −4287 | −4231 | −4456 | −4250 | −4771 |
| WA90/Ab90 | $mm^2$ | 1.224 | 1.229 | 1.235 | 1.237 | 1.230 | 1.225 |
| WA30 | $mm^2$ | 7010 | 6686 | 6690 | 7089 | 6869 | 6827 |
| Af30 | $mm^2$ | 4982 | 4907 | 5069 | 5365 | 5000 | 5408 |
| Ab30 | $mm^2$ | 2028 | 1778 | 1621 | 1724 | 1868 | 1419 |
| S30 | $mm^2$ | 2954 | 3129 | 3449 | 3641 | 3132 | 3990 |
| WA30/Ab30 | $mm^2$ | 3.46 | 3.76 | 4.13 | 4.11 | 3.68 | 4.81 |
| WA15 | $mm^2$ | 6562 | 6354 | 6483 | 6780 | 6487 | 6638 |
| Af15 | $mm^2$ | 5514 | 5440 | 5550 | 5869 | 5490 | 5902 |
| Ab15 | $mm^2$ | 1048 | 914 | 933 | 911 | 997 | 736 |
| S15 | $mm^2$ | 4466 | 4526 | 4618 | 4958 | 4494 | 5166 |
| WA15/Ab15 | $mm^2$ | 6.263 | 6.951 | 6.951 | 7.444 | 6.509 | 9.020 |
| WA0 | $mm^2$ | 6085 | 6263 | 6510 | 6677 | 6137 | 6848 |
| Af0 | $mm^2$ | 5593 | 5684 | 5858 | 6060 | 5645 | 6287 |
| Ab0 | $mm^2$ | 492 | 579 | 652 | 617 | 492 | 560 |
| S0 | $mm^2$ | 5101 | 5104 | 5205 | 5443 | 5153 | 5727 |
| \|S90\|/\|S15\| | — | 0.95 | 0.95 | 0.92 | 0.90 | 0.95 | 0.92 |
| (S15-S0)/15 | $mm^2$/deg | −42 | −39 | −39 | −32 | −44 | −37 |
| Value of θ at which Sθ is zero | degree | 53.2 | 54.9 | 57.5 | 57.2 | 55.4 | 58.3 |
| Value of θ at which WAθ/Abθ is 2.0 | degree | 53.2 | 54.9 | 57.5 | 57.2 | 55.4 | 58.3 |
| Head length H1 | mm | 123.9 | 114.6 | 117.3 | 118.8 | 124.8 | 124.9 |
| Head width W1 | mm | 114.7 | 108.0 | 103.5 | 106.3 | 115.1 | 121.0 |
| Head volume | $cm^3$ | 449 | 418 | 425 | 460 | 456 | 460 |
| Face progression FP | mm | 18.9 | 18.0 | 18.0 | 18.5 | 19.0 | 17.1 |

As these evaluation results indicate, the superiority of the present disclosure is obvious.

[Clause 1]

A golf club head including:

a face portion that forms a striking face;

a crown portion that forms a crown outer surface;

a sole portion that forms a sole outer surface; and a hosel portion that is configured to receive a shaft and that defines a shaft axis line, wherein the striking face has a face center, and a normal line at the face center, the golf club head has a head width in a face-back direction of greater than or equal to 100 mm, the golf club head has a head length in a toe-heel direction of greater than or equal to 110 mm, a state of the golf club head placed in such a manner that the shaft axis line is vertical to a horizontal plane and the normal line is parallel to a first perpendicular plane on which the shaft axis line lies is defined as a 0-degree state, a direction that is parallel to the first perpendicular plane and is parallel to the horizontal plane is defined as a projection direction, a projected area of the golf club head projected in the projection direction when the golf club head is rotated by θ° about the shaft axis line toward a back side from the 0-degree state is denoted by WAθ ($mm^2$), θ ranging from 0 to 90, the projected area is divided by the shaft axis line into two regions, of the two regions, a region to which a force acting in such a direction that the striking face is opened is applied due to air resistance during downswing is defined as a first region, and a region to which a force acting in such a direction that the striking face is closed is applied due to the air resistance is defined as a second region, an area of the first region is denoted by Afθ ($mm^2$), an area of the second region is denoted by Abθ ($mm^2$), a difference (Afθ−Abθ) is denoted by Sθ ($mm^2$), S90 is less than or equal to −4500 ($mm^2$), and S15 is less than or equal to 4700 ($mm^2$).

[Clause 2]

A golf club head including:

a face portion that forms a striking face;

a crown portion that forms a crown outer surface;

a sole portion that forms a sole outer surface; and a hosel portion that is configured to receive a shaft and that defines a shaft axis line, wherein the striking face has a face center, and a normal line at the face center, the golf club head has a head width in a face-back direction of greater than or equal to 100 mm, the golf club head has a head length in a toe-heel direction of greater than or equal to 110 mm, a state of the golf club head placed in such a manner that the shaft axis line is vertical to a horizontal plane and the normal line is parallel to a first perpendicular plane on which the shaft axis line lies is defined as a 0-degree state, a direction that is parallel to the first perpendicular plane and is parallel to the horizontal plane is defined as a projection direction, a projected area of the golf club head projected in the projection direction when the golf club head is rotated by θ° about the shaft axis line toward a back side from the 0-degree state is denoted by WAθ ($mm^2$), θ ranging from 0 to 90, the projected area is divided by the shaft axis line into two regions, of the two regions, a region to which a force acting in such a direction that the striking face is opened is applied due to air resistance during downswing is defined as a first region, and a region to which a force acting in such a direction that the striking face is closed is applied due to the air resistance is defined as a second region, an area of the first region is denoted by Afθ ($mm^2$), an area of the second region is denoted by Abθ ($mm^2$), a difference (Afθ−Abθ) is denoted by Sθ ($mm^2$), a ratio (WA90/Ab90) is less than or equal to 1.205, and a ratio (WA15/Ab15) is less than or equal to 7.00.

[Clause 3]

A golf club head including:

a face portion that forms a striking face;

a crown portion that forms a crown outer surface;

a sole portion that forms a sole outer surface; and a hosel portion that is configured to receive a shaft and that defines a shaft axis line, wherein the striking face has a face center, and a normal line at the face center, the golf club head has a head width in a face-back direction of greater than or equal to 100 mm, the golf club head has a head length in a toe-heel direction of greater than or equal to 110 mm, a state of the golf club head placed in such a manner that the shaft axis line is vertical to a horizontal plane and the normal line is parallel to a first perpendicular plane on which the shaft axis line lies is defined as a 0-degree state, a direction that is parallel to the first perpendicular plane and is parallel to the horizontal plane is defined as a projection direction, a projected area of the golf club head projected in the projection direction when the golf club head is rotated by θ° about the shaft axis line toward a back side from the 0-degree state is denoted by WAθ ($mm^2$), θ ranging from 0 to 90, the projected area is divided by the shaft axis line into two regions, of the two regions, a region to which a force acting in such a direction that the striking face is opened is applied due to air resistance during downswing is defined as a first region, and a region to which a force acting in such a direction that the striking face is closed is applied due to the air resistance is defined as a second region, an area of the first region is denoted by Afθ ($mm^2$), an area of the second region is denoted by Abθ ($mm^2$), a difference (Afθ-Abθ) is denoted by Sθ ($mm^2$), and a ratio (|S90|/|S15|) is greater than or equal to 1.00, where |S90| means an absolute value of S90, and |S15| means an absolute value of S15.

[Clause 4]

The golf club head according to any one of clauses 1 to 3, wherein a value of θ at which Sθ is zero is less than or equal to 55°.

[Clause 5]

The golf club head according to any one of clauses 1 to 4, wherein a value of θ at which a ratio (WAθ/Abθ) is 2.0 is less than or equal to 55°.

[Clause 6]

The golf club head according to any one of clauses 1 to 5, wherein (S15−S0)/15 is greater than −35 ($mm^2$/deg).

[Clause 7]

The golf club head according to any one of clauses 1 to 6, having a head volume of greater than or equal to 400 $cm^3$.

[Clause 8]

The golf club head according to any one of clauses 1 to 7, having a face progression of greater than or equal to 13 mm and less than or equal to 23 mm.

[Clause 9]

The golf club head according to any one of clauses 1 to 8, further including a protruding portion on an outer surface of the golf club head, wherein the protruding portion increases Ab90, and does not increase Af15.

[Clause 10]

The golf club head according to clause 9, wherein the protruding portion is provided on the crown outer surface.

LIST OF REFERENCE SYMBOLS

2 Golf club
4, 104, 204, 304 Head
6 Shaft
10, 110, 210, 310 Face portion
10*a*, 110*a*, 210*a*, 310*a* Striking face (Face)
12, 112, 212, 312 Crown portion
12*a*, 112*a*, 212*a*, 312*a* Crown outer surface
14, 114, 214, 314 Sole portion
14*a*, 114*a*, 214*a*, 314*a* Sole outer surface
16, 116, 216, 316 Hosel portion
20, 120, 220 Protruding portion
Z Shaft axis line
PD1 Projection direction The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising", "having", "including", and "containing" are to be construed as open-ended terms (i.e., meaning "including, but not limited to,") unless otherwise noted.

What is claimed is:

1. A right-handed golf club head comprising:

a face portion that forms a striking face;

a crown portion that forms a crown outer surface;

a sole portion that forms a sole outer surface;

a hosel portion that is configured to receive a shaft and that defines a shaft axis line, and a protruding portion disposed on an outer surface of the golf club head, wherein the striking face has a face center, and a normal line at the face center, the golf club head has a head width in a face-back direction of greater than or equal to 100 mm, the golf club head has a head length in a toe-heel direction of greater than or equal to 110 mm, a state of the golf club head placed in such a manner that the shaft axis line is vertical to a horizontal plane and the normal line is parallel to a first perpendicular plane on which the shaft axis line lies is defined as a 0-degree state, a direction that is parallel to the first perpendicular plane and is parallel to the horizontal plane is defined as a projection direction, a projected area of the golf club head projected in the projection direction when the golf club head is rotated by θ° about the shaft axis line toward a back side from the 0-degree state is denoted by WAθ ($mm^2$), θ ranging from 0 to 90, the projected area is divided by the shaft axis line into two regions, of the two regions, a left-side region is defined as a first region, and a right-side region is defined as a second region, an area of the first region is denoted by Afθ ($mm^2$), an area of the second region is denoted by Abθ ($mm^2$), a difference (Afθ−Abθ) is denoted by Sθ ($mm^2$), S90 is less than or equal to −4500 ($mm^2$), S15 is less than or equal to 4700 ($mm^2$), and the protruding portion increases Ab90 and does not increase Af15.

2. A golf club head comprising:

a face portion that forms a striking face;

a crown portion that forms a crown outer surface;

a sole portion that forms a sole outer surface;

a hosel portion that is configured to receive a shaft and that defines a shaft axis line, and a protruding portion disposed on an outer surface of the golf club head, wherein the striking face has a face center, and a normal line at the face center, the golf club head has a head width in a face-back direction of greater than or equal to 100 mm, the golf club head has a head length in a toe-heel direction of greater than or equal to 110 mm, a state of the golf club head placed in such a manner that the shaft axis line is vertical to a horizontal plane and the normal line is parallel to a first perpendicular plane on which the shaft axis line lies is defined as a 0-degree state, a direction that is parallel to the first perpendicular plane and is parallel to the horizontal plane is defined as a projection direction, a projected area of the golf club head projected in the projection direction when the golf club head is rotated by θ° about the shaft axis line toward a back side from the 0-degree state is denoted by WAθ ($mm^2$), θ ranging from 0 to 90, the projected area is divided by the shaft axis line into two regions, of the two regions, a region to which a force acting in such a direction that the striking face is opened is applied due to air resistance during downswing is defined as a first region, and a region to which a force acting in such a direction that the striking face is closed is applied due to the air resistance is defined as a second region, an area of the first region is denoted by Afθ ($mm^2$), an area of the second region is denoted by Abθ ($mm^2$), a difference (Afθ−Abθ) is denoted by Sθ ($mm^2$), a ratio ((|S90|/|S15|) is greater than or equal to 1.00, where |S90| means an absolute value of S90, and |S15| means an absolute value of S15, and the protruding portion increases Ab90 and does not increase Af15.

3. The golf club head according to claim 1, wherein a value of θ at which Sθ is zero is less than or equal to 55°.

4. The golf club head according to claim 1, wherein a value of θ at which a ratio (WAθ/Abθ) is 2.0 is less than or equal to 55°.

5. The golf club head according to claim 1, wherein (S15−S0)/15 is greater than −35 ($mm^2$/deg).

6. The golf club head according to claim 1, having a head volume of greater than or equal to 400 $cm^3$.

7. The golf club head according to claim 1, having a face progression of greater than or equal to 13 mm and less than or equal to 23 mm, wherein the face progression is a length from the shaft axis line to a frontmost point of the golf club head and is measured in the face-back direction.

8. The golf club head according to claim 1, wherein the protruding portion is provided on the crown outer surface.

9. The golf club head according to claim 2, wherein a value of θ at which Sθ is zero is less than or equal to 55°.

10. The golf club head according to claim 2, wherein a value of θ at which a ratio (WAθ/Abθ) is 2.0 is less than or equal to 55°.

11. The golf club head according to claim 2, wherein (S15−S0)/15 is greater than −35 ($mm^2$/deg).

12. The golf club head according to claim 2, wherein the protruding portion is provided on the crown outer surface.

* * * * *